US010730711B2

(12) United States Patent
Nakajima

(10) Patent No.: US 10,730,711 B2
(45) Date of Patent: Aug. 4, 2020

(54) PAPER SHEET RECYCLING AND PRINTING APPARATUS, PRINTING APPARATUS, AND PAPER SHEET RECYCLING APPARATUS

(71) Applicant: SEIKO EPSON CORPORATION, Tokyo (JP)

(72) Inventor: Yasumasa Nakajima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/313,926

(22) PCT Filed: Jun. 26, 2017

(86) PCT No.: PCT/JP2017/023448

§ 371 (c)(1),
(2) Date: Dec. 28, 2018

(87) PCT Pub. No.: WO2018/003754

PCT Pub. Date: Jan. 4, 2018

(65) Prior Publication Data

US 2019/0225439 A1 Jul. 25, 2019

(30) Foreign Application Priority Data

Jun. 30, 2016 (JP) ..... 2016-129815
Aug. 1, 2016 (JP) ..... 2016-151021
Jun. 20, 2017 (JP) ..... 2017-120285

(51) Int. Cl.
*B65H 3/44* (2006.01)
*B41J 13/10* (2006.01)
(Continued)

(52) U.S. Cl.
CPC ..... *B65H 3/44* (2013.01); *B41J 3/44* (2013.01); *B41J 11/485* (2013.01);
(Continued)

(58) Field of Classification Search
CPC ..... G03G 21/0005; B41M 7/0009; B41J 2202/37; B41J 29/26; B41J 29/36;
(Continued)

(56) References Cited

U.S. PATENT DOCUMENTS 5,463,447 A 10/1995 Kurotori et al.
5,612,766 A 3/1997 Iida et al.
(Continued)

FOREIGN PATENT DOCUMENTS

JP 04-356089 A 12/1992
JP 06-089068 A 3/1994
(Continued)

*Primary Examiner* — John Zimmermann
(74) *Attorney, Agent, or Firm* — Global IP Counselors, LLP

(57) ABSTRACT

There is provided a paper sheet recycling and printing apparatus including: a paper sheet recycling section which manufactures a recycled paper sheet under a first condition and a second condition different from the first condition; a first recycled paper sheet storage section in which the recycled paper sheet manufactured under the first condition is stored; a second recycled paper sheet storage section in which the recycled paper sheet manufactured under the second condition is stored; and a printing section to which the recycled paper sheet manufactured under the first condition is supplied from the first recycled paper sheet storage section and which prints recording information on a recording target medium including the recycled paper sheet.

39 Claims, 20 Drawing Sheets

(51) Int. Cl.

| | |
|---|---|
| ***B65H 31/24*** | (2006.01) |
| ***B41J 13/00*** | (2006.01) |
| ***B41J 3/44*** | (2006.01) |
| ***B41J 11/48*** | (2006.01) |

(52) U.S. Cl.
CPC ..... *B41J 13/0018* (2013.01); *B41J 13/103* (2013.01); *B65H 31/24* (2013.01); *B65H 2801/84* (2013.01)

(58) Field of Classification Search
CPC ..... B41J 13/103; H04N 2201/0094; B65H 2801/84; B65H 3/44
See application file for complete search history.

(56) References Cited

U.S. PATENT DOCUMENTS 5,678,157 A 10/1997 Yoshida et al.
5,970,272 A * 10/1999 Kobayashi ..... B41M 7/0009 134/122 R
8,177,347 B2 * 5/2012 Brewington ..... G03G 15/5029 347/101
8,489,010 B2 * 7/2013 Taki ..... G03G 21/00 271/3.06
8,538,280 B2 * 9/2013 Yahata ..... H04N 1/00567 399/1
8,538,317 B2 * 9/2013 Iguchi ..... G03G 15/6529 399/407
8,941,702 B2 * 1/2015 Fukaya ..... B41J 13/0009 347/179
9,036,201 B2 * 5/2015 Hagiwara ..... B41J 2/32 358/1.14
2009/0103147 A1 4/2009 Murakami
2011/0008638 A1 * 1/2011 Miyawaki ..... D21H 11/18 428/537.5
2014/0027075 A1 * 1/2014 Yamagami ..... D21B 1/08 162/4

FOREIGN PATENT DOCUMENTS

JP 07-175384 A 7/1995
JP 07-245668 A 9/1995
JP 07-261612 A 10/1995
JP 10-171318 A 6/1998
JP 2008-033034 A 2/2008

* cited by examiner

PAPER SHEET RECYCLING AND PRINTING APPARATUS, PRINTING APPARATUS, AND PAPER SHEET RECYCLING APPARATUS

CROSS-REFERENCE TO RELATED APPLICATIONS

This application is a U.S. National stage application of International Patent Application No. PCT/JP2017/023448, filed on Jun. 26, 2017, which claims priority under 35 U.S.C. § 119(a) to Japanese Patent Application No. 2016-129815, filed in Japan on Jun. 30, 2016, Japanese Patent Application No. 2016-151021, filed in Japan on Aug. 1, 2016, and Japanese Patent Application No. 2017-120285, filed in Japan on Jun. 20, 2017. The entire disclosures of Japanese Patent Application Nos. 2016-129815, 2016-151021, and 2017-120285 are hereby incorporated herein by reference.

TECHNICAL FIELD

The present invention relates to a paper sheet recycling and printing apparatus, a printing apparatus, and a paper sheet recycling apparatus.

BACKGROUND ART

Paper recycling has been widely generalized from the viewpoint of resource utilization, but in the past, industrial manufacturing of a recycled paper sheet from an accumulated waste paper sheet was employed. In recent years, however, a technique and apparatus for forming a document printed and discarded in a business office into a recycled paper sheet in a business office and inserting the recycled paper sheet as a printing paper sheet to a printing machine have been disclosed (refer to Japanese Unexamined Patent Application Publication Nos. 7-175384, 10-171318, and 2008-33034).

Each of the inventions disclosed in Japanese Unexamined Patent Application Publication Nos. 7-175384, 10-171318, and 2008-33034 is a combined apparatus that supplies a recycled paper sheet directly to a printing apparatus from an apparatus for recycling a paper sheet on which the printing is finished, that is, a so-called waste paper sheet, and recycling of the waste paper sheet and printing onto the recycled paper sheet can be continuously performed.

The method of recycling the waste paper sheet in the apparatuses disclosed in Japanese Unexamined Patent Application Publication Nos. 7-175384, 10-171318, and 2008-33034 manufactures a recording target medium on which new printing is possible by physically removing a recording medium which is called a toner that adheres to a surface of the recording target medium (paper sheet). Contrary to this, a small-sized apparatus has been suggested in which the waste paper sheet is pulverized to a fibrous form and a new paper sheet can be manufactured, but in this case, it is possible to stabilize the quality of the recycled paper sheet and obtain high productivity by continuously inserting the waste paper sheet to be inserted into a recycling step and by continuously operating the apparatus.

By the continuous operation of the above-described apparatus, the recycled paper sheets are continuously supplied from the recycling apparatus to a paper sheet tray and the like of the printing apparatus. Meanwhile, since the printing apparatuses are normally used intermittently, when the recycled paper sheets stored in the paper sheet tray are held by paper sheet pickup means for printing, substantially at the same time, there may be a case where the recycled paper sheet is supplied from the recycling apparatus to the paper sheet tray. In this case, there is a concern of occurrence of jamming caused by paper sheet complication of two paper sheets.

In addition, in the inventions disclosed in Japanese Unexamined Patent Application Publication Nos. 7-175384, 10-171318, and 2008-33034, the recycled paper sheet is supplied as a paper sheet for printing to the printing apparatus, but there is also a case where, for the use other than the printing, the recycled paper sheet, such as a recycled paper sheet to be supplied for the printing of another printing machine or a paper sheet for handwritten memo, is supplied as it is. At this time, in the inventions disclosed in Japanese Unexamined Patent Application Publication Nos. 7-175384, 10-171318, and 2008-33034, the recycled paper sheet recycled by the apparatus is stored in a paper sheet cassette or the paper sheet tray of a printing paper sheet supply section as a paper sheet for printing to the printing apparatus. Therefore, in a case of providing the recycled paper sheet for the use other than the printing, the printing apparatus is stopped, the paper sheet recycling apparatus is further stopped, and after this, the necessary quantity of the recycled paper sheets is taken out from the paper sheet cassette or the paper sheet tray. In other words, there is a problem that the printing apparatus or the paper sheet recycling apparatus is stopped, and the working efficiency remarkably deteriorates.

According to this, the printing apparatus or the paper sheet recycling apparatus is stopped, and the working efficiency remarkably deteriorates. Here, the present invention is to provide a paper sheet recycling and printing apparatus that prevents occurrence of jamming due to the paper sheet complication, can continuously operate a paper sheet recycling apparatus, and can manufacture a recycled paper sheet that is not to be supplied for printing while operating a printing apparatus.

SUMMARY

The present invention has been made to solve at least a part of the above-described problems, and an object thereof is to obtain a paper sheet recycling and printing apparatus that can continuously operate a paper sheet recycling apparatus by storing a recycled paper sheet and can manufacture the recycled paper sheet that is not to be supplied for printing while operating a printing apparatus.

Application Example 1

According to this application example, there is provided a paper sheet recycling and printing apparatus including: a paper sheet recycling section which manufactures a recycled paper sheet under a first condition and a second condition different from the first condition; a first recycled paper sheet storage section in which the recycled paper sheet manufactured under the first condition is stored; a second recycled paper sheet storage section in which the recycled paper sheet manufactured under the second condition is stored; and a printing section to which the recycled paper sheet manufactured under the first condition is supplied from the first recycled paper sheet storage section and which prints recording information on a recording target medium including the recycled paper sheet.

The paper sheet recycling and printing apparatus of this application example is an apparatus system which can directly transport the recycled paper sheet manufactured by the paper sheet recycling section to the printing section and obtain a printed material. In addition, according to the paper sheet recycling and printing apparatus of this application example, the first recycled paper sheet storage section in which the recycled paper sheet manufactured under the first condition by the paper sheet recycling section can be stored, and the second recycled paper sheet storage section in which the recycled paper sheet manufactured under the second condition by the paper sheet recycling section can be stored, are provided. Accordingly, by storing the recycled paper sheet manufactured under the first condition and transporting the stored recycled paper sheet manufactured under the first condition to the printing section, it is possible to lengthen the continuous operation time of the paper sheet recycling section, and to provide a recycled paper sheet having a stable quality.

Further, according to the paper sheet recycling and printing apparatus of this application example, it is possible to manufacture the recycled paper sheet manufactured under the second condition provided in various forms, such as the recycled paper sheet that is not to be supplied for the printing (recycled paper sheet manufactured under the second condition), for example, a recycled paper sheet to be supplied for the printing of another printing machine or a paper sheet for handwritten memo, together with the recycled paper sheet manufactured under the first condition that is to be supplied for the printing. In addition, the recycled paper sheet manufactured under the second condition that is not to be supplied for the printing can be stored in the second recycled paper sheet storage section individually. Therefore, even in a case where the printing is executed in the paper sheet recycling and printing apparatus, it is possible to take out the recycled paper sheet that is not to be supplied for the printing. In addition, it is also possible to prevent the recycled paper sheet manufactured under the first condition that is to be supplied for the printing and the recycled paper sheet manufactured under the second condition that is not to be supplied for the printing from being intermixed with each other.

Application Example 2

The paper sheet recycling and printing apparatus of the above-described application example, further includes a first recycled paper sheet supply section which supplies the recycled paper sheet from the paper sheet recycling section to the first recycled paper sheet storage section; and a second recycled paper sheet supply section which supplies the recycled paper sheet to the second recycled paper sheet storage section.

According to the paper sheet recycling and printing apparatus of this application example, the first recycled paper sheet supply section which supplies the recycled paper sheet formed by the paper sheet recycling section to the first recycled paper sheet storage section; and the second recycled paper sheet supply section which supplies the recycled paper sheet to the second recycled paper sheet storage section, are provided. Accordingly, by storing the recycled paper sheet and transporting the stored recycled paper sheet to the printing section, it is possible to lengthen the continuous operation time of the paper sheet recycling section, and to provide a recycled paper sheet having a stable quality.

Application Example 3

The paper sheet recycling and printing apparatus of the above-described application example, further includes a transport section which transports the recycled paper sheet manufactured under the first condition and stored in the first recycled paper sheet storage section to the printing section.

According to the above-described application example, it is possible to transport the recycled paper sheet manufactured under the first condition in the paper sheet recycling section to the printing section in the paper sheet recycling and printing apparatus.

Application Example 4

The paper sheet recycling and printing apparatus of the above-described application example, further includes supply section switching means for switching between the first recycled paper sheet supply section and the second recycled paper sheet supply section.

According to the above-described application example, it is possible to transport and supply a predetermined recycled paper sheet (recycled paper sheet to be supplied for the printing or recycled paper sheet that is not to be supplied for the printing) to the first recycled paper sheet supply section and the second recycled paper sheet supply section.

Application Example 5

According to the paper sheet recycling and printing apparatus of the above-described application example, a plurality of the first recycled paper sheet storage sections is further provided.

According to the above-described application example, by providing the plurality of first recycled paper sheet storage sections in which the recycled paper sheet formed by the paper sheet recycling section can be stored, it is possible to increase the storage amount of the recycled paper sheets, to lengthen the continuous operation time of the stored paper sheet recycling section, and to provide a recycled paper sheet having a stable quality.

Application Example 6

According to the paper sheet recycling and printing apparatus of the above-described application example, the second recycled paper sheet storage section makes it possible to take out the stored recycled paper sheet manufactured under the second condition from the outside.

According to the above-described application example, even when the paper sheet recycling and printing apparatus is in operation, it is possible to take out the desired recycled paper sheet manufactured under the second condition from the paper sheet recycling and printing apparatus without interrupting the driving.

Application Example 7

The paper sheet recycling and printing apparatus of the above-described application example further includes a printed material storage section in which a printed material obtained by printing the recording information on the recording target medium by the printing section is stored, and the printed material storage section also serves as the second recycled paper sheet storage section.

According to the above-described application example, as the printed material storage section which discharges and stores the printed material is integrated as a discharge and storage section of the paper sheet manufactured by the paper sheet recycling and printing apparatus including the recycled paper sheet manufactured under the second condition, it is possible to simplify the apparatus configuration.

In addition, as the printed material storage section which discharges the printed material provided in the printing section also serves as the second recycled paper sheet storage section, and also discharges the recycled paper sheet that is not to be supplied to the printing, it is possible to simplify the apparatus. In addition, by printing a fixed word or object, such as a logo mark or a company name, through the printing section only at a margin predetermined position on the recycled paper sheet that is not to be supplied for the printing and by discharging the recycled paper sheet, it is possible to easily obtain a recycled paper sheet cut form.

Application Example 8

According to the paper sheet recycling and printing apparatus of the above-described application example, the recycled paper sheet is not supplied to a predetermined first recycled paper sheet storage section among the plurality of first recycled paper sheet storage sections and the recycled paper sheet stored in the predetermined first recycled paper sheet storage section is transported to the printing section by the transport section.

According to the above-described application example, in the predetermined first recycled paper sheet storage section, only the supply of the recycled paper sheet to the printing section is performed, and the supply of the recycled paper sheet from the paper sheet recycling section, that is, so-called replenishment, is not performed. Therefore, it is possible to avoid occurrence of jamming caused by the paper sheet complication in the predetermined first recycled paper sheet storage section.

Application Example 9

According to the paper sheet recycling and printing apparatus of the above-described application example, the first recycled paper sheet supply section includes storage section switching means that is capable of transporting the recycled paper sheet to one of the plurality of first recycled paper sheet storage sections.

According to the above-described application example, the first recycled paper sheet supply section can select the first recycled paper sheet storage section having a region in which the recycled paper sheet can be stored among the plurality of first recycled paper sheet storage sections, and supply the recycled paper sheet. Therefore, in the paper sheet recycling and printing apparatus, it is possible to continuously supply the recycled paper sheet consumed by the printing. Accordingly, it is possible to continuously operate the paper sheet recycling section provided in the paper sheet recycling and printing apparatus, and to obtain a recycled paper sheet having a stable quality.

Application Example 10

According to the paper sheet recycling and printing apparatus of the above-described application example, the transport section makes it possible to transport the recycled paper sheet manufactured under the second condition and stored in the second recycled paper sheet storage section to the printing section, the printing section includes a paper sheet transport path including printing means for printing the recording information on the recording target medium, and the recycled paper sheet manufactured under the second condition, transported to the printing section and stored in the second recycled paper sheet storage section, is transported through the paper sheet transport path with or without executing printing by the printing means, and is stored in the printed material storage section.

According to the above-described application example, by transporting the recycled paper sheet manufactured under the second condition that is not to be supplied for the printing through the transport path including the printing means in which the recording target medium including the recycled paper sheet manufactured under the first condition and printed in the printing section is transported in the printing section, it is possible to simplify the transport path of the recycled paper sheet in the paper sheet recycling and printing apparatus or a new paper sheet to be supplied for the printing. In a case where the printing is executed by the printing means with respect to the recycled paper sheet manufactured under the second condition, for example, a logo mark is printed.

Application Example 11

According to the paper sheet recycling and printing apparatus of the above-described application example, the storage section switching means switches to supply of the recycled paper sheet from the first recycled paper sheet supply section to one first recycled paper sheet storage section in which there is no recycled paper sheet among the plurality of first recycled paper sheet storage sections.

According to the above-described application example, since one first recycled paper sheet storage section in which there is no recycled paper sheet is selected among the plurality of first recycled paper sheet storage sections which supplies the recycled paper sheet to the printing section, and is switched to the supply of the recycled paper sheet, when taking out the recycled paper sheet from the first recycled paper sheet storage section, there is no case where the recycled paper sheet is inadvertently supplied from the paper sheet recycling section. In other words, it is possible to avoid occurrence of jamming caused by the paper sheet complication in the first recycled paper sheet storage section.

Application Example 12

According to the paper sheet recycling and printing apparatus of the above-described application example, the transport section includes transport switching means for setting one of the plurality of first recycled paper sheet storage sections in which the recycled paper sheet is stored as the first recycled paper sheet storage section which supplies the recycled paper sheet manufactured under the first condition to the printing section when there is no recycled paper sheet stored in the first recycled paper sheet storage section, and transporting the recycled paper sheet from the set first recycled paper sheet storage section.

According to the above-described application example, when there is no recycled paper sheet stored in the first recycled paper sheet storage section, a new first recycled paper sheet storage section is set among the plurality of first recycled paper sheet storage sections by the transport switching means, and the recycled paper sheet is transported. Therefore, when taking out the recycled paper sheet, there is no case where the recycled paper sheet is inadvertently supplied from the paper sheet recycling section. In other words, it is possible to avoid occurrence of jamming caused by the paper sheet complication in the first recycled paper sheet storage section.

Application Example 13

The paper sheet recycling and printing apparatus of the above-described application example further includes a setting section, and a control is performed based on setting of the setting section.

According to the above-described application example, the control of the paper sheet recycling and printing apparatus is performed by the setting section which sets the type of the paper sheet, that is, whether the recording target medium to be supplied for the printing is "new paper sheet" or "recycled paper sheet manufactured under the first condition", or a print instruction, such as "perform the printing of a log mark or the like on the recycled paper sheet manufactured under the second condition".

Application Example 14

According to the paper sheet recycling and printing apparatus of the above-described application example, the paper sheet recycling section manufactures the recycled paper sheet manufactured under the first condition or the recycled paper sheet manufactured under the second condition based on the setting of the setting section.

According to the above-described application example, in the paper sheet recycling and printing apparatus of this application example in which the recycled paper sheet is manufactured under a plurality of conditions different from each other, based on setting information of the manufactured recycled paper sheet set in the setting section, it is possible to transport the predetermined paper sheet including the recycled paper sheet to the storage section or the printed material storage section, and to store the paper sheet in the storage section or the printed material storage section.

Application Example 15

According to another application example, there is provided a printing apparatus including: a determining section which determines whether a recycled paper sheet to be supplied from a paper sheet recycling apparatus is a recycled paper sheet manufactured under a first condition or a recycled paper sheet manufactured under a second condition different from the first condition; a first recycled paper sheet storage section in which the recycled paper sheet manufactured under the first condition is stored; a second recycled paper sheet storage section in which the recycled paper sheet manufactured under the second condition is stored; and a printing section to which the recycled paper sheet manufactured under the first condition is supplied from the first recycled paper sheet storage section and which prints recording information on a recording target medium including the recycled paper sheet.

The printing apparatus of this application example can directly transport the recycled paper sheet manufactured by the paper sheet recycling apparatus to the printing section and obtain the printed material. In addition, it is possible to configure a paper sheet recycling and printing system by combining the paper sheet recycling apparatus with the printing apparatus of this application example.

According to the printing apparatus of this application example, the first recycled paper sheet storage section and the second recycled paper sheet storage section in which the recycled paper sheet manufactured by the paper sheet recycling apparatus can be stored, are provided.

Accordingly, by storing the recycled paper sheet manufactured under the first condition in the first recycled paper sheet storage section and transporting the stored recycled paper sheet manufactured under the first condition to the printing section, it is possible to lengthen the continuous operation time of the paper sheet recycling section, and to provide a recycled paper sheet having a stable quality.

Application Example 16

The printing apparatus of the above-described application example, further includes a first recycled paper sheet supply section which supplies the recycled paper sheet from the paper sheet recycling apparatus to the first recycled paper sheet storage section; and a second recycled paper sheet supply section which supplies the recycled paper sheet to the second recycled paper sheet storage section.

The printing apparatus of this application example can configure the paper sheet recycling and printing system with the paper sheet recycling apparatus that can form and supply the recycled paper sheet that serves as the recording target medium. In addition, according to the printing apparatus of this application example, the first recycled paper sheet storage section and the second recycled paper sheet storage section in which the recycled paper sheet formed by the paper sheet recycling apparatus can be stored, are provided. Accordingly, by storing the recycled paper sheet and transporting the stored recycled paper sheet to the printing apparatus, it is possible to lengthen the continuous operation time of the paper sheet recycling apparatus, and to provide a recycled paper sheet having a stable quality.

Further, according to the printing apparatus of this application example, it is possible to form the recycled paper sheet provided in various forms (recycled paper sheet manufactured under the second condition), such as the recycled paper sheet that is not to be supplied for the printing, for example, a recycled paper sheet to be supplied for the printing of another printing machine or a paper sheet for handwritten memo, together with the recycled paper sheet to be supplied for the printing (recycled paper sheet manufactured under the first condition). In addition, the recycled paper sheet that is not to be supplied for the printing can be directly taken out from the second recycled paper sheet storage section individually. Therefore, even in a case where the printing is executed in the printing apparatus, it is possible to acquire the recycled paper sheet that is not to be supplied for the printing.

Application Example 17

The printing apparatus of the above-described application example, further includes a transport section which transports at least the recycled paper sheet manufactured under the first condition and stored in the first recycled paper sheet storage section to the printing section.

According to the above-described application example, it is possible to transport the recycled paper sheet manufactured under the first condition in the paper sheet recycling apparatus to the printing section of the printing apparatus.

Application Example 18

The printing apparatus of the above-described application example, further includes supply section switching means for switching between the first recycled paper sheet supply section and the second recycled paper sheet supply section.

According to the above-described application example, it is possible to transport and supply a predetermined recycled paper sheet (recycled paper sheet to be supplied for the printing or recycled paper sheet that is not to be supplied for the printing) to the first recycled paper sheet supply section and the second recycled paper sheet supply section.

Application Example 19

According to the printing apparatus of the above-described application example, a plurality of the first recycled paper sheet storage sections is further provided.

According to the above-described application example, by providing the plurality of first recycled paper sheet storage sections in which the recycled paper sheet formed by the paper sheet recycling apparatus can be stored, it is possible to increase the storage amount of the recycled paper sheets, to lengthen the continuous operation time of the storage paper sheet recycling apparatus, and to provide a recycled paper sheet having a stable quality.

Application Example 20

According to the printing apparatus of the above-described application example, the second recycled paper sheet storage section makes it possible to take out the stored recycled paper sheet manufactured under the second condition from the outside.

According to the above-described application example, even when the printing apparatus is in operation, it is possible to take out the desired recycled paper sheet manufactured under the second condition from the printing apparatus of the paper sheet recycling and printing system without interrupting the driving.

Application Example 21

The printing apparatus of the above-described application example further includes a printed material storage section in which a printed material obtained by printing the recording information on the recording target medium by the printing section is stored, and the printed material storage section also serves as the second recycled paper sheet storage section.

According to the above-described application example, as the printed material storage section which discharges and stores the printed material is integrated as a discharge and storage section of the paper sheet manufactured by the paper sheet recycling apparatus including the recycled paper sheet manufactured under the second condition, it is possible to simplify the apparatus configuration.

Application Example 22

According to the printing apparatus of the above-described application example, the recycled paper sheet is not supplied to a predetermined first recycled paper sheet storage section among the plurality of first recycled paper sheet storage sections and the recycled paper sheet stored in the predetermined first recycled paper sheet storage section is transported to the printing section by the transport section.

According to the above-described application example, in the predetermined first recycled paper sheet storage section, only the supply of the recycled paper sheet to the printing apparatus is performed, and the supply of the recycled paper sheet from the paper sheet recycling apparatus, that is, so-called replenishment, is not performed. Therefore, it is possible to avoid occurrence of jamming caused by the paper sheet complication in the predetermined first recycled paper sheet storage section.

Application Example 23

According to the printing apparatus of the above-described application example, the first recycled paper sheet supply section includes storage section switching means that is capable of transporting the recycled paper sheet to one of the plurality of first recycled paper sheet storage sections.

According to the above-described application example, the first recycled paper sheet supply section can select the first recycled paper sheet storage section having a region in which the recycled paper sheet can be stored among the plurality of first recycled paper sheet storage sections, and supply the recycled paper sheet. Therefore, in the printing apparatus, it is possible to continuously supply the recycled paper sheet consumed by the printing. Accordingly, it is possible to continuously operate the paper sheet recycling apparatus, and to obtain a recycled paper sheet having a stable quality.

Application Example 24

According to the printing apparatus of the above-described application example, the transport section makes it possible to transport the recycled paper sheet manufactured under the second condition and stored in the second recycled paper sheet storage section to the printing section, the printing section includes a paper sheet transport path including printing means for printing the recording information on the recording target medium, and the recycled paper sheet manufactured under the second condition, transported to the printing section and stored in the second recycled paper sheet storage section, is transported through the paper sheet transport path with or without executing printing by the printing means, and is stored in the printed material storage section.

According to the above-described application example, by transporting the recycled paper sheet manufactured under the second condition that is not to be supplied for the printing through the transport path including the printing means in which the recording target medium including the recycled paper sheet manufactured under the first condition printed in the printing section is transported in the printing section, it is possible to simplify the transport path of the recycled paper sheet in the paper sheet recycling and printing system or a new paper sheet to be supplied for the printing.

Application Example 25

According to the printing apparatus of the above-described application example, the storage section switching means switches to supply of the recycled paper sheet from the first recycled paper sheet supply section to one first recycled paper sheet storage section in which there is no recycled paper sheet among the plurality of first recycled paper sheet storage sections.

According to the above-described application example, since one first recycled paper sheet storage section in which there is no recycled paper sheet is selected among the plurality of first recycled paper sheet storage sections which supplies the recycled paper sheet to the printing section, and is switched to the supply of the recycled paper sheet, when taking out the recycled paper sheet from the first recycled paper sheet storage section, there is no case where the recycled paper sheet is inadvertently supplied from the paper sheet recycling section. In other words, it is possible to avoid occurrence of jamming caused by the paper sheet complication in the first recycled paper sheet storage section.

Application Example 26

According to the printing apparatus of the above-described application example, the second recycled paper sheet supply section supplies the recycled paper sheet to the printing section, and the unprinted recycled paper sheet is discharged to a recording target medium discharge section (printed material storage section) by which the recording target medium is discharged from the printing section.

According to the above-described application example, by discharging the recycled paper sheet that is not to be supplied for the printing to the recording target medium discharge section (printed material storage section) by which the printed material provided in the printing section is discharged, it is possible to simplify the apparatus. In addition, by discharging the recycled paper sheet that is not to be supplied for the printing via the printing apparatus, it is possible to easily obtain a recycled paper sheet cut form on which, for example, a logo mark, a company name, or the like is printed in the margin.

Application Example 27

The printing apparatus of the above-described application example further includes a setting section, and a control is performed based on setting of the setting section.

According to the above-described application example, the controls of the printing apparatus and the paper sheet recycling and printing system are performed by the setting section which sets the type of the paper sheet, that is, whether the recording target medium to be supplied for the printing is "new paper sheet" or "recycled paper sheet manufactured under the first condition", or a print instruction, such as "perform the printing of a log mark or the like on the recycled paper sheet manufactured under the second condition".

Application Example 28

According to the printing apparatus of the above-described application example, the determining section performs determination based on the setting of the setting section.

According to the above-described application example, in the printing apparatus of this application example provided in the paper sheet recycling and printing system in which the recycled paper sheet is manufactured under a plurality of conditions different from each other by the paper sheet recycling apparatus, based on the setting information of the manufactured recycled paper sheet set in the setting section, it is possible to transport the predetermined paper sheet including the recycled paper sheet to the storage section or the printed material storage section, and to store the paper sheet in the storage section or the printed material storage section.

Application Example 29

According to a still another application example, there is provided a paper sheet recycling apparatus including: a paper sheet recycling section which manufactures a recycled paper sheet; a determining section which determines whether the recycled paper sheet is a recycled paper sheet manufactured under a first condition or a recycled paper sheet manufactured under a second condition different from the first condition; a first recycled paper sheet storage section in which the recycled paper sheet manufactured under the first condition is stored; and a second recycled paper sheet storage section in which the recycled paper sheet manufactured under the second condition is stored, in which the recycled paper sheet manufactured under the first condition is supplied from the first recycled paper sheet storage section to a printing apparatus.

The paper sheet recycling apparatus of this application example can directly transport the recycled paper sheet manufactured by the paper sheet recycling section to the printing apparatus and obtain the printed material. In addition, it is possible to configure a paper sheet recycling and printing system by combining the printing apparatus with the paper sheet recycling apparatus of this application example.

In the paper sheet recycling apparatus of this application example, the first recycled paper sheet storage section and the second recycled paper sheet storage section in which the manufactured recycled paper sheet can be stored, are provided. Accordingly, by storing the recycled paper sheet manufactured under the first condition in the first recycled paper sheet storage section and transporting the stored recycled paper sheet manufactured under the first condition to the printing apparatus, it is possible to lengthen the continuous operation time of the paper sheet recycling section, and to provide a recycled paper sheet having a stable quality.

Application Example 30

The paper sheet recycling apparatus of the above-described application example, further includes a first recycled paper sheet supply section which supplies the recycled paper sheet to the first recycled paper sheet storage section, a second recycled paper sheet supply section which supplies the recycled paper sheet to the second recycled paper sheet storage section, and supply section switching means which switches the first recycled paper sheet supply section and the second recycled paper sheet supply section.

The paper sheet recycling apparatus of this application example can configure the paper sheet recycling and printing system by the printing apparatus which prints the recording information on the recycled paper sheet which is formed and supplied as the recording target medium. In addition, according to the paper sheet recycling apparatus of this application example, the first recycled paper sheet storage section which is provided in the paper sheet recycling apparatus and in which the recycled paper sheet can be stored, is provided. Accordingly, by storing the recycled paper sheet and transporting the stored recycled paper sheet to the printing apparatus, it is possible to lengthen the continuous operation time of the paper sheet recycling apparatus, and to provide a recycled paper sheet having a stable quality.

Further, according to the paper sheet recycling apparatus of this application example, it is possible to form the recycled paper sheet provided in various forms, such as the recycled paper sheet that is not to be supplied for the printing, for example, a recycled paper sheet to be supplied for the printing of another printing machine or a paper sheet for handwritten memo, together with the recycled paper sheet to be supplied for the printing. In addition, the recycled paper sheet that is not to be supplied for the printing can be directly taken out from the recycled paper sheet discharge section (second recycled paper sheet storage section) individually. Therefore, even in a case where the printing is executed in the printing apparatus, it is possible to acquire the recycled paper sheet that is not to be supplied for the printing.

Application Example 31

The paper sheet recycling apparatus of the above-described application example, further includes a transport section which transports at least the recycled paper sheet manufactured under the first condition and stored in the first recycled paper sheet storage section to the printing apparatus.

According to the above-described application example, it is possible to transport the recycled paper sheet manufactured under the first condition in the paper sheet recycling section to the printing apparatus.

Application Example 32

According to the paper sheet recycling apparatus of the above-described application example, a plurality of the first recycled paper sheet storage sections is further provided.

According to the above-described application example, by providing the plurality of first recycled paper sheet storage sections in which the recycled paper sheet formed by the paper sheet recycling apparatus can be stored, it is possible to increase the storage amount of the recycled paper sheets, to lengthen the continuous operation time of the storage paper sheet recycling apparatus, and to provide a recycled paper sheet having a stable quality.

Application Example 33

According to the paper sheet recycling apparatus of the above-described application example, the second recycled paper sheet storage section makes it possible to take out the stored recycled paper sheet manufactured under the second condition from the outside.

According to the above-described application example, even when the printing apparatus is in operation, it is possible to take out the desired recycled paper sheet manufactured under the second condition from the paper sheet recycling apparatus of the paper sheet recycling and printing system without interrupting the driving.

Application Example 34

According to the paper sheet recycling apparatus of the above-described application example, the recycled paper sheet is not supplied to a predetermined first recycled paper sheet storage section among the plurality of first recycled paper sheet storage sections and the recycled paper sheet stored in the predetermined first recycled paper sheet storage section is transported to the printing apparatus by the transport section.

According to the above-described application example, in the predetermined first recycled paper sheet storage section, only the supply of the recycled paper sheet to the printing section is performed, and the supply of the recycled paper sheet from the paper sheet recycling section, that is, so-called replenishment, is not performed. Therefore, it is possible to avoid occurrence of jamming caused by the paper sheet complication in the predetermined first recycled paper sheet storage section.

Application Example 35

According to the paper sheet recycling apparatus of the above-described application example, the first recycled paper sheet supply section includes storage section switching means that is capable of transporting the recycled paper sheet to one of the plurality of first recycled paper sheet storage sections.

According to the above-described application example, the first recycled paper sheet supply section can select the first recycled paper sheet storage section having a region in which the recycled paper sheet can be stored among the plurality of first recycled paper sheet storage sections, and supply the recycled paper sheet. Therefore, in the printing apparatus, it is possible to continuously supply the recycled paper sheet consumed by the printing. Accordingly, it is possible to continuously operate the paper sheet recycling section provided in the paper sheet recycling apparatus, and to obtain a recycled paper sheet having a stable quality.

Application Example 36

According to the paper sheet recycling apparatus of the above-described application example, the transport section makes it possible to transport the recycled paper sheet manufactured under the second condition and stored in the second recycled paper sheet storage section to the printing apparatus, and the recycled paper sheet manufactured under the second condition, stored in the second recycled paper sheet storage section, and transported to the printing apparatus is stored in the printed material storage section provided in the printing apparatus with or without executing the printing.

According to the above-described application example, by transporting the recycled paper sheet manufactured under the second condition that is not to be supplied for the printing through the transport path including the printing means in which the recording target medium including the recycled paper sheet manufactured under the first condition printed in the printing apparatus is transported in the printing apparatus, it is possible to simplify the transport path of the recycled paper sheet in the paper sheet recycling and printing system or a new paper sheet to be supplied for the printing.

Application Example 37

According to the paper sheet recycling apparatus of the above-described application example, the storage section switching means switches to supply of the recycled paper sheet from the first recycled paper sheet supply section to one first recycled paper sheet storage section in which there is no recycled paper sheet among the plurality of first recycled paper sheet storage sections.

According to the above-described application example, since one first recycled paper sheet storage section in which there is no recycled paper sheet is selected among the plurality of first recycled paper sheet storage sections which supplies the recycled paper sheet to the printing apparatus, and is switched to the supply of the recycled paper sheet, when taking out the recycled paper sheet from the first recycled paper sheet storage section, there is no case where the recycled paper sheet is inadvertently supplied from the paper sheet recycling section. In other words, it is possible to avoid occurrence of jamming caused by the paper sheet complication in the first recycled paper sheet storage section.

Application Example 38

The paper sheet recycling apparatus of the above-described application example, further includes a setting section, and a control is performed based on setting of the setting section.

According to the above-described application example, the controls of the paper sheet recycling apparatus and the paper sheet recycling and printing system are performed by the setting section which sets the type of the paper sheet, that is, whether the recording target medium to be supplied for the printing is "new paper sheet" or "recycled paper sheet manufactured under the first condition", or a print instruction, such as "perform the printing of a log mark or the like on the recycled paper sheet manufactured under the second condition".

Application Example 39

According to the paper sheet recycling apparatus of the above-described application example, the determining section performs determination based on the setting of the setting section.

According to the above-described application example, in the paper sheet recycling apparatus of this application example provided in the paper sheet recycling and printing system in which the recycled paper sheet is manufactured under a plurality of conditions different from each other by the paper sheet recycling section, based on the setting information of the manufactured recycled paper sheet set in the setting section, it is possible to transport the predetermined paper sheet including the recycled paper sheet to the storage section or the printed material storage section, and to store the paper sheet in the storage section or the printed material storage section.

DESCRIPTION OF EMBODIMENTS

Hereinafter, embodiments of the present invention will be described with reference to the drawings.

First Embodiment

Figure 1:
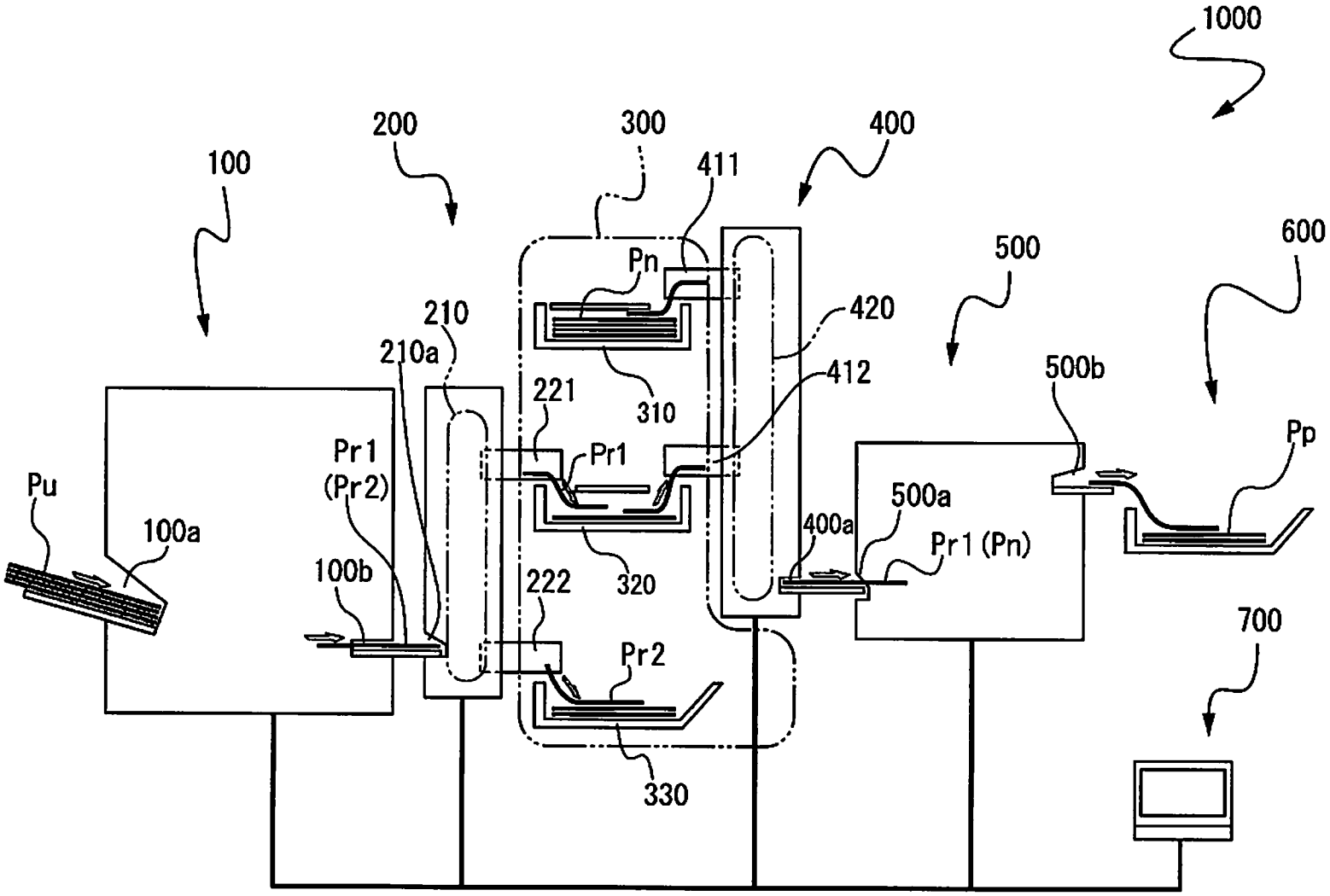
FIG. 1 is a configuration view illustrating a schematic configuration of a paper sheet recycling and printing apparatus according to a first embodiment.

FIG. 1 is a configuration view illustrating a schematic configuration of a paper sheet recycling and printing apparatus according to a first embodiment. A paper sheet recycling and printing apparatus 1000 illustrated in FIG. 1 includes a paper sheet recycling section 100, a storage section 300 for storing a recording target medium, a printing section 500, a printed material storage section 600, and a setting section 700 including a control section (not illustrated) for controlling the paper sheet recycling and printing apparatus 1000. The storage section 300 stores a recycled paper sheet Pr1 for printing (hereinafter, referred to as a printing recycled paper sheet Pr1), a recycled paper sheet Pr2 that serves as a recycled paper sheet for non-printing which is for a non-printing use, and a new paper sheet Pn which is not used for printing yet, as a recording target medium therein. The printing recycled paper sheet Pr1 is a recycled paper sheet which is recycled from a waste paper sheet Pu inserted into the paper sheet recycling section 100 and is provided as a printing application, and is a recycled paper sheet manufactured under a first condition in the paper sheet recycling section 100. The recycled paper sheet Pr2 that serves as the recycled paper sheet for non-printing which is for a non-printing use is a recycled paper sheet manufactured under a second condition different from the first condition. The printing section 500 prints predetermined recording information on the new paper sheet Pn or the printing recycled paper sheet Pr1 to be supplied from the storage, section 300. The printed material storage section 600 can store and take out a printed material Pp on which the recording information discharged from the printing section 500 is printed. The setting section 700 enables an input of operation settings and the like by an operator (person), is a controller with a display device including a touch panel and the like, includes a CPU, a ROM, and a RAM, and controls the paper sheet recycling and printing apparatus 1000.

The storage section 300 includes a paper sheet storage section 310 in which the new paper sheet Pn is stored, a first recycled paper sheet storage section 320 in which the printing recycled paper sheet Pr1 is stored, and a second recycled paper sheet storage section 330 in which the recycled paper sheet Pr2 is stored. In addition, an aspect in which the paper sheet recycling and printing apparatus 1000 illustrated in FIG. 1 includes each one of the paper sheet storage section 310 in which the new paper sheet Pn is stored, the first recycled paper sheet storage section 320 in which the printing recycled paper sheet Pr1 is stored, and the second recycled paper sheet storage section 330 in which the recycled paper sheet Pr2 is stored, is exemplified, but the invention is not limited thereto, and a plurality of the sections may be provided.

A recycled paper sheet supply section 200 is provided between the paper sheet recycling section 100 and the storage section 300. The recycled paper sheet supply section 200 includes recycled paper sheet transport means 210 (not illustrated in detail), first recycled paper sheet supply means 221 that serves as a first recycled paper sheet supply section which supplies the printing recycled paper sheet Pr1 to the first recycled paper sheet storage section 320, and second recycled paper sheet supply means 222 that serves as a second recycled paper sheet supply section which supplies the recycled paper sheet Pr2 to the second recycled paper sheet storage section 330. The waste paper sheet Pu is inserted into the paper sheet recycling section 100 from a waste paper sheet supply section 100*a* provided in the paper sheet recycling section 100, and the recycled printing recycled paper sheet Pr1 or recycled paper sheet Pr2 are delivered to a recycled paper sheet insertion port 210*a* provided in the recycled paper sheet supply section 200 from a recycled paper sheet discharge section 100*b*.

The printing recycled paper sheet Pr1 inserted into the recycled paper sheet insertion port 210*a* is transported to the first recycled paper sheet supply means 221 by the recycled paper sheet transport means 210 and is transported and stored in the first recycled paper sheet storage section 320. In addition, the recycled paper sheet Pr2 is transported to the second recycled paper sheet supply means 222 by the recycled paper sheet transport means 210 and is transported and stored in the second recycled paper sheet storage section 330. A determining section (not illustrated) provided in the setting section 700 determines whether the recycled paper sheet inserted into the recycled paper sheet insertion port 210*a* is the printing recycled paper sheet Pr1 or the recycled paper sheet Pr2, and as described above, when it is determined that the printing recycled paper sheet Pr1 is inserted, the printing recycled paper sheet Pr1 is transported to the first recycled paper sheet storage section 320, and when it is determined that the recycled paper sheet Pr2 is inserted, the recycled paper sheet Pr2 is transported to the second recycled paper sheet storage section 330.

The determining section determines that the printing recycled paper sheet Pr1 is inserted into the recycled paper sheet insertion port 210*a* in a case where creation information (condition for manufacturing the recycled paper sheet) of the recycled paper sheet in the paper sheet recycling section 100 input into the setting section 700, for example, a manufacturing command (first condition) of the printing recycled paper sheet Pr1 is issued, and the printing recycled paper sheet Pr1 is transported to the first recycled paper sheet supply means 221 via the recycled paper sheet transport means 210 and stored in the first recycled paper sheet storage section 320. In addition, the determining section determines that the recycled paper sheet Pr2 is inserted into the recycled paper sheet insertion port 210*a* in a case a manufacturing command (second condition) of the recycled paper sheet Pr2 is issued, and the recycled paper sheet Pr2 is transported to the second recycled paper sheet supply means 222 via the recycled paper sheet transport means 210 and stored in the second recycled paper sheet storage section 330. The manufacturing command (first condition) for manufacturing the printing recycled paper sheet Pr1 is a manufacturing condition in which texture of the paper (degree of uniformity of the fiber structure), thickness, hardness and rigidity, color, sheet characteristics and the like are in a desired form appropriate for a printing use. Therefore, the recycled paper sheet (printing recycled paper sheet Pr1) manufactured under the first condition and the recycled paper sheet manufactured under the second condition (recycled paper sheet Pr2) have texture of the paper (degree of uniformity of the fiber structure), thickness, hardness and rigidity, color, sheet characteristics and the like which are different from each other.

The paper sheet recycling and printing apparatus 1000 is provided with a transport section 400 between the storage section 300 and the printing section 500. The new paper sheet Pn or the printing recycled paper sheet Pr1 is taken out by the transport section 400 from the paper sheet storage section 310 in which the new paper sheet Pn is stored, and the first recycled paper sheet storage section 320 in which the printing recycled paper sheet Pr1 is stored which are provided in the storage section 300, and is transported to the printing section 500. Meanwhile, from the second recycled paper sheet storage section 330 which is provided in the storage section 300 and in which the recycled paper sheet Pr2 that is not to be supplied for the printing is stored, for example, the operator (person) directly takes out the stored recycled paper sheet Pr2.

As described above, the recycled paper sheet Pr2 may be various forms, such as, a recycled paper sheet that is not to be supplied for the printing, for example, a recycled paper sheet to be supplied for the printing of another printing machine, or a paper sheet for handwritten memo. Further, in the paper sheet recycling section 100 to be described later, it is also possible to manufacture a color recycled paper sheet since coloring is possible in the paper sheet recycling section 100 not being limited to a colorless (white) recycled paper sheet, and it is possible to provide the recycled paper sheet not only for the printing but also for various uses other than the printing, such as decoration or origami. Accordingly, the recycled paper sheet Pr2 is not supplied to the printing section 500 provided in the paper sheet recycling and printing apparatus 1000, and a supply path to be supplied in the second recycled paper sheet storage section 330 which can be taken out from the outside is set.

The transport section 400 includes first taking-out means 411 for taking out the new paper sheet Pn from the paper sheet storage section 310 and second taking-out means 412 for taking out the printing recycled paper sheet Pr1 from the first recycled paper sheet storage section 320. The new paper sheet Pn taken out by the first taking-out means 411 or the printing recycled paper sheet Pr1 taken out by the second taking-out means 412 is transported to a paper sheet supply section 400*a* of the transport section 400 by transport means 420 (not illustrated in detail). The transport means 420 of the transport section 400 is configured of, for example, rollers and belts.

The transport section 400 supplies the new paper sheet Pn from the paper sheet storage section 310 or the printing recycled paper sheet Pr1 from the first recycled paper sheet storage section 320 to a paper sheet taking-in section 500*a* from the paper sheet supply section 400*a*, predetermined recording information is printed in the printing section 500, and the printed material Pp is discharged from a printed material discharge section 500*b*. The printed material Pp discharged from the printed material discharge section 500*b* is discharged and stored in the printed material storage section 600 and taken out from the paper sheet recycling and printing apparatus 1000 by the operator (person). In addition, in the present embodiment, the printing section 500 and the printed material storage section 600 are illustrated as independent configuration elements, but the printed material storage section 600 may be integrally configured in the printing section 500.

Figure 2:
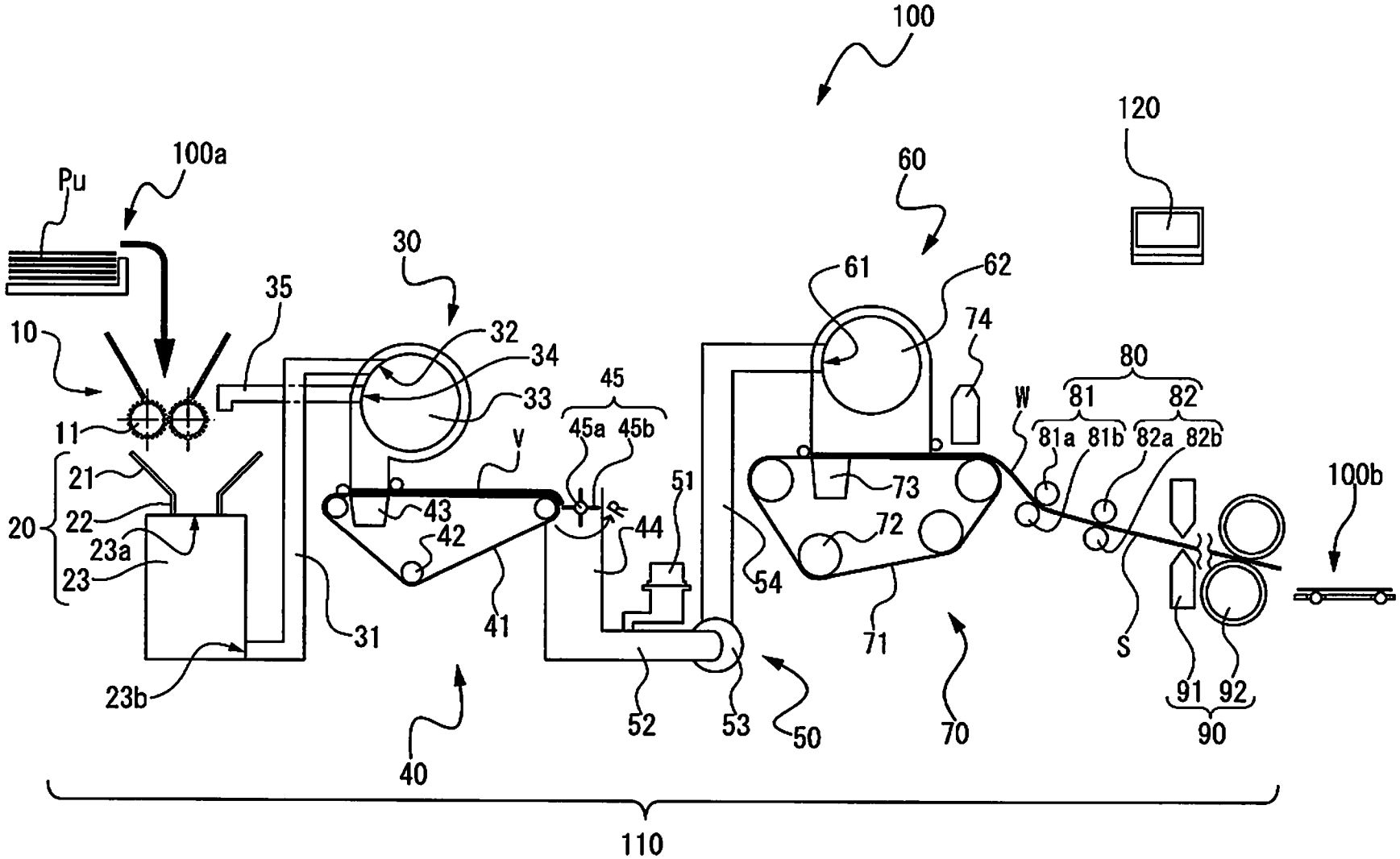
FIG. 2 is a configuration view illustrating a schematic configuration of a paper sheet recycling section included in the paper sheet recycling and printing apparatus according to the first embodiment.

FIG. 2 is a configuration view illustrating a schematic configuration of the paper sheet recycling section 100 included in the paper sheet recycling and printing apparatus 1000 according to the present embodiment. As illustrated in FIG. 2, the paper sheet recycling section 100 includes the waste paper sheet supply section 100*a*, a manufacturing section 110, and a control section 120. The manufacturing section 110 manufactures the printing recycled paper sheet Pr1 or the recycled paper sheet Pr2. The manufacturing section 110 includes a coarse crushing section 10, a defibrating section 20, a sorting section 30, a first web forming section 40, a rotating body 45, a mixing section 50, a depositing section 60, a second web forming section 70, a sheet forming section 80, and a cutting section 90.

The waste paper sheet supply section 100*a* supplies the waste paper sheet Pu to the coarse crushing section 10. The waste paper sheet supply section 100*a* is, for example, an automatic inserting section for continuously inserting the waste paper sheet Pu to the coarse crushing section 10. The waste paper sheet Pu supplied by the waste paper sheet supply section 100*a* is not limited to the waste paper sheet, and may be any paper sheet containing fibers, for example, a pulp sheet.

In the coarse crushing section 10, the waste paper sheet Pu supplied by the waste paper sheet supply section 100*a* is cut into pieces by cutting in the air. The shape or size of the pieces is, for example, several cm square. In the example illustrated in the drawing, the coarse crushing section 10 has a coarse crushing blade 11, and the coarse crushing blade 11 can cut the inserted raw material. As the coarse crushing section 10, for example, a shredder can be used. The waste paper sheet Pu cut by the coarse crushing section 10 is transferred (transported) to a defibrating apparatus section 23 via a pipe 22 after being received by a hopper 21 provided in the defibrating section 20.

The defibrating apparatus section 23 defibrates the raw material cut by the coarse crushing section 10. Here, a term "defibrate" in the present specification means to disentangle the fibers of the waste paper sheet Pu that serves as a defibration target formed by binding a plurality of fibers, one by one. The defibrating apparatus section 23 also has a function of separating substances, such as resin particles, ink, toner, or bleed inhibitor, that adhere to the raw material, from the fibers.

The material that has passed through the defibrating apparatus section 23 is referred to as "defibrated material". There is also a case where "defibrated material" includes not only disentangled defibrated material fibers but also resin (resin for binding a plurality of fibers) particles separated from the fibers when disentangling the fibers, a coloring material, such as ink or toner, or additives, such as bleed inhibitor or paper strength enhancer.

The defibrating apparatus section 23 performs the defibration in a so-called dry type in the atmosphere (in the air) without using a solvent, water or the like. Specifically, as the defibrating apparatus section 23, an impeller mill is used. The defibrating apparatus section 23 has a function of generating an airflow that suctions the raw material and discharges the defibrated material. Accordingly, the defibrating apparatus section 23 can suction the raw material together with the airflow from an introduction port 23*a* by the airflow generated by the defibrating apparatus section 23 itself, perform defibration processing, and transport the defibrated material to a discharge port 23*b*. The defibrated material that has passed through the defibrating apparatus section 23 is transferred to the sorting section 30 via a pipe 31. In addition, the airflow for transporting the defibrated material from the defibrating apparatus section 23 to the sorting section 30 may use the airflow generated in the defibrating apparatus section 23, or may use the airflow by providing an airflow generating apparatus, such as a blower.

The sorting section 30 introduces the defibrated material defibrated by the defibrating section 20 through the pipe 31 into a sorting apparatus section 33 from the introduction port 32 and sorts the defibrated material according to the length of the fiber. For example, a sieve is used as the sorting apparatus section 33. The sorting apparatus section 33 has a mesh (filter, screen) and can divide the defibrated material into fibers or particles (fibers or particles that have passed through the mesh, that is, a first sorted material) smaller than an aperture of the mesh, and particles, undefibrated pieces, or dams (particles, pieces, or dams that do not pass through the mesh, that is, a second sorted material) larger than the aperture of the mesh. For example, the first sorted material is transferred to the mixing section 50 via a pipe 44. The second sorted material is returned from a discharge port 34 to the defibrating section 20 via a pipe 35. Specifically, the sorting apparatus section 33 is a cylindrical sieve which is rotationally driven by a motor. As the mesh of the sorting apparatus section 33, for example, a wire mesh, an expanded metal obtained by stretching a metal plate with a cut, and a punching metal having a hole formed in a metal plate by a press machine or the like are used.

The first web forming section 40 transports the first sorted material that has passed through the sorting section 30 to the mixing section 50. The first web forming section 40 includes a mesh belt 41, a stretching roller 42, and a suction section (suction mechanism) 43.

The suction section 43 can suction the first sorted material dispersed in the air passing through an opening (mesh opening) of the sorting section 30 onto the mesh belt 41. The first sorted material is suctioned from the sorting section 30 by the suction section 43, is deposited on the moving mesh belt 41, and forms a web V. The basic configuration of the mesh belt 41, the stretching roller 42, and the suction section 43 is the same as that of the mesh belt 71, a stretching roller 72, and a suction section (suction mechanism) 73 of the second web forming section 70 to be described later.

By passing through the sorting section 30 and the first web forming section 40, the web V is formed in a state of containing a large amount of air and being softly bulged. The web V deposited on the mesh belt 41 is inserted into the pipe 44 and transported to the mixing section 50.

The rotating body 45 can cut the web V before the web V is transported to the mixing section 50. In the illustrated example, the rotating body 45 has a base portion 45*a* and a protrusion portion 45*b* that protrudes from the base portion 45*a*. The protrusion portion 45*b* has, for example, a plate-like shape. In the illustrated example, four protrusion portions 45*b* are provided, and the four protrusion portions 45*b* are provided at equivalent intervals. As the base portion 45*a* rotates in a direction R, the protrusion portion 45*b* can rotate around the base portion 45*a*. By cutting the web V with the rotating body 45, for example, it is possible to reduce fluctuation in the amount of the defibrated material per unit time supplied to the depositing section 60 to be described later.

The mixing section 50 passes through the sorting section 30 and mixes the first sorted material transported by the first web forming section 40 and a binder resin powder with each other. The mixing section 50 includes a powder supply device 51 for supplying the binder resin powder, a pipe 52 for transporting the first sorted material and the binder resin powder, and a blower 53. The pipe 52 is continuous with the pipe 44.

In the mixing section 50, the airflow is generated by the blower 53, and the first sorted material and the binder resin powder supplied from the powder supply device 51 can be transported in the pipe 52 while being mixed with each other. The binder resin powder supplied from the powder supply device 51 contains a resin capable of binding a plurality of fibers. At the time when the resin is supplied, the plurality of fibers is not bound. The resin bonds the plurality of fibers by melting when passing through the sheet forming section 80 to be described later. In addition, the mechanism for mixing the first sorted material and the binder resin powder with each other is not particularly limited.

The binder resin powder supplied from the powder supply device 51 is a thermoplastic resin or a thermosetting resin, and examples thereof include AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, polyether ether ketone, and the like. These resins may be used alone or as an appropriate mixture thereof.

In addition, as the binder resin powder supplied from the powder supply device 51, in addition to the resin for binding the fibers, in accordance with the type of the sheet to be manufactured, a coloring agent for coloring the fibers, a coagulation preventing agent for preventing coagulation of fibers, a flame retardant for making fibers and the like unlikely to burn, and the like, may be included. The mixture of the first sorted material and the binder resin powder that has passed through the mixing section 50 is transferred to the depositing section 60 via the pipe 54.

The depositing section 60 introduces the mixture that has passed through the mixing section 50 from an introduction port 61 into a depositing apparatus section 62, disentangles the intertwined fibers of the defibrated material, and descends while dispersing in the air. Furthermore, in a case where the resin of the binder resin powder supplied from the powder supply device 51 is fibrous, the depositing apparatus section 62 disentangles the intertwined resin fibers. Accordingly, the depositing section 60 can deposit the mixture uniformly on the second web forming section 70.

As the depositing apparatus section 62, a cylindrical sieve having a rotating mesh is used, and allows fibers or particles smaller than the opening of the sieve of the mesh which are contained in the mixture that has passes through the mixing section 50, that is, fibers or particles that can pass through the mesh, pass therethrough. The configuration of the depositing section 60 is, for example, the same as the configuration of the sorting section 30.

In addition, the "sieve" of the depositing apparatus section 62 may not have a function of sorting a specific target. In other words, the "sieve" used as the depositing apparatus section 62 means that the mesh is provided, and may allow all of the mixtures introduced into the depositing apparatus section 62 pass therethrough.

The second web forming section 70 deposits the passing material that has passed through the depositing section 60 and forms a web W. The second web forming section 70 includes, for example, the mesh belt 71, the stretching roller 72, and the suction section (suction mechanism) 73.

While moving, the mesh belt 71 deposits the passing material that has passed through the opening (opening of the mesh) of the depositing section 60. The mesh belt 71 is configured to be stretched by the stretching roller 72, and to make the air pass therethrough while the passing material is unlikely to pass therethrough. The mesh belt 71 continuously moves as the stretching roller 72 rotates. As the passing material that has passed through the depositing section 60 descends and is accumulated on the continuously moving mesh belt 71, the web W is formed on the mesh belt 71.

The suction section 73 is provided below the mesh belt 71 (on a side opposite to the depositing section 60 side). The suction section 73 can generate a downwardly directed airflow (airflow from the depositing section 60 to the mesh belt 71). Accordingly, it is possible to increase a discharge speed of the passing material from the depositing section 60.

As described above, by passing through the depositing section 60 and the second web forming section 70 (web forming step), the web W is formed in a state of containing a large amount of air and being softly bulged. The web W deposited on the mesh belt 71 is transported to the sheet forming section 80. In addition, in the illustrated example, a humidity control section 74 which controls humidity of the web W is provided. In the humidity control section 74, water or water vapor can be added to the web W and the amount ratio between the web W and water can be adjusted.

The sheet forming section 80 pressurizes and heats the web W deposited on the mesh belt 71 and forms a sheet S. In the sheet forming section 80, a plurality of fibers in the mixture can be bound to each other via the binder resin powder by applying heat to the mixture of the defibrated material and the binder resin powder mixed in the web W.

The sheet forming section 80 includes a pressurizing section 81 for pressurizing the web W and a heating section 82 for heating the web W pressurized by the pressurizing section 81. The pressurizing section 81 is configured with a pair of calendar rollers 81*a* and 81*b* and applies pressure to the web W. The thickness of the web W is reduced by being pressurized, and the density of the web W is increased. The heating section 82 includes a pair of heating rollers 82*a* and 82*b*. The sheet S is formed by heating the web W pressurized by the calendar rollers 81*a* and 81*b* with the heating rollers 82*a* and 82*b* and binding the fibers by melting the resin. Here, the pressure applied to the web W by the calendar rollers 81*a* and 81*b* of the pressurizing section 81 can be set higher than the pressure applied to the web W by the heating rollers 82*a* and 82*b* of the heating section 82. In addition, the number of the calendar rollers 81*a* and 81*b* or the heating rollers 82*a* and 82*b* is not particularly limited.

The cutting section 90 cuts the sheet S formed by the sheet forming section 80. In the illustrated example, the cutting section 90 includes a first cutting section 91 for cutting the sheet S in a direction intersecting the transport direction of the sheet S, and a second cutting section 92 for cutting the sheet S in a direction parallel to the transport direction, for example, a roller cutter. For example, the second cutting section 92 cuts the sheet S that has passed through the first cutting section 91. By passing through the cutting section 90, the printing recycled paper sheet Pr1 or the recycled paper sheet Pr2 of a cut form having a predetermined size cut from the sheet S is formed. The cut printing recycled paper sheet Pr1 of the cut form or the recycled paper sheet Pr2 is discharged to the recycled paper sheet discharge section 100*b* illustrated in FIG. 1 and is transported to the recycled paper sheet supply section 200. In addition, the method of recycling the paper sheet is not limited to the above-described method, and various paper sheet recycling methods, such as a method of physically removing a recording medium called a toner that adheres to the surface of the recording target medium and a wet type paper sheet recycling method, can be adopted.

Regarding the printing recycled paper sheet Pr1 or the recycled paper sheet Pr2 manufactured by the above-described paper sheet recycling section 100, the printing recycled paper sheet Pr1 is supplied by the recycled paper sheet supply section 200 as described in FIG. 1 to the first recycled paper sheet storage section 320 and stored therein, and the recycled paper sheet Pr2 is supplied to the second recycled paper sheet storage section 330 and stored therein. In addition, when the printing section 500 selects the printing recycled paper sheet Pr1 as the recording target medium, the printing recycled paper sheet Pr1 is taken out by the transport section 400 from the first recycled paper sheet storage section 320, and a predetermined quantity of the printing recycled paper sheets Pr1 is transported to the printing section 500.

Figure 3:
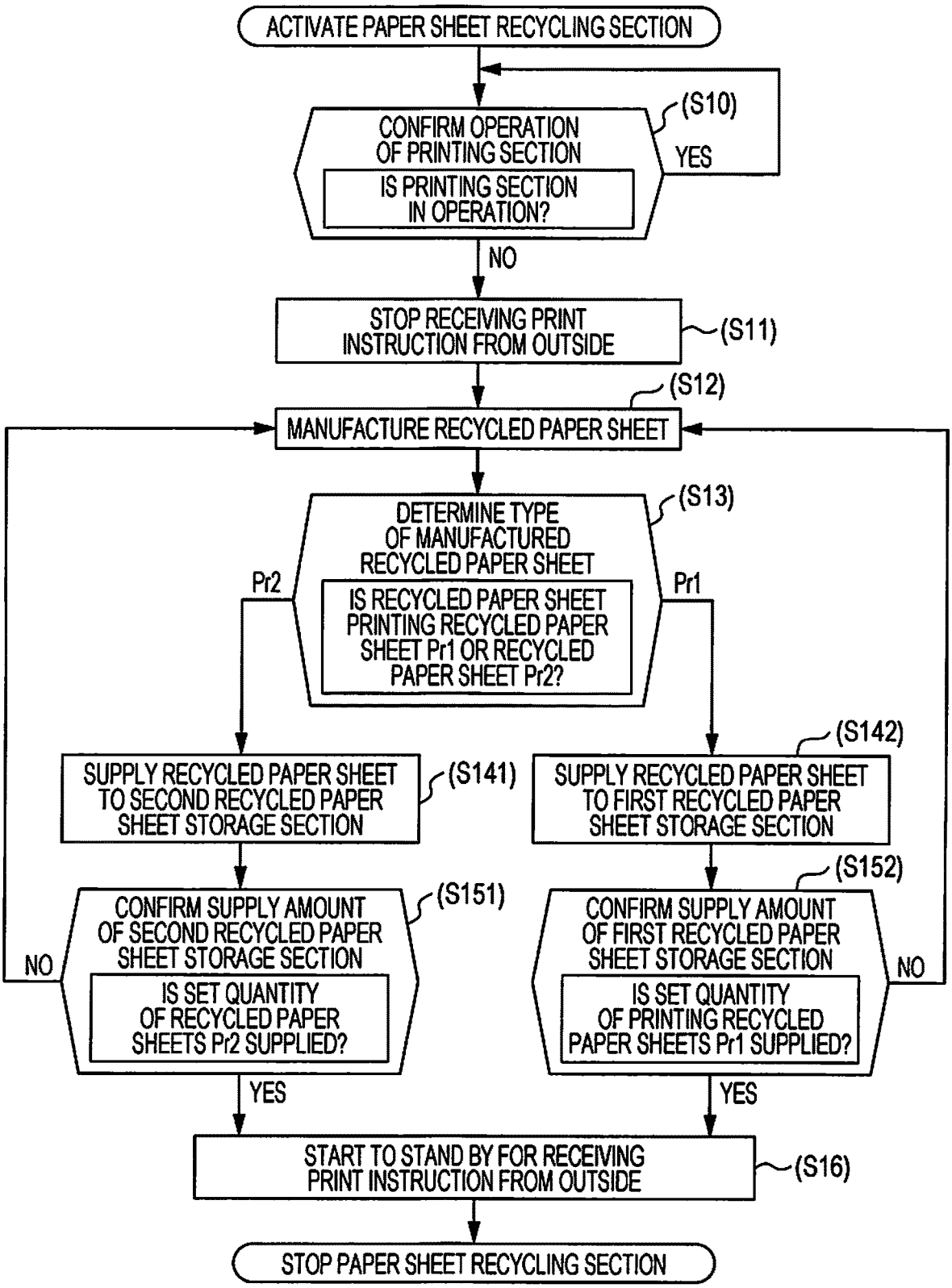
FIG. 3 is a flowchart illustrating a flow in which a recycled paper sheet is supplied from the paper sheet recycling section to a storage section in the paper sheet recycling and printing apparatus according to the first embodiment.

FIG. 3 is a flowchart illustrating a flow for supplying the printing recycled paper sheet Pr1 manufactured in the paper sheet recycling section 100 to the first recycled paper sheet storage section 320 or the recycled paper sheet Pr2 to the second recycled paper sheet storage section 330.

(Printing Section Operation Confirmation)

When the paper sheet recycling section 100 is started based on the instruction input into the setting section 700, a printing section operation confirming step (S10) for confirming whether or not the printing section 500 is in operation is executed. In a case where the printing section 500 is in an operating state, the printing operation based on a print command received from the outside or instructed from the setting section 700 is not paused in the middle and is continued until the printing is completed. In other words, in a case where the printing section 500 is in operation (YES), the paper sheet recycling section 100 is placed in a standby state for starting the recycling operation of the paper sheet.

(Stop of Receiving Print Instruction from Outside)

In a case where the printing section 500 does not receive the print command or the printing is completed, that is, in the printing section operation confirming step (S10), when it is confirmed that the printing section 500 is not in operation (NO), the print instruction receiving stopping step (S11) is executed such that the printing section 500 does not receive the print command. In other words, so-called offline is achieved. Accordingly, in the setting section 700, an indication, such as "printing section offline" or "printing cannot be input because the recycled paper sheet is currently being manufactured" is displayed on a display section (not illustrated) and guides the operator (person).

(Recycled Paper Sheet Manufacturing)

When the printing section 500 becomes offline (S11), the paper sheet recycling and printing apparatus 1000 shifts to a recycled paper sheet manufacturing step (S12) for manufacturing the recycled paper sheet. In the recycled paper sheet manufacturing step (S12), either one of the printing recycled paper sheet Pr1 or the recycled paper sheet Pr2 is manufactured from the waste paper sheet Pu in the paper sheet recycling section 100 illustrated in FIG. 2 described above by setting of the setting section 700.

(Determination of Type of Manufactured Recycled Paper Sheet)

A manufactured recycled paper sheet type determining step (S13) is a step for determining whether the recycled paper sheet manufactured in the recycled paper sheet manufacturing (S12) step is the printing recycled paper sheet Pr1 to be supplied for the printing or the recycled paper sheet Pr2 that is not to be supplied for the printing based on the setting information of the setting section 700.

(Supply of Second Recycled Paper Sheet Storage Section)

When it is determined that the recycled paper sheet manufactured by the paper sheet recycling section 100 is the recycled paper sheet Pr2 that is not to be supplied for the printing in the manufactured recycled paper sheet type determining step (S13), the recycled paper sheet Pr2 is supplied to the second recycled paper sheet storage section 330 (S141).

(Confirmation of Supply Amount of Second Recycled Paper Sheet Storage Section)

When the recycled paper sheet Pr2 is supplied to the second recycled paper sheet storage section 330 (S141), a supply amount confirming step (S151) of the second recycled paper sheet storage section 330 for confirming whether or not the manufacturing quantity of the recycled paper sheets Pr2 set by the setting section 700, that is, the quantity of the recycled paper sheets Pr2 supplied to the second recycled paper sheet storage section 330 is the quantity set by the setting section 700, is executed. In addition, in a case where the set quantity has not been reached (NO), the recycled paper sheet manufacturing step (S12) is continued.

(Supply of First Recycled Paper Sheet Storage Section)

Meanwhile, when it is determined that the recycled paper sheet manufactured by the paper sheet recycling section 100 is the printing recycled paper sheet Pr1 to be supplied for the printing in the manufactured recycled paper sheet type determining step (S13), the printing recycled paper sheet Pr1 is supplied to the first recycled paper sheet storage section 320 (S142).

(Confirmation of Supply Amount of First Recycled Paper Sheet Storage Section)

When the printing recycled paper sheet Pr1 is supplied (S142) to the first recycled paper sheet storage section, a supply amount confirming step (S152) of the first recycled paper sheet storage section for confirming whether or not the manufacturing quantity of the printing recycled paper sheets Pr1 set by the setting section 700, that is, the quantity of the printing recycled paper sheets Pr1 supplied to the first recycled paper sheet storage section 320 is the quantity set by the setting section 700, is executed. In addition, in a case where the set quantity has not been reached (NO), the recycled paper sheet manufacturing step (S12) is continued.

(Start of Standby for Receiving Print Instruction from Outside)

In the supply amount confirming step (S151) of the second recycled paper sheet storage section or the supply amount confirming step (S152) of the first recycled paper sheet storage section, when the set quantity of the recycled paper sheets is supplied to the second recycled paper sheet storage section 330 or the first recycled paper sheet storage section 320 (YES), the offline state is canceled, a print instruction receiving standby starting step (S16) from the outside is executed, a message indicating that the printing is possible is displayed in the setting section 700 or the printing section 500. In addition, the manufacturing of the recycled paper sheet in the paper sheet recycling section 100 is stopped.

Figure 4:
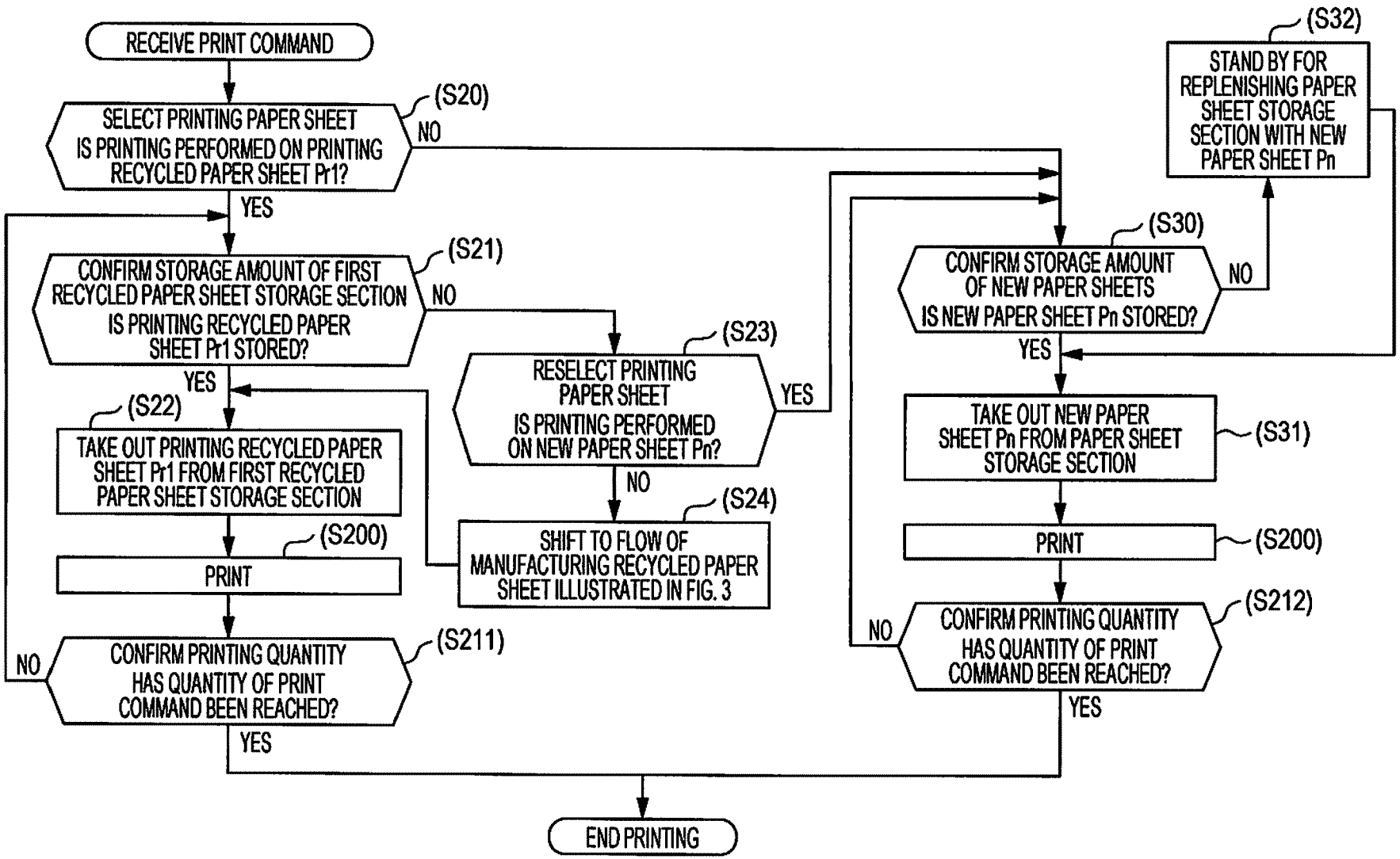
FIG. 4 is a flowchart illustrating a flow in which a recording target medium is supplied from the paper sheet storage section to a printing section in the paper sheet recycling and printing apparatus according to the first embodiment.

Next, a flowchart of FIG. 4 illustrates a flow of transporting and supplying the new paper sheet Pn or the printing recycled paper sheet Pr1 stored in the storage section 300 to the printing section 500 and manufacturing the printed material Pp.

(Printing Paper Sheet Selection)

As illustrated in FIG. 4, as the control section provided in the paper sheet recycling and printing apparatus 1000 receives the print command for starting the printing, the printing is started based on the print information. First, a printing paper sheet selecting step (S20) to be printed is executed. Based on the print command or the print information, it is determined and selected whether the printing paper sheet is the printing recycled paper sheet Pr1 or the new paper sheet Pn.

(First Recycled Paper Sheet Storage Section Storage Amount Confirmation)

When the printing recycled paper sheet Pr1 is selected (YES) in the printing paper sheet selecting step (S20), a first recycled paper sheet storage section storage amount confirming step (S21) for confirming whether or not the printing recycled paper sheet Pr1 is stored in the first recycled paper sheet storage section 320 in which the printing recycled paper sheet Pr1 is stored, is executed. When it is confirmed that at least one printing recycled paper sheet Pr1 is stored (YES), the process shifts to the next printing recycled paper sheet taking-out step (S22).

(Printing Recycled Paper Sheet Taking-Out)

The printing recycled paper sheet taking-out step (S22) is a step for taking out the printing recycled paper sheet Pr1 from the first recycled paper sheet storage section 320 and transporting the printing recycled paper sheet Pr1 to the paper sheet taking-in section 500*a* of the printing section 500 by the transport section 400. In addition, a printing step (S200) for discharging the printing recycled paper sheet Pr1 transported to the paper sheet taking-in section 500*a* to the printed material discharge section 500*b* as the printed material Pp after the predetermined printing is performed by the printing section 500, and storing the printing recycled paper sheet Pr1 in the printed material storage section 600, is executed.

(Printing Quantity Confirmation)

When the printing step (S200) is executed, a printing quantity confirming step (S211) for confirming whether or not the printing quantity based on the printing command has been reached, is executed. When the printing quantity based on the print command has been reached (YES), the printing is completed. In a case where the printing quantity has not been reached (NO), the process shifts to the first recycled paper sheet storage section storage amount confirming step (S21), and printing on the printing recycled paper sheet Pr1 is continued.

(Printing Paper Sheet Reselection)

In a case where it is confirmed that the printing recycled paper sheet Pr1 is not stored (NO) in the step of the above-described first recycled paper sheet storage section storage amount confirming step (S21), a printing paper sheet reselecting step (S23) is executed. In the printing paper sheet reselecting step (S23), selection is performed as to whether to perform the predetermined printing on either the new paper sheet Pn or the printing recycled paper sheet Pr1.

As means for the selection, the operator (person) performs determination from "there is no remaining printing recycled paper sheet Pr1" or "determination of continuation or cancellation of printing" displayed on the display section or the like provided in the paper sheet recycling and printing apparatus 1000, but in this example, it is described that printing is continued. In order to continue the printing, by performing the printing on the new paper sheet Pn in which it is easy to replenish the paper sheets to be supplied for the printing (YES) or without selecting the new paper sheet Pn (NO), the paper sheet recycling section 100 selects whether to continue the printing after manufacturing and storing the printing recycled paper sheet Pr1 in the first recycled paper sheet storage section 320.

When the printing on the new paper sheet Pn (YES) is selected in the printing paper sheet reselecting step (S23), the printing is continued based on the flow in which (NO) to be described later, that is, the new paper sheet Pn, is selected in the printing paper sheet selecting step (S20). Meanwhile, in a case where the new paper sheet Pn is not selected (NO), a shifting step (S24) to the manufacturing flow of the printing recycled paper sheet Pr1 based on the manufacturing flow of the recycled paper sheet illustrated in FIG. 3 described above, is executed.

At this time, as described in the manufacturing flow of the recycled paper sheet illustrated in FIG. 3, the printing section 500 is in the offline state and stands by until the manufactured printing recycled paper sheet Pr1 is stored in the first recycled paper sheet storage section 320. When the printing recycled paper sheet Pr1 is stored in the first recycled paper sheet storage section 320, the process shifts to the above-described printing recycled paper sheet taking-out step (S22). In addition, regarding the manufacturing quantity of the printing recycled paper sheets Pr1, when selecting (NO) in the printing paper sheet reselecting step (S23), there is no particular limitation on whether to designate the manufacturing quantity of the printing recycled paper sheets Pr1 to the setting section 700, or to manufacture the remaining printing quantity of the printing recycled paper sheets Pr1 with respect to the printing quantity included in the print command.

Meanwhile, in a case where the printing recycled paper sheet Pr1 is not selected (NO) in the printing paper sheet selecting step (S20), the new paper sheet Pn stored in the paper sheet storage section 310 is selected. When the new paper sheet Pn is selected, a new paper sheet storage amount confirming step (S30) for confirming the presence or absence of the stored new paper sheet Pn stored in the paper sheet storage section 310, is executed. When it is confirmed that the new paper sheet Pn is stored (YES) in the new paper sheet storage amount confirming step (S30), the taking-out (S31) of the new paper sheet Pn from the paper sheet storage section 310 is executed, and the new paper sheet Pn is supplied to the printing section 500. Then, the printing step (S200) and a printing quantity confirming step (S212) are executed.

In a case where the new paper sheet Pn is not stored in the paper sheet storage section 310 (NO) in the new paper sheet storage amount confirming step (S30), the operator (person) is warned by warning means (not illustrated) and the process shifts to the step (S32) for standing by for replenishing the paper sheet storage section 310 with the new paper sheet Pn. Then, when the paper sheet storage section 310 is replenished with the new paper sheet Pn, the printing is restarted.

In the printing quantity confirming step (S212), in a case where the printing quantity based on the printing command has not been reached (NO), the process shifts to the new paper sheet storage amount confirming step (S30), and then, each step up to the printing step (S200) is executed.

In both of the printing quantity confirming step (S211) in the flow of the printing onto the printing recycled paper sheet Pr1 and the printing quantity confirming step (S212) in the flow of the printing onto the new paper sheet Pn, when the printing quantity based on the printing command has been reached (YES), the printing is completed.

As described above, in the paper sheet recycling and printing apparatus 1000 according to the present embodiment, as illustrated in FIG. 1, among the recycled paper sheets manufactured in the paper sheet recycling section 100, the storage section 300 including the paper sheet storage section 310 in which the new paper sheet Pn is stored in addition to the first recycled paper sheet storage section 320 in which the printing recycled paper sheet Pr1 to be supplied for the printing is stored, and the second recycled paper sheet storage section 330 in which the recycled paper sheet Pr2 that is not to be supplied for the printing is stored, is provided.

The recycled paper sheet Pr2 that is not to be supplied for the printing may be various forms, such as, a recycled paper sheet to be supplied for the printing of another printing machine, or a paper sheet for handwritten memo. Furthermore, the above-described paper sheet recycling section 100 can also perform coloring in the paper sheet recycling section 100 not being limited to a colorless (white) recycled paper sheet, and can also manufacture the color recycled paper sheet, and thus, it is possible to provide the recycled paper sheet not only for the printing but also for various uses other than the printing, such as decoration or origami. Therefore, regarding the recycled paper sheet Pr2 manufactured in the paper sheet recycling section 100, by making it possible to directly take out the stored recycled paper sheet Pr2 from the second recycled paper sheet storage section 330 without passing through the printing section 500, in the printing section 500, it is possible to take out the desired recycled paper sheet Pr2 from the paper sheet recycling and printing apparatus 1000 without interrupting the printing executed in the printing section 500 using the new paper sheet Pn or the printing recycled paper sheet Pr1.

When it is desired to operate the paper sheet recycling section 100, as illustrated in FIG. 3, in a case where the printing section 500 is in operation, the printing is continued and the process does not shift to the execution of the recycled paper sheet manufacturing. Therefore, when the printing recycled paper sheet Pr1 is being taken out for the printing from the first recycled paper sheet storage section 320, the printing recycled paper sheet Pr1 from the paper sheet recycling section 100 is not supplied to the first recycled paper sheet storage section 320. In addition, in a case where the printing section 500 is not in operation, by setting the printing section 500 offline, a state where the printing section 500 does not operate during the manufacturing of the recycled paper sheet is configured. Therefore, when the printing recycled paper sheet Pr1 is supplied from the paper sheet recycling section 100 to the first recycled paper sheet storage section 320, the printing recycled paper sheet Pr1 will not be taken out for the printing from the first recycled paper sheet storage section 320. In other words, from the first recycled paper sheet storage section 320 for the printing, there is no case where the taking-out of the printing recycled paper sheet Pr1 and the supply of the printing recycled paper sheet Pr1 from the paper sheet recycling section 100 overlap each other. Accordingly, it is possible to prevent occurrence of jamming at the time of paper feeding.

Second Embodiment

Figure 5:
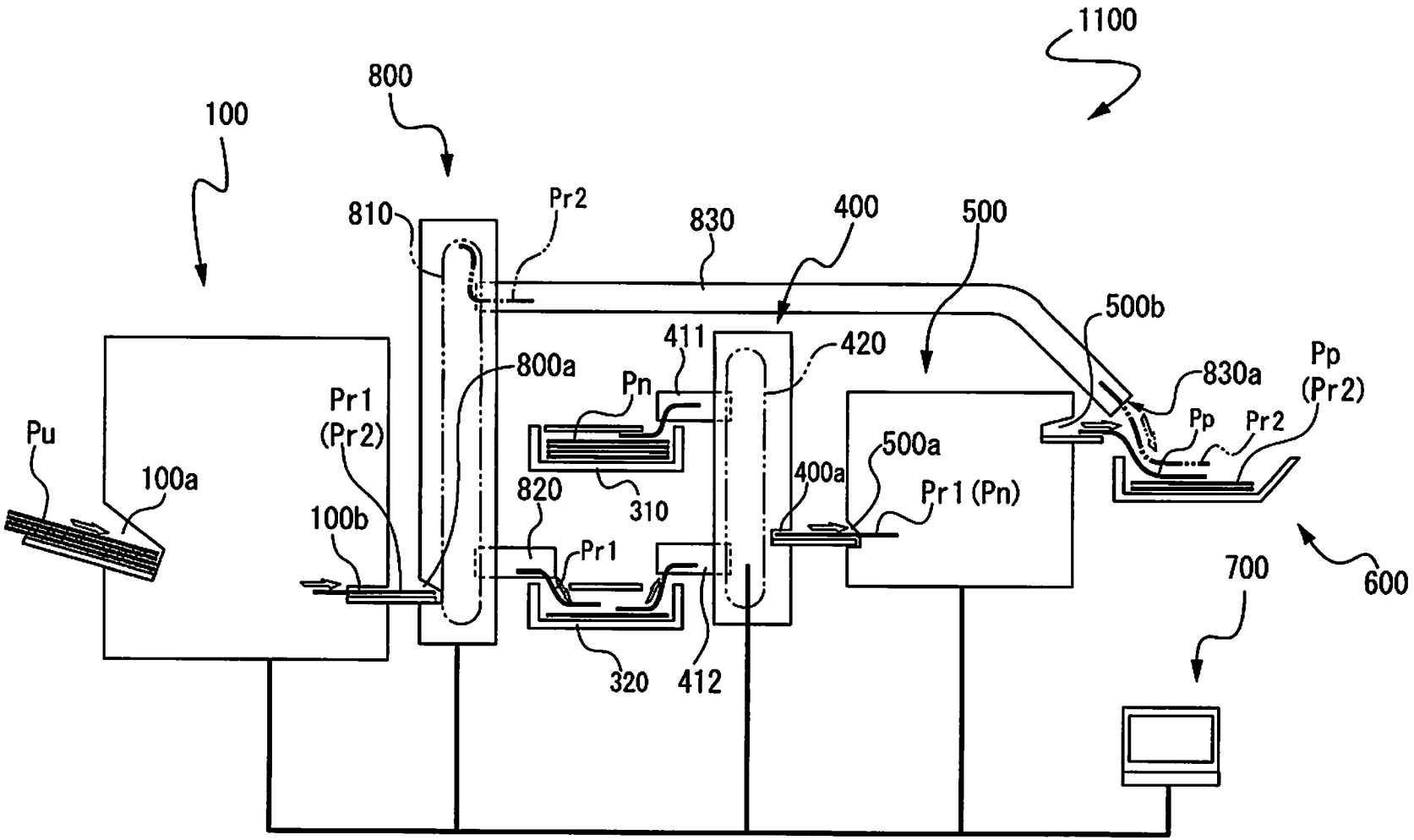
FIG. 5 is a configuration view illustrating a schematic configuration of a paper sheet recycling and printing apparatus according to a second embodiment.

FIG. 5 is a configuration view illustrating a schematic configuration of the paper sheet recycling and printing apparatus according to a second embodiment. Compared to the paper sheet recycling and printing apparatus 1000 according to the first embodiment, a paper sheet recycling and printing apparatus 1100 according to the present embodiment illustrated in FIG. 5 is configured not to include the second recycled paper sheet storage section 330 provided in the paper sheet recycling and printing apparatus 1000, and to directly supply the recycled paper sheet Pr2 that is not to be supplied for the printing to the printed material storage section 600 by second recycled paper sheet supply means 830. Therefore, in the paper sheet recycling and printing apparatus 1100, the same reference numerals will be given to the same configuration elements as those of the paper sheet recycling and printing apparatus 1000 according to the first embodiment, and the description thereof will be omitted.

As illustrated in FIG. 5, in the paper sheet recycling and printing apparatus 1100 according to the present embodiment, the printing recycled paper sheet Pr1 manufactured by the paper sheet recycling section 100 is inserted into a recycled paper sheet insertion port 800*a* of the recycled paper sheet supply section 800, and is supplied from first recycled paper sheet supply means 820 to the first recycled paper sheet storage section 320 by recycled paper sheet transport means 810 and stored in the first recycled paper sheet storage section 320. In addition, the new paper sheet Pn is stored in the paper sheet storage section 310 similar to the paper sheet recycling and printing apparatus 1000 according to the first embodiment.

Meanwhile, the recycled paper sheet Pr2 that is not to be supplied for the printing manufactured in the paper sheet recycling section 100 is inserted into the recycled paper sheet insertion port 800*a* of the recycled paper sheet supply section 800, and is transported to the second recycled paper sheet supply means 830 by the recycled paper sheet transport means 810. The second recycled paper sheet supply means 830 directly transports the recycled paper sheet Pr2 to the printed material storage section 600 and discharges the recycled paper sheet Pr2 from a recycled paper sheet supply port 830*a* to the printed material storage section 600.

Figure 6:
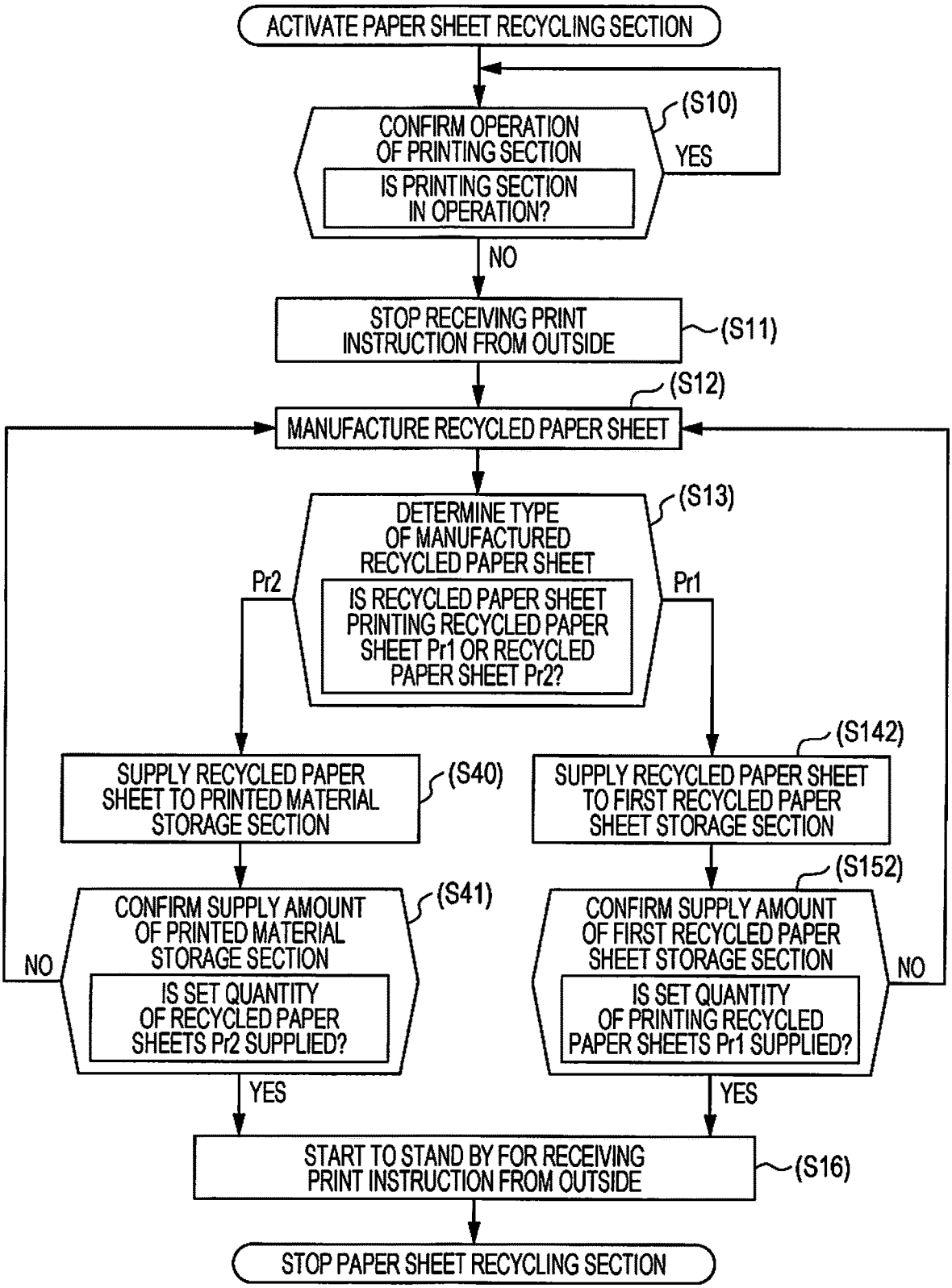
FIG. 6 is a flowchart illustrating a flow in which a recycled paper sheet is supplied from a paper sheet recycling section to a storage section in the paper sheet recycling and printing apparatus according to the second embodiment.

FIG. 6 is a flowchart illustrating a flow for supplying the printing recycled paper sheet Pr1 manufactured in the paper sheet recycling section 100 to the first recycled paper sheet storage section 320 or the recycled paper sheet Pr2 to the printed material storage section 600. In addition, in the supply flow of the recycled paper sheet of the paper sheet recycling and printing apparatus 1100 according to the present embodiment illustrated in FIG. 6, since a supplying step (S141) to the second recycled paper sheet storage section in the recycled paper sheet supply flow of the paper sheet recycling and printing apparatus 1000 according to the first embodiment and the next supply amount confirming step (S151) of the second recycled paper sheet storage section are different from each other and other flow steps are the same as each other, the same flow step numbers will be given and the description thereof will be omitted.

(Supply to Printed Material Storage Section)

In the manufactured recycled paper sheet type determining step (S13), when it is determined that the recycled paper sheet manufactured in the recycled paper sheet manufacturing step (S12) is the recycled paper sheet Pr2 that is not to be supplied to the printing, a step (S40) for supplying the recycled paper sheet to the printed material storage section 600 by the second recycled paper sheet supply means 830 is executed. At this time, since the printing section 500 is set to be in the offline state in advance in step S11 in the supply flow of the recycled paper sheet according to the present embodiment, the printed material Pp is not discharged from the printing section 500 to the printed material storage section 600. Therefore, even in a case of the printed material storage section 600 in which the printed material Pp is already stored, the recycled paper sheet Pr2 is discharged to the uppermost part of the stored printed material Pp, and it is possible to avoid that the recycled paper sheet Pr2 and the printed material Pp are mixed with each other.

(Confirmation of Supply Amount of Printed Material Storage Section)

When the recycled paper sheet Pr2 is supplied to the printed material storage section 600 (S40), a supply amount confirming step (S41) of the printed material storage section 600 for confirming whether or not the manufacturing quantity of the recycled paper sheets Pr2 set by the setting section 700, that is, the quantity of the recycled paper sheets Pr2 supplied to the printed material storage section 600 is the quantity set by the setting section 700, is executed. In addition, in a case where the set quantity has not been reached (NO), the recycled paper sheet manufacturing step (S12) is continued.

(Start of Standby for Receiving Print Instruction from Outside)

In the supply amount confirming step (S41) of the printed material storage section or the supply amount confirming step (S152) of the first recycled paper sheet storage section, when the set quantity of the recycled paper sheets is supplied to the printed material storage section 600 or the first recycled paper sheet storage section 320 (YES), the offline state is canceled, a print instruction receiving standby starting step (S16) from the outside is executed, the message indicating that the printing is possible is displayed in the setting section 700 or the printing section 500. In addition, the manufacturing of the recycled paper sheet in the paper sheet recycling section 100 is stopped.

In addition, since a flow for transporting and supplying the new paper sheet Pn stored in the paper sheet storage section 310 or the printing recycled paper sheet Pr1 stored in the first recycled paper sheet storage section 320 to the printing section 500 and manufacturing the printed material Pp is the same as that of the paper sheet recycling and printing apparatus 1000 according to the first embodiment and the flowchart illustrated in FIG. 4, the description thereof will be omitted.

As described above, in the paper sheet recycling and printing apparatus 1100 according to the present embodiment, as illustrated in FIG. 5, the recycled paper sheet Pr2 is directly discharged to the printed material storage section 600, and accordingly, it is possible to easily take out the recycled paper sheet Pr2. In other words, the second recycled paper sheet storage section 330 in which the recycled paper sheet Pr2 is stored in the paper sheet recycling and printing apparatus 1000 according to the first embodiment is configured to be also used as the printed material storage section 600.

In addition, as illustrated in FIG. 6, since the printing section 500 is set to be in the offline state in advance in step S11, the printed material Pp is not discharged from the printing section 500 to the printed material storage section 600. Therefore, even in a state where the printed material Pp is already stored in the printed material storage section 600, the recycled paper sheet Pr2 is discharged to the uppermost part of the stored printed material Pp, and thus, it is possible to avoid that the recycled paper sheet Pr2 and the printed material Pp are mixed with each other.

Third Embodiment

Figure 7:
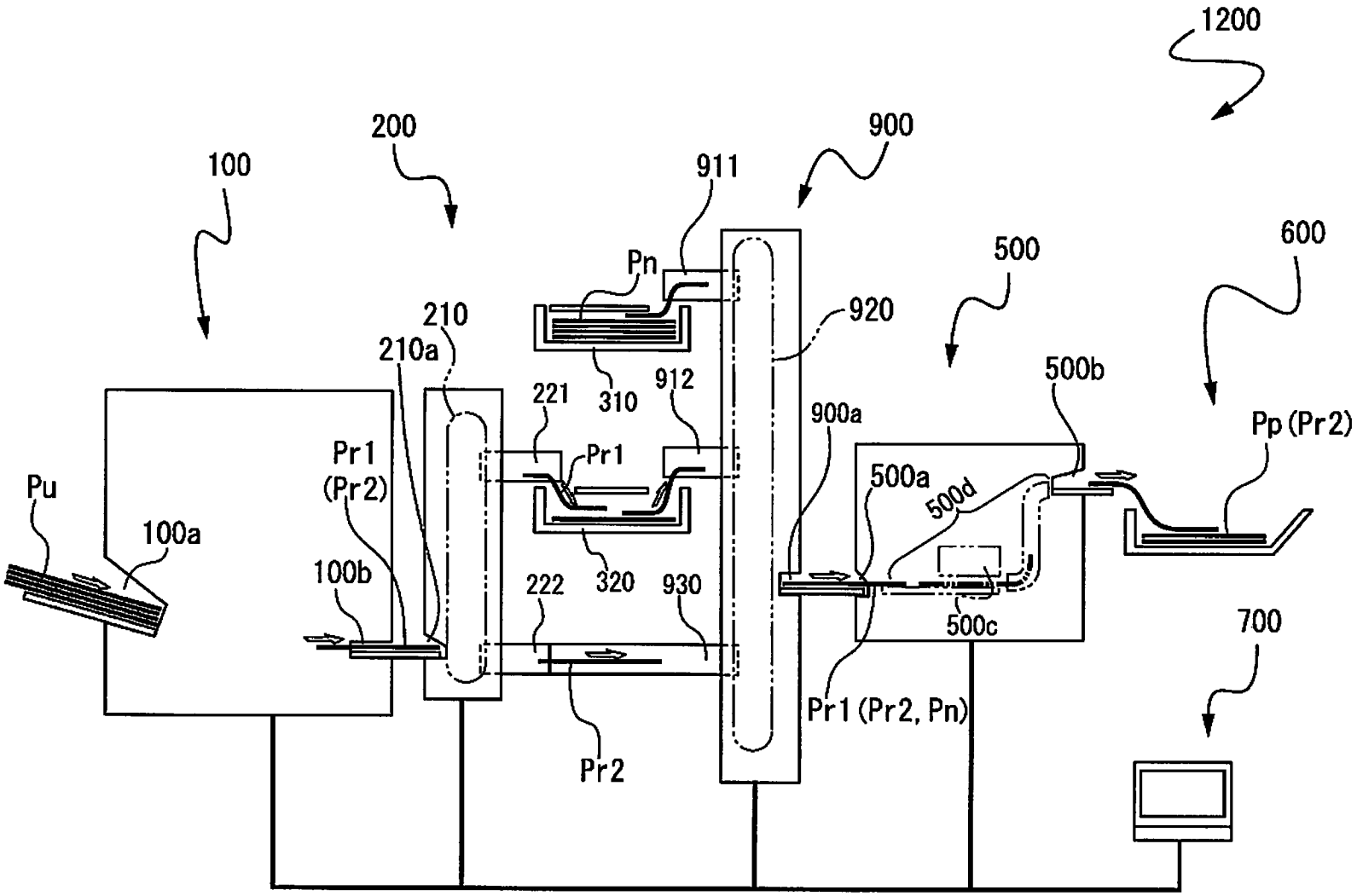
FIG. 7 is a configuration view illustrating a schematic configuration of a paper sheet recycling and printing apparatus according to a third embodiment.

FIG. 7 is a configuration view illustrating a schematic configuration of the paper sheet recycling and printing apparatus according to a third embodiment. Compared to the paper sheet recycling and printing apparatus 1000 according to the first embodiment, a paper sheet recycling and printing apparatus 1200 according to the present embodiment illustrated in FIG. 7 is configured to supply the recycled paper sheet Pr2 that is not to be supplied for the printing from the second recycled paper sheet supply means 222 of the recycled paper sheet supply section 200 to the transport section 400 via the taking-out port, and to be capable of supplying the recycled paper sheet Pr2 to the printing section 500. Therefore, in the paper sheet recycling and printing apparatus 1200, the same reference numerals will be given to the same configuration elements as those of the paper sheet recycling and printing apparatus 1000 according to the first embodiment, and the description thereof will be omitted.

As illustrated in FIG. 7, the paper sheet recycling and printing apparatus 1200 according to the present embodiment includes a paper sheet storage section 310 in which the new paper sheet Pn is stored, and the first recycled paper sheet storage section 320 in which the printing recycled paper sheet Pr1 to be supplied for the printing is stored. In addition, the printing recycled paper sheet Pr1 manufactured in the paper sheet recycling section 100 is transported and supplied to the first recycled paper sheet storage section 320 by the recycled paper sheet supply section 200 and is stored in the first recycled paper sheet storage section 320.

Meanwhile, the recycled paper sheet Pr2 manufactured in the paper sheet recycling section 100 is transported from the second recycled paper sheet supply means 222 to recycled paper sheet receiving means 930 provided in the transport section 900. In addition, either the new paper sheet Pn or the printing recycled paper sheet Pr1 is transported to the printing section 500 by the transport section 900 based on the print setting, and the predetermined printing is executed.

In the printing section 500, a paper sheet transport path 500*d* including printing means 500*c* is disposed from the paper sheet taking-in section 500*a* to the printed material discharge section 500*b*. The printing means 500*c* is an apparatus body which prints printing recording information input into the printing section 500 with respect to the recording target medium (printing paper sheet) using the recording medium (ink or toner), and the printing method is not particularly limited.

In the paper sheet recycling and printing apparatus 1200 according to the present embodiment, similar to the paper sheet recycling and printing apparatus 1000 according to the first embodiment, the transport section 900 includes first taking-out means 911 for taking out the new paper sheet Pn from the paper sheet storage section 310 and second taking-out means 912 for taking out the printing recycled paper sheet Pr1 from the first recycled paper sheet storage section 320. The new paper sheet Pn taken out by the first taking-out means 911 or the printing recycled paper sheet Pr1 taken out by the second taking-out means 912 is transported to a paper sheet supply section 900*a* of the transport section 900 by transport means 920 (not illustrated in detail).

In a process in which the new paper sheet Pn is supplied from the paper sheet storage section 310 by the transport section 900 or the printing recycled paper sheet Pr1 from the first recycled paper sheet storage section 320 is supplied by the paper sheet supply section 900*a* to the paper sheet taking-in section 500*a*, and the paper sheet transport path 500*d* is transported, the predetermined recording information is printed by the printing means 500*c* (print head), and the printed material Pp is discharged from the printed material discharge section 500*b*. The printed material Pp discharged from the printed material discharge section 500*b* is discharged to and stored in the printed material storage section 600 and taken out from the paper sheet recycling and printing apparatus 1200 by the operator (person).

Meanwhile, the recycled paper sheet Pr2 manufactured in the paper sheet recycling section 100 is transported to the second recycled paper sheet supply means 222 by the recycled paper sheet transport means 210 provided in the recycled paper sheet supply section 200. Recycled paper sheet receiving means 930 provided in the transport section 900 that can directly deliver the recycled paper sheet Pr2 is connected to the second recycled paper sheet supply means 222. Accordingly, the recycled paper sheet Pr2 transported to the second recycled paper sheet supply means 222 is sent to the transport means 920 provided in the transport section 900 via the recycled paper sheet receiving means 930. Then, the transport section 900 transports the recycled paper sheet Pr2 to the paper sheet supply section 900*a* similar to the above-described new paper sheet Pn or the printing recycled paper sheet Pr1, and the recycled paper sheet Pr2 is supplied to the paper sheet taking-in section 500*a* of the printing section 500.

The recycled paper sheet Pr2 transported to the paper sheet supply section 900*a* is transported from the paper sheet taking-in section 500*a* of the printing section 500 through the paper sheet transport path 500*d* of the printing section 500, discharged to the printed material discharge section 500*b*, and stored in the printed material storage section 600. However, since the recycled paper sheet Pr2 is provided as the recycled paper sheet that is not to be supplied for the printing as described above, the paper sheet recycling and printing apparatus 1200 starts the manufacturing the recycled paper sheet Pr2 and simultaneously sets the printing section 500 offline, and does not execute the printing. Accordingly, the unprinted recycled paper sheet Pr2 is discharged from the printed material discharge section 500*b* and stored in the printed material storage section 600.

Figure 8:
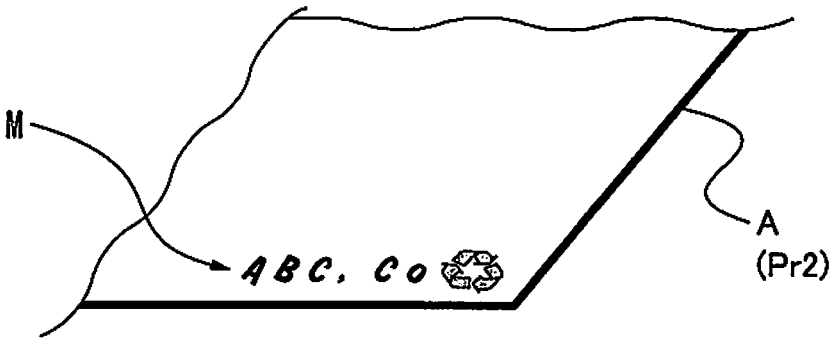
FIG. 8 is an external view of the recycled paper sheet illustrating an example of a printing logo mark.

In the paper sheet recycling and printing apparatus 1200 according to the present embodiment, the recycled paper sheet Pr2 that is not to be supplied for the printing as described above is also configured to transport the paper sheet transport path 500*d* of the printing section 500. In addition, as described above, in general, the printing is not executed on the recycled paper sheet Pr2, but, as illustrated in FIG. 8, for example, it is also easy to create a recycled paper sheet A that serves as the recycled paper sheet Pr2 on which a logo mark M is printed, and it is determined whether to execute the printing.

Figure 9:
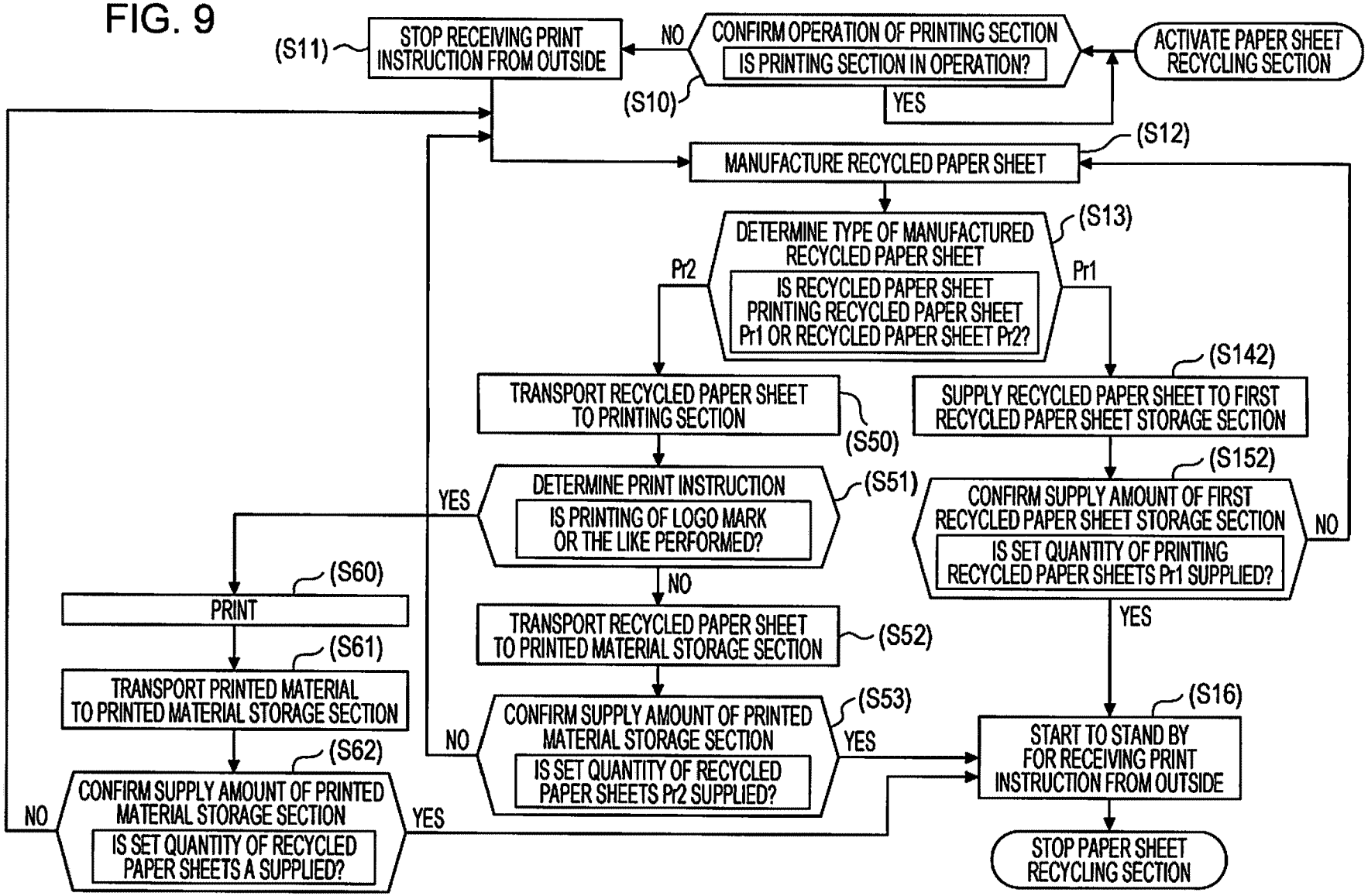
FIG. 9 is a flowchart illustrating a flow in which the recycled paper sheet is supplied from a paper sheet recycling section to a storage section in the paper sheet recycling and printing apparatus according to the third embodiment.

FIG. 9 is a flowchart illustrating a flow for supplying the printing recycled paper sheet Pr1 manufactured in the paper sheet recycling section 100 to the first recycled paper sheet storage section 320 or the recycled paper sheet Pr2 to the printed material storage section 600 via the paper sheet transport path 500*d* of the printing section 500. In addition, in the supply flow of the recycled paper sheet of the paper sheet recycling and printing apparatus 1200 according to the present embodiment illustrated in FIG. 9, since the supplying step (S141) to the second recycled paper sheet storage section in the recycled paper sheet supply flow (refer to FIG. 3) of the paper sheet recycling and printing apparatus 1000 according to the first embodiment and the next supply amount confirming step (S151) of the second recycled paper sheet storage section are different from each other, and a flow of manufacturing the recycled paper sheet A illustrated in FIG. 8 is provided. Since the other flow steps are the same as those of the paper sheet recycling and printing apparatus 1000 according to the first embodiment, the same flow step numbers will be given and the description thereof will be omitted.

As illustrated in FIG. 9, the paper sheet recycling and printing apparatus 1200 according to the present embodiment is driven by the same flow as that of the paper sheet recycling and printing apparatus 1000 according to the first embodiment described in FIG. 3 from the start of the paper sheet recycling section 100 to the manufactured recycled paper sheet type determining step (S13). In addition, in the manufactured recycled paper sheet type determining step (S13), in a case where the printing recycled paper sheet Pr1 is determined, each step from S142 to S16 is the same as those of the paper sheet recycling and printing apparatus 1000 according to the first embodiment, and the printing recycled paper sheet Pr1 is stored in the first recycled paper sheet storage section 320.

(Transport to Printing Section)

As illustrated in FIG. 9, when it is determined that the recycled paper sheet Pr2 that is not to be supplied for the printing is manufactured in the manufactured recycled paper sheet type determining step (S13), a step (S50) of transporting the recycled paper sheet Pr2 from the second recycled paper sheet supply means 222 to the printing section 500 via the recycled paper sheet receiving means 930 is executed, and the recycled paper sheet Pr2 arrives the paper sheet taking-in section 500*a*.

(Printing Instruction Determination)

When the recycled paper sheet Pr2 arrives the paper sheet taking-in section 500*a*, a print instruction determining step (S51) is executed. As described above, although the recycled paper sheet Pr2 is not supplied for the printing use, it is determined whether to manufacture the recycled paper sheet A on which the logo mark is printed as illustrated in FIG. 8.

(Transport to Printed Material Storage Section)

In the print instruction determining step (S51), when it is determined that printing is not performed (NO), the recycled paper sheet Pr2 is transported through the paper sheet transport path 500*d* of the printing section 500. At this time, a step (S52) of transporting the recycled paper sheet Pr2 to the printed material storage section 600 via the printed material discharge section 500*b* is executed without driving the printing means 500*c*.

(Confirmation of Supply Amount of Printed Material Storage Section)

When the recycled paper sheet Pr2 is transported to the printed material storage section 600 (S52), a supply amount confirming step (S53) of the printed material storage section 600 for confirming whether or not the manufacturing quantity of the recycled paper sheets Pr2, that is, the quantity of the recycled paper sheets Pr2 supplied to the printed material storage section 600 is the set quantity, is executed. In addition, in a case where the set quantity has not been reached (NO), the recycled paper sheet manufacturing step (S12) is continued.

(Start of Standby for Receiving Print Instruction from Outside)

In the supply amount confirming step (S53) of the printed material storage section, when the set quantity of the recycled paper sheets Pr2 is supplied to the printed material storage section 600 (YES), the offline state is canceled, and the print instruction receiving standby starting step (S16) from the outside is executed. The message indicating that the printing is possible is displayed in the setting section 700 or the printing section 500, and the manufacturing of the recycled paper sheet in the paper sheet recycling section 100 is stopped.

Meanwhile, in the print instruction determining step (S51), it is determined to print the logo mark or the like (YES), and for example, in a case where the recycled paper sheet A (refer to FIG. 8) is created, the process shifts to the printing.

(Printing)

The printing step (S60) is different from printing of the desired recording information onto the new paper sheet Pn or the printing recycled paper sheet Pr1 based on the print command from the outside with respect to the printing section 500. While the print command or the like from the outside is not received, that is, while the offline state is continued, the printing is executed with respect to the recycled paper sheet Pr2, for example, based on logo mark information or symbol mark information stored in the setting section 700. In the setting section 700, setting of the paper sheet type, that is, whether the recording target medium to be printed is set as the new paper sheet or the recycled paper sheet (Pr1) manufactured under the first condition, and setting of the print instruction or the like, that is, whether to perform the printing of the log mark or the like with respect to the recycled paper sheet manufactured under the second condition, are performed, and the paper sheet recycling and printing apparatus is controlled.

In the paper sheet recycling and printing apparatus 1200 according to the present embodiment, as the recycled paper sheet Pr2 that is not to be supplied for the printing is also supplied to the paper sheet transport path 500*d* including the printing means 500*c* of the printing section 500, in the printing step (S60), when the recycled paper sheet Pr2 is transported to the paper sheet transport path 500*d*, by driving the printing means 500*c*, it is possible to obtain the recycled paper sheet A.

(Transport to Printed Material Storage Section)

When the printing step (S60) is executed, the recycled paper sheet A on which the logo mark or the like is printed on the recycled paper sheet Pr2 is transported (S61) to and stored in the printed material storage section 600.

(Confirmation of Supply Amount of Printed Material Storage Section)

When the recycled paper sheet A obtained by printing the log mark or the like on the recycled paper sheet Pr2 is transported to the printed material storage section 600 (S61), a supply amount confirming step (S62) of the printed material storage section 600 for confirming whether or not the set manufacturing quantity of the recycled paper sheets A, that is, the quantity of the recycled paper sheets A supplied to the printed material storage section 600 is the set quantity, is executed. In addition, in a case where the set quantity has not been reached (NO), the recycled paper sheet manufacturing step (S12) is continued.

(Start of Standby for Receiving Print Instruction from Outside)

In the supply amount confirming step (S62) of the printed material storage section, when the set quantity of the recycled paper sheets A is supplied to the printed material storage section 600 (YES), the offline state is canceled, the print instruction receiving standby starting step (S16) from the outside is executed, and the message indicating that the printing is possible is displayed in the setting section 700 or the printing section 500. In addition, the manufacturing of the recycled paper sheet in the paper sheet recycling section 100 is stopped.

In addition, since a flow for transporting and supplying the new paper sheet Pn stored in the paper sheet storage section 310 or the printing recycled paper sheet Pr1 stored in the first recycled paper sheet storage section 320 to the printing section 500 and manufacturing the printed material Pp is the same as that of the flowchart illustrated in FIG. 4, the description thereof will be omitted.

As described above, as the paper sheet recycling and printing apparatus 1200 according to the present embodiment is configured to transport the recycled paper sheet Pr2 that is not to be supplied for the printing through the paper sheet transport path 500*d* of the printing section 500, as illustrated in FIG. 8, in a case of creating the recycled paper sheet A that serves as the recycled paper sheet Pr2 that is not to be supplied for the printing and on which, for example, the logo mark M is printed, it is possible to easily obtain the recycled paper sheet A on which the logo mark M is printed. In addition, the object to be printed on the recycled paper sheet A is not limited to the logo mark M, and may be a ruled line, a manufacturing date, the number of times of recycling, or the like.

In addition, without providing the second recycled paper sheet storage section 330 in which the recycled paper sheet Pr2 is stored in the paper sheet recycling and printing apparatus 1000 according to the first embodiment, as the recycled paper sheet Pr2 is discharged to the printed material storage section 600 directly from the recycled paper sheet supply section 200 via the paper sheet transport path 500*d* of the printing section 500, it is possible to easily simplify the apparatus and take out the recycled paper sheet by using the printed material storage section 600 as the storage section of the recycled paper sheet Pr2 without using the storage section dedicated to recycled paper sheet Pr2.

In addition, as illustrated in FIG. 9, since the printing section 500 is set to be in the offline state in advance in step S11, the printed material Pp is not discharged from the printing section 500 to the printed material storage section 600. Therefore, even in a case where the printed material Pp is already stored in the printed material storage section 600, the recycled paper sheet Pr2 is discharged to the uppermost part of the stored printed material Pp, and, it is possible to avoid that the recycled paper sheet Pr2 or the recycled paper sheet A and the printed material Pp are mixed with each other.

Fourth Embodiment

As a fourth embodiment, a printing apparatus 2000 provided with the storage section 300 including the first recycled paper sheet storage section 320 and the second recycled paper sheet storage section 330 will be described. In addition, the printing apparatus 2000 according to the present embodiment has an aspect in which the paper sheet recycling section 100 of the paper sheet recycling and printing apparatus 1000 according to the first embodiment is configured as a paper sheet recycling apparatus 2100 that serves as an independent apparatus and is incorporated in a paper sheet recycling and printing system 10000. Therefore, the same reference numerals will be given to the same configuration elements as those of the paper sheet recycling and printing apparatus 1000 according to the first embodiment, and the description thereof will be omitted.

More specifically, in the printing apparatus 2000 according to the present embodiment, the printed material storage section 600, the printing section 500, the transport section 400, the storage section 300, and the recycled paper sheet supply section 200 have the same reference numerals as those of the paper sheet recycling and printing apparatus 1000 according to the first embodiment.

Figure 10:
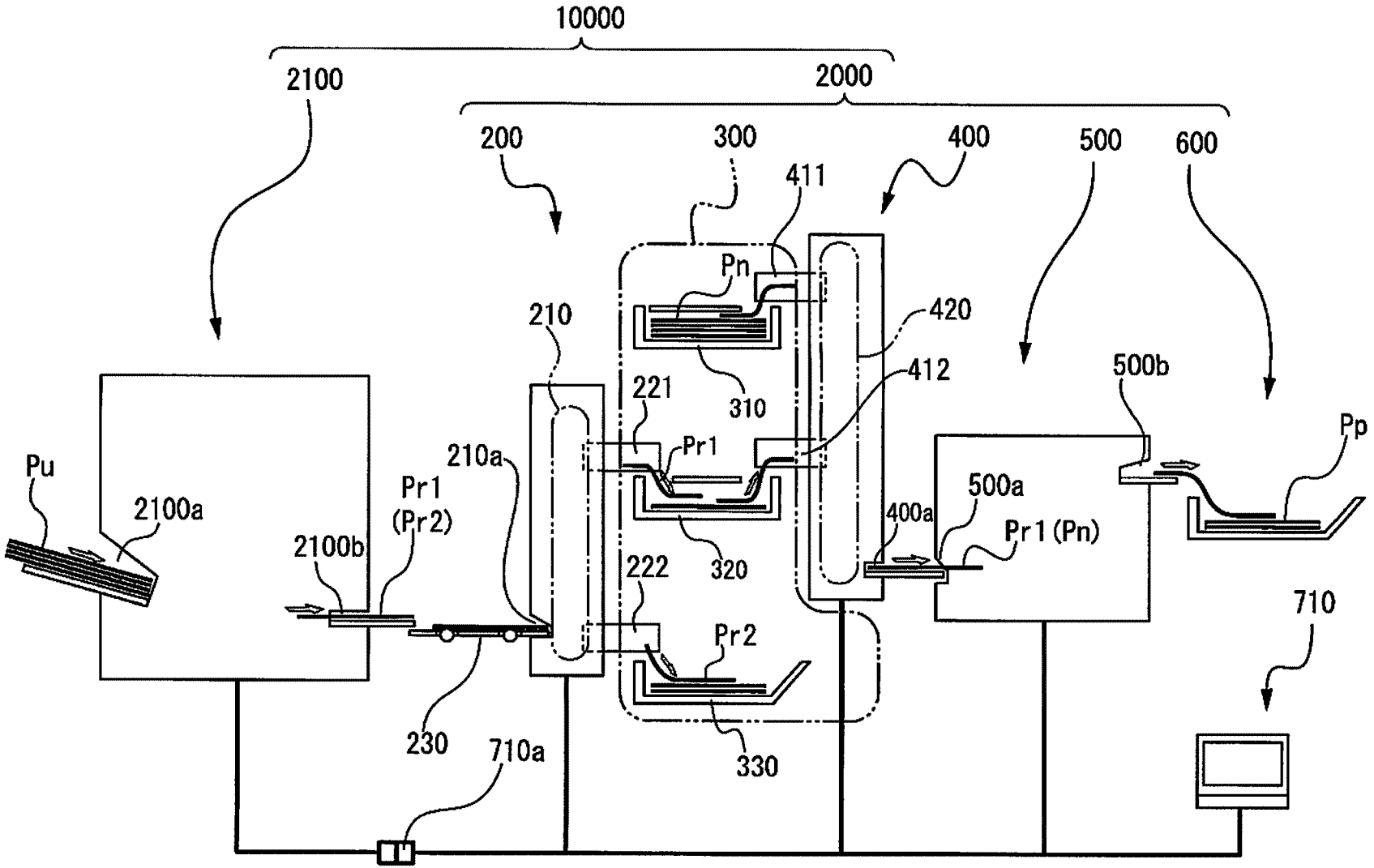
FIG. 10 is a configuration view illustrating a schematic configuration of a paper sheet recycling and printing system according to a fourth embodiment.

As illustrated in FIG. 10, the paper sheet recycling and printing system 10000 includes the paper sheet recycling apparatus 2100 and the printing apparatus 2000. The paper sheet recycling apparatus 2100 includes the same apparatus configuration (refer to FIG. 2) on the inside thereof as the paper sheet recycling section 100 provided in the paper sheet recycling and printing apparatus 1000 illustrated in FIG. 1, for example, and the waste paper sheet Pu supplied to a waste paper sheet supply section 2100*a* is discharged to a recycled paper sheet discharge section 2100*b* as the printing recycled paper sheet Pr1 or the recycled paper sheet Pr2. In addition, the method of recycling the paper sheet is not limited to the method illustrated in FIG. 2, and various paper sheet recycling methods, such as a method of physically removing a recording medium called a toner that adheres to the surface of the recording target medium and a wet type paper sheet recycling method, can be adopted.

The discharged printing recycled paper sheet Pr1 or recycled paper sheet Pr2 is transported to the recycled paper sheet insertion port 210*a* of the recycled paper sheet supply section 200 via the supply transport section 230. Then, the transported printing recycled paper sheet Pr1 is supplied to and stored in the first recycled paper sheet storage section 320 provided in the storage section 300 by the first recycled paper sheet supply means 221 of the recycled paper sheet supply section 200. Meanwhile, the recycled paper sheet Pr2 that is not to be supplied for the printing is supplied to and stored in the second recycled paper sheet storage section 330 by the second recycled paper sheet supply means 222.

The supply transport section 230 is provided in the recycled paper sheet supply section 200, but is disposed to be detachable from the paper sheet recycling apparatus 2100. Further, in the paper sheet recycling and printing system 10000, a setting section 710 including a control section (not illustrated) for controlling the paper sheet recycling and printing system 10000 is provided. A control line that connects the setting section 710 and the paper sheet recycling apparatus 2100 to each other is detachably connected by a connector 710*a*. In this manner, as the paper sheet recycling apparatus 2100 and the printing apparatus 2000 are configured to be separable at the position of the supply transport section 230, it is possible to easily exchange only the paper sheet recycling apparatus 2100, and to easily perform maintenance and management of the paper sheet recycling and printing system 10000. In addition, the setting section 710 and the paper sheet recycling apparatus 2100 may be connected to each other by wireless communication. The setting section 710 enables an input of operation settings and the like by the operator (person), is a controller with a display device including a touch panel and the like, includes a CPU, a ROM, and a RAM, and controls the paper sheet recycling apparatus 2100.

In addition, in the printing apparatus 2000 according to the present embodiment, since a flow for supplying the printing recycled paper sheet Pr1 supplied from the paper sheet recycling apparatus 2100 to the first recycled paper sheet storage section 320 and a flow for supplying the recycled paper sheet Pr2 to the second recycled paper sheet storage section 330 are the same as those of the flowchart illustrated in FIG. 3, the description thereof will be omitted. In addition, since a flow for transporting and supplying the new paper sheet Pn or the printing recycled paper sheet Pr1 stored in the storage section 300 to the printing section 500 and manufacturing the printed material Pp is the same as that of the flowchart illustrated in FIG. 4, the description thereof will be omitted.

The paper sheet recycling and printing system 10000 including the printing apparatus 2000 according to the present embodiment may be a paper sheet recycling and printing system in which the second recycled paper sheet storage section 330 provided in the paper sheet recycling and printing apparatus 1000 according to the first embodiment is provided, the recycled paper sheet Pr2 that is not to be supplied for the printing is stored in the second recycled paper sheet storage section 330, the second recycled paper sheet storage section 330 functions as the taking-out section of the recycled paper sheet Pr2, but the printed material storage section 600 according to the second or third embodiment is provided, and the recycled paper sheet Pr2 is supplied to the printed material storage section 600.

Fifth Embodiment

As a fifth embodiment, a paper sheet recycling apparatus 3000 provided with the storage section 300 including the first recycled paper sheet storage section 320 and the second recycled paper sheet storage section 330 will be described. In addition, the paper sheet recycling apparatus 3000 according to the present embodiment has an aspect in which the printing section 500 of the paper sheet recycling and printing apparatus 1000 according to the first embodiment includes a printing apparatus 3100 as an independent apparatus, and a printing apparatus unit 3200 obtained by combining the printed material storage section 600 with the printing apparatus 3100 is configured and is incorporated in a paper sheet recycling and printing system 20000. Therefore, the same reference numerals will be given to the same configuration elements as those of the paper sheet recycling and printing apparatus 1000 according to the first embodiment, and the description thereof will be omitted.

More specifically, in the paper sheet recycling apparatus 3000 according to the present embodiment, the paper sheet recycling section 100, the recycled paper sheet supply section 200, the storage section 300, the transport section 400, and the printed material storage section 600 are the same configuration elements as those of the paper sheet recycling and printing apparatus 1000 according to the first embodiment.

Figure 11:
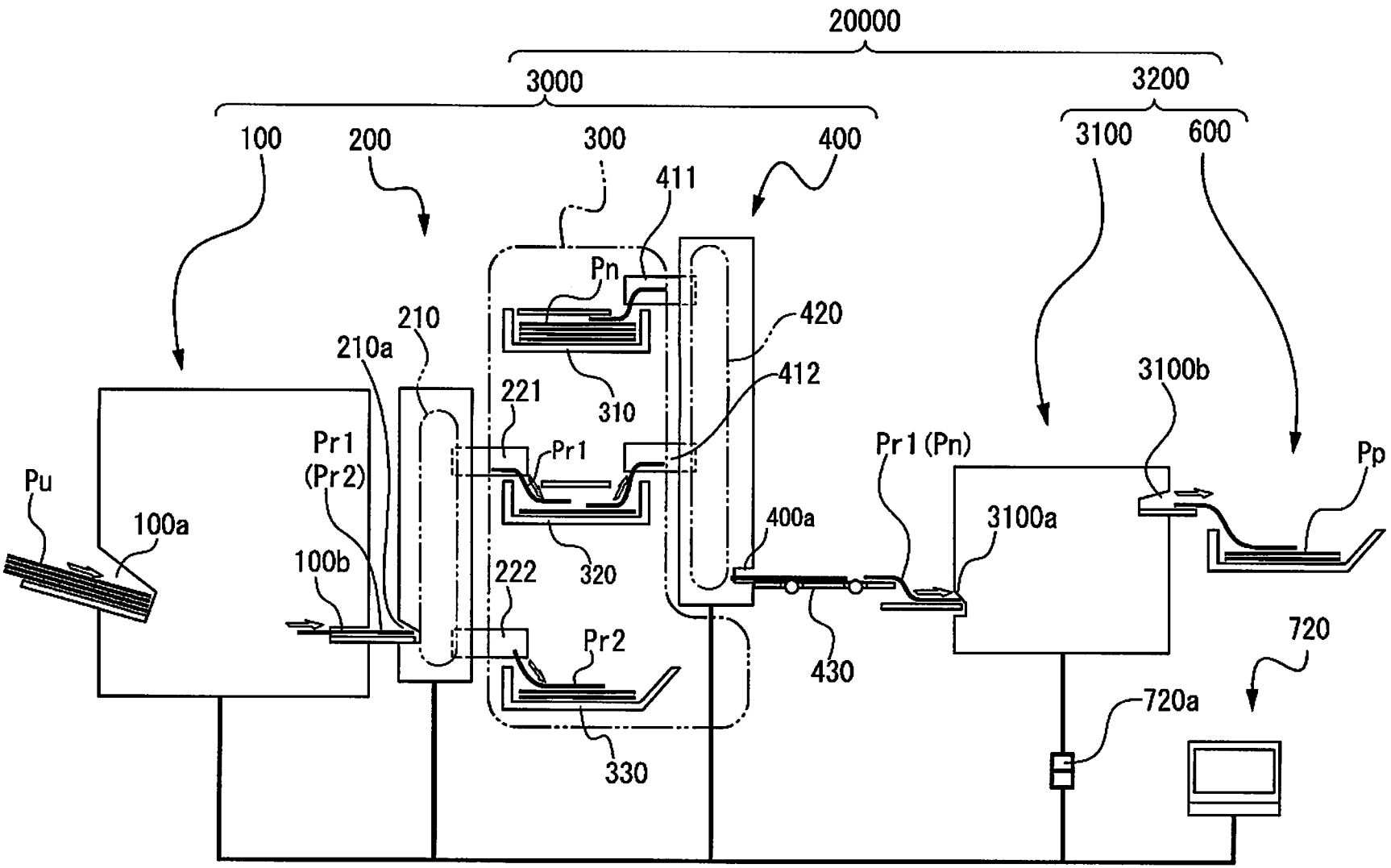
FIG. 11 is a configuration view illustrating a schematic configuration of a paper sheet recycling and printing system according to a fifth embodiment.

As illustrated in FIG. 11, the paper sheet recycling and printing system 20000 includes the paper sheet recycling apparatus 3000, and the printing apparatus unit 3200 including the printing apparatus 3100 and the printed material storage section 600. The paper sheet recycling apparatus 3000 stores the printing recycled paper sheet Pr1 among the recycled paper sheets manufactured in the paper sheet recycling section 100 in the first recycled paper sheet storage section 320 provided in the storage section 300, supplies the new paper sheet Pn that serves as the predetermined recording target medium from the paper sheet storage section 310 by the print command from the printing apparatus 3100, supplies the printing recycled paper sheet Pr1 from the first recycled paper sheet storage section 320 to the printing apparatus 3100 according to the flowchart illustrated in FIG. 4, and stores the printed material Pp in the printed material storage section 600.

In addition, the paper sheet recycling apparatus 3000 is an apparatus for supplying the recycled paper sheet Pr2 that is not to be supplied for the printing among the recycled paper sheets manufactured in the paper sheet recycling section 100 to the second recycled paper sheet storage section 330 and for storing the recycled paper sheet Pr2 therein. In addition, the method of recycling the paper sheet in the paper sheet recycling apparatus 3000 is not limited to the method illustrated in FIG. 2, and various paper sheet recycling methods, such as a method of physically removing a recording medium called a toner that adheres to the surface of the recording target medium and a wet type paper sheet recycling method, can be adopted.

Between the transport section 400 and the printing apparatus 3100, the new paper sheet Pn or the printing recycled paper sheet Pr1 of the recording target medium discharged from the paper sheet supply section 400*a* is transported to the paper sheet taking-in section 3100*a* of the printing apparatus 3100 by the supply transport section 430 provided in the transport section 400.

The supply transport section 430 is disposed separably between the paper sheet recycling apparatus 3000 and the printing apparatus 3100, and can easily exchange the printing apparatus 3100. In other words, in the paper sheet recycling and printing system 20000, the printing apparatus 3100 is an apparatus that is easily applied to an appropriate printing apparatus according to work, for example, from a laser printer to an ink jet printer or a printing apparatus having a faster printing speed, or from a monochrome printer to a color printer.

Further, in the paper sheet recycling and printing system 20000, a setting section 720 including a control section (not illustrated) for controlling the paper sheet recycling and printing system 20000 is provided, and the control line that connects the setting section 720 and the printing apparatus 3100 to each other is detachably connected by the connector 720*a*. In addition, the setting section 720 and the printing apparatus 3100 may be connected to each other by wireless communication.

In this manner, as the paper sheet recycling apparatus 3000 and the printing apparatus 3100 are configured to be separable at the position of the supply transport section 430, it is easy to exchange only the printing apparatus 3100, and to easily perform maintenance and management of the paper sheet recycling and printing system 20000.

In addition, in the paper sheet recycling apparatus 3000 according to the present embodiment, since a flow for supplying the printing recycled paper sheet Pr1 supplied from the paper sheet recycling section 100 to the first recycled paper sheet storage section 320 and a flow for supplying the recycled paper sheet Pr2 to the second recycled paper sheet storage section 330 are the same as those of the flowchart illustrated in FIG. 3, the description thereof will be omitted. In addition, since a flow for transporting and supplying the new paper sheet Pn or the printing recycled paper sheet Pr1 stored in the storage section 300 to the printing apparatus 3100, manufacturing the printed material Pp, and supplying the printed material Pp to the printed material storage section 600 is the same as that of the flowchart illustrated in FIG. 4, the description thereof will be omitted.

The paper sheet recycling and printing system 20000 including the paper sheet recycling apparatus 3000 according to the present embodiment may be a paper sheet recycling and printing system in which the second recycled paper sheet storage section 330 provided in the paper sheet recycling and printing apparatus 1000 according to the first embodiment is provided, the recycled paper sheet Pr2 that is not to be supplied for the printing is stored in the second recycled paper sheet storage section 330, the second recycled paper sheet storage section 330 functions as the taking-out section of the recycled paper sheet Pr2, but the printed material storage section 600 according to the second or third embodiment is provided, and the recycled paper sheet Pr2 is supplied to the printed material storage section 600.

In addition, in the present embodiment, the storage section 300 is described as a section including the paper sheet storage section 310 in which the new paper sheet Pn is stored, but the new paper sheet Pn may be stored on the inside of the printing apparatus 3100. By doing so, the printing on the new paper sheet Pn is completed within the printing apparatus 3100, and thus, the printing speed or the printing quality are improved. Further, the configuration of the paper sheet recycling and printing system 2000 is simplified.

As described above, the paper sheet recycling section 100 provided in the paper sheet recycling and printing apparatus 1000 according to the first embodiment, the paper sheet recycling and printing apparatus 1100 according to the second embodiment, the paper sheet recycling and printing apparatus 1200 according to the third embodiment, the paper sheet recycling and printing system 10000 including the printing apparatus 2000 according to the fourth embodiment, and the paper sheet recycling and printing system 20000 including the paper sheet recycling apparatus 3000 according to the fourth embodiment can manufacture the printing recycled paper sheet Pr1 to be supplied for the printing and the recycled paper sheet Pr2 that is not to be supplied for the printing.

Since at least two types of recycled paper sheets (printing recycled paper sheet Pr1 and recycled paper sheet Pr2) are used differently, and in particular, the recycled paper sheet Pr2 is simply used as the recycled paper sheet cut form, the recycled paper sheet Pr2 is supplied to and stored in the second recycled paper sheet storage section 330 provided in the paper sheet recycling and printing apparatus 1000 and the paper sheet recycling and printing systems 10000 and 20000 according to the above-described embodiments, and the printed material storage section 600 in the paper sheet recycling and printing apparatus 1100 according to the second embodiment and the paper sheet recycling and printing apparatus 1200 according to the third embodiment, and accordingly, it is possible to easily take out the recycled paper sheet Pr2.

In addition, in the paper sheet recycling and printing apparatus 1200 according to the third embodiment, even when the recycled paper sheet Pr2 is supplied from the transport section 900 to the printing section 500, the taking-out section of the printed material Pp and the recycled paper sheet Pr2 in the apparatus can be used commonly by discharging the paper sheets to the printed material discharge section 500*b* without printing, and it is possible to provide ease of taking out the paper sheet.

Furthermore, in the manufacturing flow of the paper sheet recycle in the paper sheet recycling and printing apparatus 1000 according to the first embodiment, the paper sheet recycling and printing apparatus 1100 according to the second embodiment, the paper sheet recycling and printing apparatus 1200 according to the third embodiment, the paper sheet recycling and printing system 10000 including the printing apparatus 2000 according to the fourth embodiment, and the paper sheet recycling and printing system 20000 including the paper sheet recycling apparatus 3000 according to the fifth embodiment, the print instruction receiving stopping step (step S11 in FIGS. 3, 6, and 9) from the outside is included, and accordingly, a state where the print command cannot be input into the printing section 500 during the manufacturing of the recycled paper sheet is configured.

Accordingly, when the printing recycled paper sheet Pr1 from the paper sheet recycling section 100 is supplied to the first recycled paper sheet storage section 320, the printing recycled paper sheet Pr1 is not taken out from the first recycled paper sheet storage section 320 for the printing in the printing section 500. In other words, when the printing recycled paper sheet Pr1 transported from the first recycled paper sheet storage section 320 to the printing section 500 is taken out, there is no case where the supply of the printing recycled paper sheet Pr1 from the paper sheet recycling section 100 overlaps the taking-out. Therefore, it is possible to prevent occurrence of jamming at the time of paper feeding.

Sixth Embodiment

Figure 12:
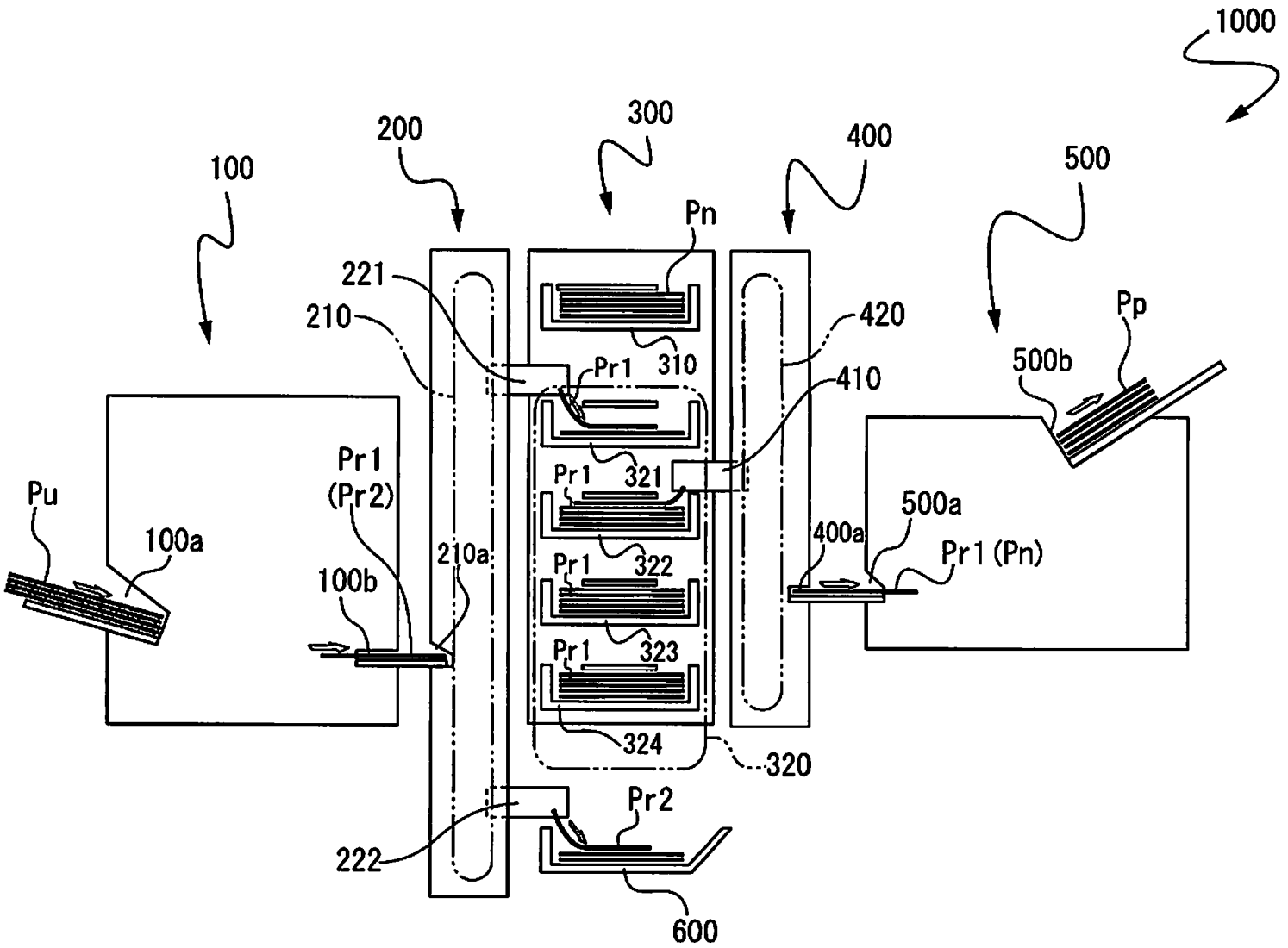
FIG. 12 is a configuration view illustrating a schematic configuration of a paper sheet recycling and printing apparatus according to a sixth embodiment.

FIG. 12 is a configuration view illustrating a schematic configuration of the paper sheet recycling and printing apparatus according to a sixth embodiment. The paper sheet recycling and printing apparatus 1000 illustrated in FIG. 12 includes: the paper sheet recycling section 100; the storage section 300 in which the printing recycled paper sheet Pr1 (hereinafter, referred to as the printing recycled paper sheet Pr1) as the recycled paper sheet to be provided for the printing to be recycled from the waste paper sheet Pu inserted into the paper sheet recycling section 100 and the unprinted new paper sheet Pn are stored as the recording target medium; the printing section 500 which prints the predetermined recording information on the new paper sheet Pn or the printing recycled paper sheet Pr1 to be supplied from the storage section 300; the recycled paper sheet discharge section (second recycled paper sheet storage section) 600 which makes it possible to directly take out the recycled paper sheet Pr2 that is to be discharged from the paper sheet recycling section 100, is directly taken out not passing through the printing section 500, and is not to be supplied for the printing; and an apparatus control section (not illustrated).

The storage section 300 includes the paper sheet storage section 310 in which the new paper sheet Pn is stored, and the recycled paper sheet storage unit 320 in which the printing recycled paper sheet Pr1 is stored. In this example, the recycled paper sheet storage unit 320 includes the plurality of recycled paper sheet storage sections (first recycled paper sheet storage section) 321, 322, 323, and 324 including the recycled paper sheet storage section (first recycled paper sheet storage section) 321 to which the printing recycled paper sheet Pr1 formed in the paper sheet recycling section 100 is supplied and in which the printing recycled paper sheet Pr1 is stored; the recycled paper sheet storage section (first recycled paper sheet storage section) 322 in which the printing recycled paper sheet Pr1 supplied to the printing section 500 is stored; and the recycled paper sheet storage sections (first recycled paper sheet storage sections) 323 and 324 which stand by in a state where the printing recycled paper sheet Pr1 is stored, as illustrated in the drawing.

In addition, in the paper sheet recycling and printing apparatus 1000 illustrated in FIG. 12, one paper sheet storage section 310 in which the new paper sheet Pn is stored and four recycled paper sheet storage sections (first recycled paper sheet storage sections) 321, 322, 323, and 324 in which the printing recycled paper sheet Pr1 is stored are exemplified, but the invention is not limited thereto. The plurality of paper sheet storage sections 310 in which the new paper sheet Pn is stored may be provided. The recycled paper sheet storage section (first recycled paper sheet storage section) in which the printing recycled paper sheet Pr1 is stored may include two recycled paper sheet storage sections including at least the recycled paper sheet storage section (first recycled paper sheet storage section) for the supply to the printing section 500 and the recycled paper sheet storage section (first recycled paper sheet storage section) in which the printing recycled paper sheet Pr1 to be discharged from the paper sheet recycling section 100 is stored.

The recycled paper sheet supply section 200 is provided between the paper sheet recycling section 100 and the storage section 300. The recycled paper sheet supply section 200 includes: the recycled paper sheet transport means 210 (not illustrated in detail); the first recycled paper sheet supply means (recycled paper sheet storage and supply means) 221 that serves as the recycled paper sheet storage and supply section (first recycled paper sheet supply section); and the second recycled paper sheet supply means (recycled paper sheet discharge and supply means) 222 that serves as the recycled paper sheet discharge and supply section (second recycled paper sheet supply section). The waste paper sheet Pu is inserted into the paper sheet recycling section 100 from the waste paper sheet supply section 100*a* provided in the paper sheet recycling section 100, and the recycled printing recycled paper sheet Pr1 or recycled paper sheet Pr2 are delivered to the recycled paper sheet insertion port 210*a* provided in the recycled paper sheet supply section 200 from the recycled paper sheet discharge section (second recycled paper sheet storage section) 100*b*.

The recycled paper sheet supply section 200 can transport the recycled paper sheet Pr2 to be described later to the second recycled paper sheet supply means (recycled paper sheet discharge and supply means) 222 for the supply to the recycled paper sheet discharge section (second recycled paper sheet storage section) 600 by the recycled paper sheet transport means 210. In the recycled paper sheet transport means 210, a driving section that serves as the supply section switching means (not illustrated) is provided, and it is possible to switch the transport path such that the transport path of the printing recycled paper sheet Pr1 is set in the first recycled paper sheet supply means (recycled paper sheet storage and supply means) 221 in a case where the printing recycled paper sheet Pr1 is supplied to the recycled paper sheet storage section 320 provided in the storage section 300, and the transport path of the recycled paper sheet Pr2 is set in the second recycled paper sheet supply means (recycled paper sheet discharge and supply means) 222 in a case where the recycled paper sheet Pr2 is supplied to the recycled paper sheet discharge section (second recycled paper sheet storage section) 600.

The printing recycled paper sheet Pr1 inserted into the recycled paper sheet insertion port 210*a* is transported to the first recycled paper sheet supply means (recycled paper sheet storage and supply means) 221 by the recycled paper sheet transport means 210. The first recycled paper sheet supply means (recycled paper sheet storage and supply means) 221 moves such that the printing recycled paper sheet Pr1 can be supplied to any of the recycled paper sheet storage sections (first recycled paper sheet storage sections) 321, 322, 323, and 324 provided in the recycled paper sheet storage unit 320 by driving means that serves as the storage section switching means (not illustrated), and stores the printing recycled paper sheet Pr1 therein. In the present embodiment, an aspect in which the printing recycled paper sheet Pr1 is stored in the recycled paper sheet storage section (first recycled paper sheet storage section) 321 is exemplified.

Meanwhile, the recycled paper sheet Pr2 may be suggested as various forms, such as, a recycled paper sheet that is not to be supplied for the printing as described above, for example, a recycled paper sheet to be supplied for the printing of another printing machine, or a paper sheet for handwritten memo. Further, in the paper sheet recycling section 100 to be described later, it is also possible to form a color recycled paper sheet since coloring is possible in the paper sheet recycling section 100 not being limited to a colorless (white) recycled paper sheet, and it is possible to provide the recycled paper sheet not only for the printing but also for various uses other than the printing, such as decoration or origami. Therefore, the transport path through which the recycled paper sheet Pr2 is not supplied to the printing section 500 included in the printing paper sheet recycling and printing apparatus 1000 is set.

As illustrated in FIG. 12, the recycled paper sheet Pr2 formed in the paper sheet recycling section 100 is discharged from the recycled paper sheet discharge section (second recycled paper sheet storage section) 100*b* and is inserted into the recycled paper sheet insertion port 210*a* provided in the recycled paper sheet supply section 200. The recycled paper sheet Pr2 inserted into the recycled paper sheet supply section 200 is supplied to the recycled paper sheet discharge section (second recycled paper sheet storage section) 600 from the second recycled paper sheet supply means (recycled paper sheet discharge and supply means) 222 by the recycled paper sheet transport means 210 switched to the supply to the second recycled paper sheet supply means (recycled paper sheet discharge and supply means) 222 by the supply section switching means, and the predetermined quantity of the recycled paper sheets Pr2 are stored. Then, the necessary quantity of the recycled paper sheets Pr2 is taken out from the recycled paper sheet discharge section (second recycled paper sheet storage section) 600, for example, by the hand of human.

Between the storage section 300 and the printing section 500, the transport section 400 for transporting and supplying the new paper sheet Pn or the printing recycled paper sheet Pr1 that is stored in the storage section 300 and serve as the recording target medium to the printing section 500, is provided.

The transport section 400 includes: paper sheet acquiring means 410 for picking up the desired paper sheet from the paper sheet storage section 310 in which the new paper sheet Pn is stored or the recycled paper sheet storage sections (first recycled paper sheet storage sections) 321, 322, 323, and 324 in which the printing recycled paper sheet Pr1 is stored; and the paper sheet transport means 420 (not illustrated in detail) for transporting the paper sheet picked up by the paper sheet acquiring means 410 to the paper sheet supply section 400*a*.

The paper sheet acquiring means 410 is driven by the driving means that serves as the transport switching means (not illustrated) at the position at which the paper sheet storage section 310 in which the new paper sheet Pn is stored or the recycled paper sheet storage sections (first recycled paper sheet storage sections) 321, 322, 323, and 324 in which the printing recycled paper sheet Pr1 is stored are disposed by a paper sheet selection command from the printing section 500, and can pick up a desired paper sheet.

The printing recycled paper sheet Pr1 or the new paper sheet Pn supplied from the paper sheet supply section 400*a* of the transport section 400 is taken into the apparatus from the paper sheet taking-in section 500*a* of the printing section 500, and is discharged to the printed material discharge section 500*b* that serves as the recording target medium discharge section as the printed material Pp on which the desired recording information is printed. In addition, the printing section 500 is not particularly limited as long as the printing section 500 forms the printed material Pp by making toner or ink of the recording medium adhere to the surface of the recording target medium, such as a so-called laser printer or an ink jet printer.

Figure 13:
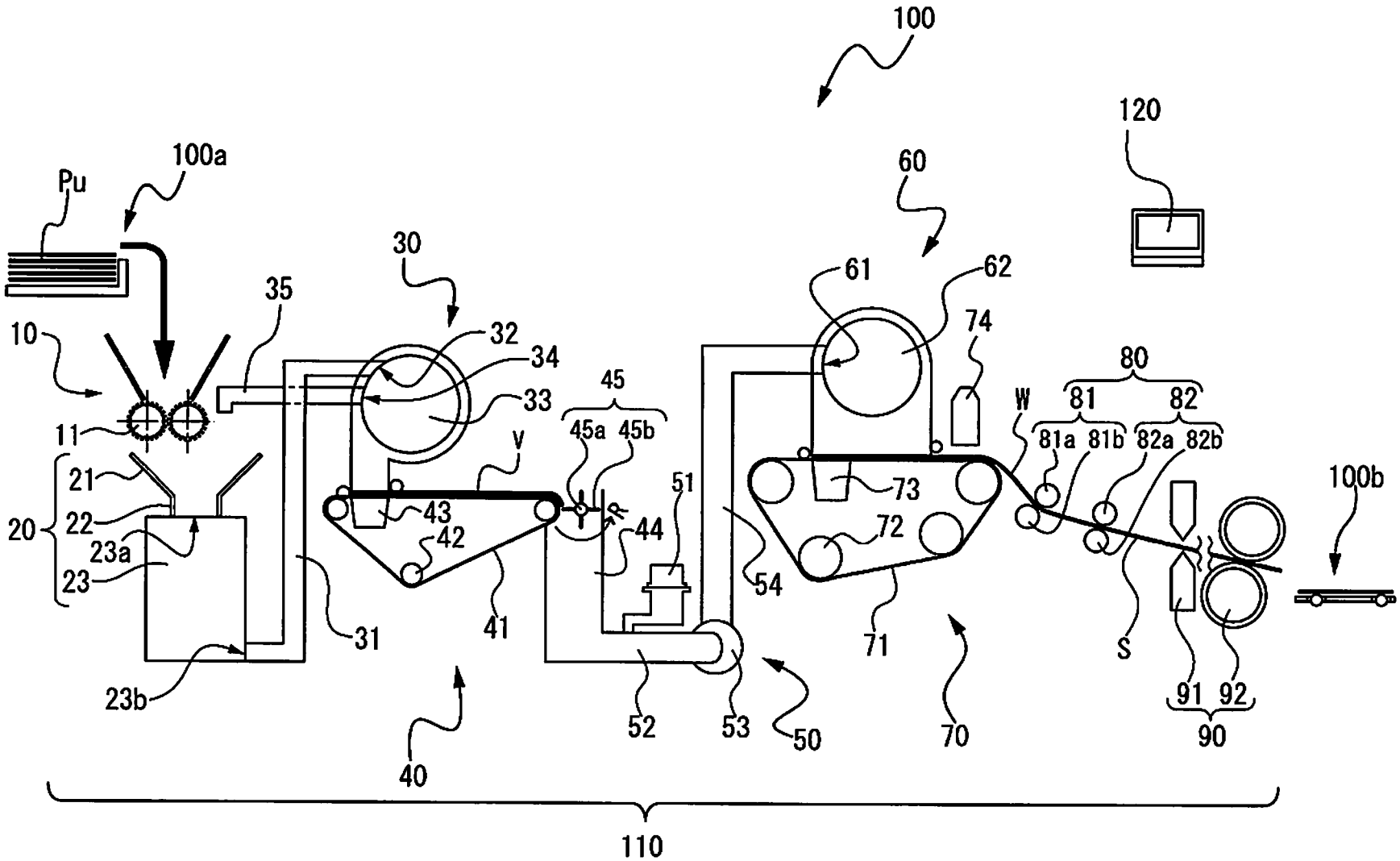
FIG. 13 is a configuration view illustrating a schematic configuration of a paper sheet recycling section included in the paper sheet recycling and printing apparatus according to the sixth embodiment.

FIG. 13 is a configuration view illustrating a schematic configuration of the paper sheet recycling section 100 included in the paper sheet recycling and printing apparatus 1000 according to the present embodiment. As illustrated in FIG. 13, the paper sheet recycling section 100 includes the waste paper sheet supply section 100*a*, the manufacturing section 110, and the control section 120. The manufacturing section 110 manufactures the printing recycled paper sheet Pr1 or the recycled paper sheet Pr2. The manufacturing section 110 includes the coarse crushing section 10, the defibrating section 20, the sorting section 30, the first web forming section 40, the rotating body 45, the mixing section 50, the depositing section 60, the second web forming section 70, the sheet forming section 80, and the cutting section 90.

The waste paper sheet supply section 100*a* supplies the waste paper sheet Pu to the coarse crushing section 10. The waste paper sheet supply section 100*a* is, for example, an automatic inserting section for continuously inserting the waste paper sheet Pu to the coarse crushing section 10. The waste paper sheet Pu supplied by the waste paper sheet supply section 100*a* is not limited to the waste paper sheet but may be any paper sheet containing fibers, for example, a pulp sheet.

In the coarse crushing section 10, the waste paper sheet Pu supplied by the waste paper sheet supply section 100*a* is cut into pieces by cutting in the air. The shape or size of the pieces is, for example, several cm square. In the example illustrated in the drawing, the coarse crushing section 10 has the coarse crushing blade 11, and the coarse crushing blade 11 can cut the inserted raw material. As the coarse crushing section 10, for example, a shredder can be used. The waste paper sheet Pu cut by the coarse crushing section 10 is transferred (transported) to the defibrating apparatus section 23 via the pipe 22 after being received by the hopper 21 provided in the defibrating section 20.

The defibrating apparatus section 23 defibrates the raw material cut by the coarse crushing section 10. Here, a term "defibrate" in the present specification means to disentangle the fibers of the waste paper sheet Pu that serves as a defibration target formed by binding a plurality of fibers, one by one. The defibrating apparatus section 23 also has a function of separating substances, such as resin particles, ink, toner, or bleed inhibitor, that adhere to the raw material, from the fibers.

The material that has passed through the defibrating apparatus section 23 is referred to as "defibrated material". There is also a case where "defibrated material" includes not only disentangled defibrated material fibers but also resin (resin for binding a plurality of fibers) particles separated from the fibers when disentangling the fibers, a coloring material, such as ink or toner, or additives, such as bleed inhibitor or paper strength enhancer.

The defibrating apparatus section 23 performs the defibration in a so-called dry type in the atmosphere (in the air) without using a solvent, water or the like. Specifically, as the defibrating apparatus section 23, an impeller mill is used. The defibrating apparatus section 23 has a function of generating an airflow that suctions the raw material and discharges the defibrated material. Accordingly, the defibrating apparatus section 23 can suction the raw material together with the airflow from the introduction port 23*a* by the airflow generated by the defibrating apparatus section 23 itself, perform defibration processing, and transport the defibrated material to the discharge port 23*b*. The defibrated material that has passed through the defibrating apparatus section 23 is transferred to the sorting section 30 via the pipe 31. In addition, the airflow for transporting the defibrated material from the defibrating apparatus section 23 to the sorting section 30 may use the airflow generated in the defibrating apparatus section 23, or may use the airflow by providing an airflow generating apparatus, such as a blower.

The sorting section 30 introduces the defibrated material defibrated by the defibrating section 20 through the pipe 31 into the sorting apparatus section 33 from the introduction port 32 and sorts the defibrated material according to the length of the fiber. For example, a sieve is used as the sorting apparatus section 33. The sorting apparatus section 33 has a mesh (filter, screen) and can divide the defibrated material into fibers or particles (fibers or particles that have passed through the mesh, that is, a first sorted material) smaller than an aperture of the mesh, and particles, undefibrated pieces, or dams (particles, pieces, or dams that do not pass through the mesh, that is, a second sorted material) larger than the aperture of the mesh. For example, the first sorted material is transferred to the mixing section 50 via the pipe 44. The second sorted material is returned from the discharge port 34 to the defibrating section 20 via the pipe 35. Specifically, the sorting apparatus section 33 is a cylindrical sieve which is rotationally driven by a motor. As the mesh of the sorting apparatus section 33, for example, a wire mesh, an expanded metal obtained by stretching a metal plate with a cut, and a punching metal having a hole formed in a metal plate by a press machine or the like are used.

The first web forming section 40 transports the first sorted material that has passed through the sorting section 30 to the mixing section 50. The first web forming section 40 includes the mesh belt 41, the stretching roller 42, and the suction section (suction mechanism) 43.

The suction section 43 can suction the first sorted material dispersed in the air passing through an opening (mesh opening) of the sorting section 30 onto the mesh belt 41. The first sorted material is suctioned from the sorting section 30 by the suction section 43, is deposited on the moving mesh belt 41, and forms the web V. The basic configuration of the mesh belt 41, the stretching roller 42, and the suction section 43 is the same as that of the mesh belt 71, the stretching roller 72, and the suction section (suction mechanism) 73 of the second web forming section 70 to be described later.

By passing through the sorting section 30 and the first web forming section 40, the web V is formed in a state of containing a large amount of air and being softly bulged. The web V deposited on the mesh belt 41 is inserted into the pipe 44 and transported to the mixing section 50.

The rotating body 45 can cut the web V before the web V is transported to the mixing section 50. In the illustrated example, the rotating body 45 has the base portion 45*a* and the protrusion portion 45*b* that protrudes from the base portion 45*a*. The protrusion portion 45*b* has, for example, a plate-like shape. In the illustrated example, four protrusion portions 45*b* are provided, and the four protrusion portions 45*b* are provided at equivalent intervals. As the base portion 45*a* rotates in the direction R, the protrusion portion 45*b* can rotate around the base portion 45*a*. By cutting the web V with the rotating body 45, for example, it is possible to reduce fluctuation in the amount of the defibrated material per unit time supplied to the depositing section 60 to be described later.

The mixing section 50 passes through the sorting section 30 and mixes the first sorted material transported by the first web forming section 40 and a binder resin powder with each other. The mixing section 50 includes the powder supply device 51 for supplying the binder resin powder, the pipe 52 for transporting the first sorted material and the binder resin powder, and the blower 53. The pipe 52 is continuous with the pipe 44.

In the mixing section 50, the airflow is generated by the blower 53, and the first sorted material and the binder resin powder supplied from the powder supply device 51 can be transported in the pipe 52 while being mixed with each other. The binder resin powder supplied from the powder supply device 51 contains a resin capable of binding a plurality of fibers. At the time when the resin is supplied, the plurality of fibers is not bound. The resin bonds the plurality of fibers by melting when passing through the sheet forming section 80 to be described later. In addition, the mechanism for mixing the first sorted material and the binder resin powder with each other is not particularly limited.

The binder resin powder supplied from the powder supply device 51 is a thermoplastic resin or a thermosetting resin, and examples thereof include AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, polyether ether ketone, and the like. These resins may be used alone or as an appropriate mixture thereof.

In addition, as the binder resin powder supplied from the powder supply device 51, in addition to the resin for binding the fibers, in accordance with the type of the sheet to be manufactured, a coloring agent for coloring the fibers, a coagulation preventing agent for preventing coagulation of fibers, a flame retardant for making fibers and the like unlikely to burn, and the like, may be included. The mixture of the first sorted material and the binder resin powder that has passed through the mixing section 50 is transferred to the depositing section 60 via the pipe 54.

The depositing section 60 introduces the mixture that has passed through the mixing section 50 from the introduction port 61 into the depositing apparatus section 62, disentangles the intertwined fibers of the defibrated material, and descends while dispersing in the air. Furthermore, in a case where the resin of the binder resin powder supplied from the powder supply device 51 is fibrous, the depositing apparatus section 62 disentangles the intertwined resin fibers. Accordingly, the depositing section 60 can deposit the mixture uniformly on the second web forming section 70.

As the depositing apparatus section 62, a cylindrical sieve having a rotating mesh is used, and allows fibers or particles smaller than the opening of the sieve of the mesh which are contained in the mixture that has passes through the mixing section 50, that is, fibers or particles that can pass through the mesh, pass therethrough. The configuration of the depositing section 60 is, for example, the same as the configuration of the sorting section 30.

In addition, the "sieve" of the depositing apparatus section 62 may not have a function of sorting a specific target. In other words, the "sieve" used as the depositing apparatus section 62 means that the mesh is provided, and may allow all of the mixtures introduced into the depositing apparatus section 62 pass therethrough.

The second web forming section 70 deposits the passing material that has passed through the depositing section 60 and forms the web W. The second web forming section 70 includes, for example, the mesh belt 71, the stretching roller 72, and the suction section (suction mechanism) 73.

While moving, the mesh belt 71 deposits the passing material that has passed through the opening (opening of the mesh) of the depositing section 60. The mesh belt 71 is configured to be stretched by the stretching roller 72, and to make the air pass therethrough while the passing material is unlikely to pass therethrough. The mesh belt 71 continuously moves as the stretching roller 72 rotates. As the passing material that has passed through the depositing section 60 descends and is accumulated on the continuously moving mesh belt 71, the web W is formed on the mesh belt 71.

The suction section 73 is provided below the mesh belt 71 (on a side opposite to the depositing section 60 side). The suction section 73 can generate a downwardly directed airflow (airflow from the depositing section 60 to the mesh belt 71). Accordingly, it is possible to increase a discharge speed of the passing material from the depositing section 60.

As described above, by passing through the depositing section 60 and the second web forming section 70 (web forming step), the web W is formed in a state of containing a large amount of air and being softly bulged. The web W deposited on the mesh belt 71 is transported to the sheet forming section 80. In addition, in the illustrated example, the humidity control section 74 which controls humidity of the web W is provided. In the humidity control section 74, water or water vapor can be added to the web W and the amount ratio between the web W and water can be adjusted.

The sheet forming section 80 pressurizes and heats the web w deposited on the mesh belt 71 and forms the sheet S. In the sheet forming section 80, a plurality of fibers in the mixture can be bound to each other via the binder resin powder by applying heat to the mixture of the defibrated material and the binder resin powder mixed in the web W.

The sheet forming section 80 includes the pressurizing section 81 for pressurizing the web W and the heating section 82 for heating the web W pressurized by the pressurizing section 81. The pressurizing section 81 is configured with the pair of calendar rollers 81*a* and 81*b* and applies pressure to the web W. The thickness of the web W is reduced by being pressurized, and the density of the web W is increased. The heating section 82 includes the pair of heating rollers 82*a* and 82*b*. The sheet S is formed by heating the web W pressurized by the calendar rollers 81*a* and 81*b* with the heating rollers 82*a* and 82*b* and binding the fibers by melting the resin. Here, the pressure applied to the web W by the calendar rollers 81*a* and 81*b* of the pressurizing section 81 can be set higher than the pressure applied to the web W by the heating rollers 82*a* and 82*b* of the heating section 82. In addition, the number of the calendar rollers 81*a* and 81*b* or the heating rollers 82*a* and 82*b* is not particularly limited.

The cutting section 90 cuts the sheet S formed by the sheet forming section 80. In the illustrated example, the cutting section 90 includes the first cutting section 91 for cutting the sheet S in a direction intersecting the transport direction of the sheet S, and the second cutting section 92 for cutting the sheet S in a direction parallel to the transport direction, for example, a roller cutter. For example, the second cutting section 92 cuts the sheet S that has passed through the first cutting section 91. By passing through the cutting section 90, the printing recycled paper sheet Pr1 or the recycled paper sheet Pr2 of a cut form having a predetermined size cut from the sheet S is formed. The cut printing recycled paper sheet Pr1 of the cut form or the recycled paper sheet Pr2 is discharged to the recycled paper sheet discharge section (second recycled paper sheet storage section) 100*b* illustrated in FIG. 12 and is transported to the recycled paper sheet supply section 200. In addition, the method of recycling the paper sheet is not limited to the above-described method, a method of physically removing the recording medium called a toner that adheres to the surface of the recording target medium may be adopted.

Regarding the printing recycled paper sheet Pr1 or the recycled paper sheet Pr2 formed by the above-described paper sheet recycling section 100, the printing recycled paper sheet Pr1 is supplied to and stored in any of the recycled paper sheet storage sections (first recycled paper sheet storage sections) 321, 322, 323, and 324 by the recycled paper sheet supply section 200 as described in FIG. 12, and the recycled paper sheet Pr2 is supplied to and stored in the recycled paper sheet discharge section (second recycled paper sheet storage section) 600. In addition, when the printing section 500 selects the printing recycled paper sheet Pr1 as the recording target medium, the printing recycled paper sheet Pr1 is taken out by the transport section 400 from any of the recycled paper sheet storage sections (first recycled paper sheet storage sections) 321, 322, 323, and 324, and a predetermined quantity of the printing recycled paper sheets Pr1 is transported to the printing section 500.

In this manner, from the plurality of recycled paper sheet storage sections (first recycled paper sheet storage sections) 321, 322, 323, and 324, one recycled paper sheet storage section (first recycled paper sheet storage section) to which the printing recycled paper sheet Pr1 is supplied by the recycled paper sheet supply section 200, and one recycled paper sheet storage section (first recycled paper sheet storage section) from which the recycled paper sheet Pr is taken out by the transport section 400, are selected.

In addition, in the following description, one recycled paper sheet storage section (first recycled paper sheet storage section) selected from the plurality of recycled paper sheet storage sections (first recycled paper sheet storage sections) 321, 322, 323, and 324 from which the printing recycled paper sheet Pr1 is taken out by the transport section 400, is set as a predetermined recycled paper sheet storage section (predetermined first recycled paper sheet storage section) 32A. Meanwhile, one recycled paper sheet storage section (first recycled paper sheet storage section) selected from the plurality of recycled paper sheet storage sections (first recycled paper sheet storage sections) 321, 322, 323, and 324 to which the printing recycled paper sheet Pr1 is supplied by the recycled paper sheet supply section 200, is set as another recycled paper sheet storage section (another first recycled paper sheet storage section) 32B.

Figure 14:
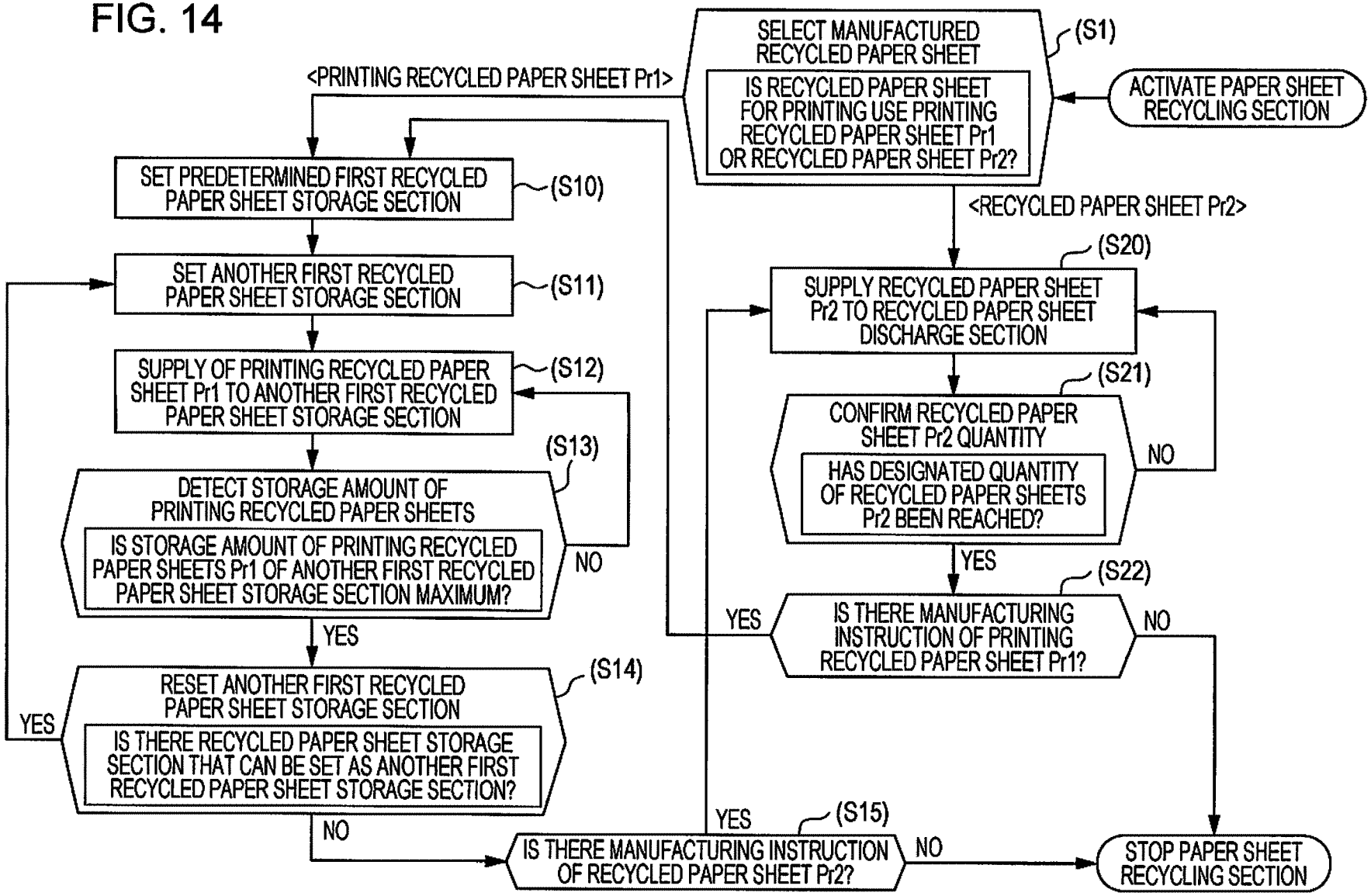
FIG. 14 is a flowchart illustrating a flow in which the recycled paper sheet is supplied from the paper sheet recycling section to a storage section in the paper sheet recycling and printing apparatus according to the sixth embodiment.

FIG. 14 is a flowchart illustrating a flow for supplying the printing recycled paper sheet Pr1 formed in the paper sheet recycling section 100 to the recycled paper sheet storage unit 320 provided in the storage section 300 or the recycled paper sheet Pr2 to the recycled paper sheet discharge section (second recycled paper sheet storage section) 600.

(Manufactured Recycled Paper Sheet Selection)

When the operation of the paper sheet recycling section 100 is started, firstly, the manufactured recycled paper sheet selection (S1) is executed. The manufactured recycled paper sheet selection (S1) is a step for selecting whether the recycled paper sheet formed by the paper sheet recycling section 100 is the printing recycled paper sheet Pr1 to be supplied for the printing or the recycled paper sheet Pr2 that is not to be supplied for the printing. When the manufacturing of the printing recycled paper sheet Pr1 is selected in the manufactured recycled paper sheet selection (S1), the process shifts to setting (S10) of the recycled paper sheet storage section (first recycled paper sheet storage section) which is the next step.

(Setting of Predetermined First Recycled Paper Sheet Storage Section)

When the manufacturing of the printing recycled paper sheet Pr1 is selected in the manufactured recycled paper sheet selection (S1), the setting (S10) of the predetermined recycled paper sheet storage section (predetermined first recycled paper sheet storage section) is executed. As described above, the predetermined recycled paper sheet storage section (predetermined first recycled paper sheet storage section) 32A indicates one recycled paper sheet storage section (first recycled paper sheet storage section) which is selected from the plurality of recycled paper sheet storage sections (first recycled paper sheet storage sections) 321, 322, 323, and 324 and from which the printing recycled paper sheet Pr1 is taken out by the transport section 400. In other words, among the recycled paper sheet storage sections (first recycled paper sheet storage sections) 321, 322, 323, and 324, one recycled paper sheet storage section (first recycled paper sheet storage section) in which the printing recycled paper sheet Pr1 can be transported to the printing section 500 is set as the predetermined recycled paper sheet storage section (predetermined first recycled paper sheet storage section) 32A. In addition, when the operation of the paper sheet recycling section 100 is started, when the predetermined recycled paper sheet storage section (predetermined first recycled paper sheet storage section) 32A has already been set, it is not necessary to reset the paper sheet storage section.

In the paper sheet recycling and printing apparatus 1000 according to the present embodiment illustrated in FIG. 12, an aspect in which the printing recycled paper sheet Pr1 transported from the recycled paper sheet storage section (first recycled paper sheet storage section) 322 provided in the recycled paper sheet storage unit 320 to the printing section 500 is taken out is exemplified. In this example, the apparatus control section (not illustrated) recognizes that the recycled paper sheet storage section (first recycled paper sheet storage section) 322 is a predetermined recycled paper sheet storage section (predetermined first recycled paper sheet storage section) 32A, and the paper sheet acquiring means 410 is driven by the transport switching means at the position of the recycled paper sheet storage section (first recycled paper sheet storage section) 322.

(Setting of Another First Recycled Paper Sheet Storage Section)

Next, the setting (S11) of another recycled paper sheet storage section (another first recycled paper sheet storage section) in which, among the recycled paper sheet storage sections (first recycled paper sheet storage sections) 321, 323, and 324 except for the predetermined recycled paper sheet storage section (predetermined first recycled paper sheet storage section) 32A (322), one recycled paper sheet storage section (first recycled paper sheet storage section) in which the printing recycled paper sheet Pr1 supplied from the recycled paper sheet recycling section 100 and transported by the recycled paper sheet supply section 200 is stored is set as another recycled paper sheet storage section (another first recycled paper sheet storage section) 32B, is executed.

Among the recycled paper sheet storage sections (first recycled paper sheet storage sections) 321, 323, and 324 except for the predetermined recycled paper sheet storage section (predetermined first recycled paper sheet storage section) 32A (322), the recycled paper sheet storage section (first recycled paper sheet storage section) in which the printing recycled paper sheet Pr1 is not stored is selected as another recycled paper sheet storage section (another recycled paper sheet storage section) 32B. In the present embodiment, the recycled paper sheet storage section (first recycled paper sheet storage section) 321 is set as another recycled paper sheet storage section (another first recycled paper sheet storage section) 32B and the printing recycled paper sheet Pr1 is supplied.

In addition, when setting another recycled paper sheet storage section (another first recycled paper sheet storage section) 32B, it is not necessary to select the recycled paper sheet storage section (first recycled paper sheet storage section) in which there is no printing recycled paper sheet Pr1. For example, in a case where the recycled paper sheet storage section (first recycled paper sheet storage section) which has already reached the maximum storage amount of the printing recycled paper sheets Pr1 has been excluded from options, and further, there is no recycled paper sheet storage section (first recycled paper sheet storage section) which is empty without the printing recycled paper sheet Pr1, even when the printing recycled paper sheet Pr1 is stored, it is possible to select another recycled paper sheet storage section among the recycled paper sheet storage sections (first recycled paper sheet storage sections) having a region in which the new printing recycled paper sheet Pr1 can be stored. In the paper sheet recycling and printing apparatus 1000 illustrated in the present embodiment, in order to supply the printing recycled paper sheet Pr1 to the recycled paper sheet storage section (first recycled paper sheet storage section) 321 as illustrated in FIG. 12, the apparatus control section (not illustrated) recognizes that the recycled paper sheet storage section (first recycled paper sheet storage section) 321 is another recycled paper sheet storage section (another first recycled paper sheet storage section) 32B, and the first recycled paper sheet storage means (recycled paper sheet storage and supply means) 221 is driven by the storage section switching means at the position of the recycled paper sheet storage section (first recycled paper sheet storage section) 321.

(Recycled Paper Sheet Supply)

When another recycled paper sheet storage section (another first recycled paper sheet storage section) is set (S11), the supply (S12) of the printing recycled paper sheet from the first recycled paper sheet supply means (recycled paper sheet storage and supply means) 221 of the recycled paper sheet supply section 200 to the set another recycled paper sheet storage section (another first recycled paper sheet storage section) 32B, is executed.

(Printing Recycled Paper Sheet Storage Amount Detection)

When the printing recycled paper sheet Pr1 is supplied to another recycled paper sheet storage section (another first recycled paper sheet storage section) 32B, the recycled paper sheet storage among detection (S13) in another recycled paper sheet storage section (another first recycled paper sheet storage section) 32B is performed. In the printing recycled paper sheet storage amount detection (S13), in a case where the maximum storage amount is not satisfied, that is, NO, the printing recycled paper sheet supply (S12) is performed again. However, in a case where the maximum storage amount has been reached, that is, YES, the process shifts to the next resetting (S14) of another recycled paper sheet storage section (another first recycled paper sheet storage section).

(Resetting of Another First Recycled Paper Sheet Storage Section)

When the recycled paper sheet storage section (first recycled paper sheet storage section) 321 illustrated in FIG. 12 in the present embodiment, which was set as another recycled paper sheet storage section (another first recycled paper sheet storage section) 32B, has reached the maximum storage amount of the printing recycled paper sheets Pr1, the resetting (S14) of another recycled paper sheet storage section (another first recycled paper sheet storage section) is performed. In other words, in the present embodiment, it is determined whether or not it is possible to set one recycled paper sheet storage section (first recycled paper sheet storage section) from the recycled paper sheet storage sections (first recycled paper sheet storage sections) 323 and 324 except for the recycled paper sheet storage section (first recycled paper sheet storage section) 322 set as the predetermined recycled paper sheet storage section (predetermined first recycled paper sheet storage section) 32A from which the printing recycled paper sheet Pr1 transported to the above-described printing section 500 is taken out, and the recycled paper sheet storage section (first recycled paper sheet storage section) 321 that has reached the maximum storage amount of the printing recycled paper sheets Pr1 as another recycled paper sheet storage section (another first recycled paper sheet storage section) 32B, as another recycled paper sheet storage section (another first recycled paper sheet storage section) 32B.

In a case where both or any one of the recycled paper sheet storage sections (first recycled paper sheet storage sections) 323 and 324 have the region in which the printing recycled paper sheet Pr1 can be stored (YES), the process shifts to the setting (S11) of another recycled paper sheet storage section (another first recycled paper sheet storage section), and the printing recycled paper sheet Pr1 is stored in the newly set another recycled paper sheet storage section (another first recycled paper sheet storage section) 32B. However, in a case where there is no region in which the printing recycled paper sheet Pr1 can be stored, that is, in a case where the maximum storage amount has been reached (NO), in any of the recycled paper sheet storage sections (first recycled paper sheet storage sections) 323 and 324, it is confirmed (S15) whether or not the paper sheet recycling and printing apparatus 1000 receives a manufacturing instruction of the recycled paper sheet Pr2 that is not to be supplied for the printing, and when the manufacturing instruction of the recycled paper sheet Pr2 is not received (NO), the paper sheet recycling section 100 is stopped, and the supply of the printing recycled paper sheet Pr1 is paused.

Meanwhile, in a case where the paper sheet recycling and printing apparatus 1000 receives the manufacturing instruction of the recycled paper sheet Pr2 (YES), the process shifts to the supply (S20) of the recycled paper sheet Pr2 that is to be described later and not to be supplied for the printing to the recycled paper sheet discharge.

In addition, in a case where the process shifts to the step of confirmation (S15) of the manufacturing instruction of the recycled paper sheet Pr2 before stopping the paper sheet recycling section 100, not only the paper sheet recycling section 100 is stopped by the above-described flow, but also the paper sheet recycling section 100 is stopped in the following case. For example, in a case where the planned forming quantity of the printing recycled paper sheet Pr1 with respect to the paper sheet recycling section 100 is input into the control section in advance and the planned forming quantity has been reached, the process shifts to the step (815) of the manufacturing instruction of the recycled paper sheet Pr2 before stopping the paper sheet recycling section 100, and shifts to the stop of the paper sheet recycling section 100. Otherwise, in a case where all of the waste paper sheets Pu that serve as the raw material supplied to the waste paper sheet supply section 100*a* is consumed, the process shifts to the step of confirming (S15) the manufacturing instruction of the recycled paper sheet Pr2 before stopping the paper sheet recycling section 100, and the paper sheet recycling section 100 is stopped or paused while the waste paper sheet Pu is supplied again.

As described above, since any of the plurality of recycled paper sheet storage sections (first recycled paper sheet storage sections) 321, 322, 323, and 324 provided in the recycled paper sheet storage unit 320 is set as another recycled paper sheet storage section (another first recycled paper sheet storage section) 32B to which the printing recycled paper sheet Pr1 is supplied, even when the paper sheet recycling section 100 is continuously operated, the printing recycled paper sheet Pr1 formed by the paper sheet recycling section 100 is supplied to any of the recycled paper sheet storage sections (first recycled paper sheet storage sections) 321, 322, 323, and 324, and can be stored therein.

In other words, in the paper sheet recycling section 100 provided in the paper sheet recycling and printing apparatus 1000 according to the present embodiment described with reference to FIG. 13, in order to obtain the printing recycled paper sheet Pr1 having more stable quality, the plurality of recycled paper sheet storage sections (first recycled paper sheet storage sections) 321, 322, 323, and 324 are provided in the recycled paper sheet storage unit 320, and the continuous operation for a long period of time by the paper sheet recycling section 100 is possible.

In addition, from the plurality of recycled paper sheet storage sections (first recycled paper sheet storage sections) 321, 322, 323, and 324, from the recycled paper sheet storage section (first recycled paper sheet storage section) except for the recycled paper sheet storage section (first recycled paper sheet storage section) (first recycled paper sheet storage section 322 of FIG. 12 in the example of the present embodiment) set as the predetermined recycled paper sheet storage section (predetermined first recycled paper sheet storage section) 32A, another recycled paper sheet storage section (another first recycled paper sheet storage section) 32B (first recycled paper sheet storage section 321 of FIG. 12 in the example of the present embodiment) is set as the recycled paper sheet storage section (first recycled paper sheet storage section) to which the printing recycled paper sheet Pr1 is supplied and in which the printing recycled paper sheet Pr1 is stored, and accordingly, it is possible to prevent a case where the taking-out of the printing recycled paper sheet Pr1 transported to the printing section 500 and the supply of the printing recycled paper sheet Pr1 from the paper sheet recycling section 100 overlap each other, that is, a so-called paper sheet complication, and to prevent occurrence of jamming.

In the manufactured recycled paper sheet selection (S1) illustrated in FIG. 14, when the supply of the recycled paper sheet Pr2 that is not to be supplied for the printing is selected, the recycled paper sheet Pr2 is manufactured and the supply (S20) to the recycled paper sheet discharge section (second recycled paper sheet storage section) 600 is executed.

(Recycled Paper Sheet Pr2 Quantity Confirmation)

By the supply of the recycled paper sheet Pr2 to the recycled paper sheet discharge section (second recycled paper sheet storage section) 600 (S20), the recycled paper sheet Pr2 is supplied to and stored in the recycled paper sheet discharge section (second recycled paper sheet storage section) 600. Then, the recycled paper sheet Pr2 quantity confirmation (S21) for confirming whether or not the manufacturing quantity of the recycled paper sheets Pr2 instructed to the paper sheet recycling and printing apparatus 1000 has already been reached, is executed.

In the recycled paper sheet Pr2 quantity confirmation (S21), in a case where the designated quantity has not been reached (NO), the supply (S20) of the recycled paper sheet Pr2 to recycled paper sheet discharge section (second recycled paper sheet storage section) 600, is executed. However, in the recycled paper sheet Pr2 quantity confirmation (S21), in a case where the designated quantity has been reached (YES), it is confirmed whether or not the paper sheet recycling and printing apparatus 1000 has received the manufacturing instruction of the printing recycled paper sheet Pr1 to be supplied for the printing (S22), and when the manufacturing instruction of the printing recycled paper sheet Pr1 is not received (NO), the paper sheet recycling section 100 is stopped and the supply of the recycled paper sheet Pr2 is paused. Meanwhile, in a case where the paper sheet recycling and printing apparatus 1000 receives the manufacturing instruction of the printing recycled paper sheet Pr1 (YES), the process shifts to the setting (S10) of the predetermined recycled paper sheet storage section (predetermined first recycled paper sheet storage section) in the supply flow of the printing recycled paper sheet Pr1, and the supply flow of the above-described printing recycled paper sheet Pr1 is executed.

The recycled paper sheet formed in the paper sheet recycling section 100 provided in the paper sheet recycling and printing apparatus 1000 according to the present embodiment includes the printing recycled paper sheet Pr1 to be supplied for the printing and the recycled paper sheet Pr2 that is not to be supplied for the printing according to the use. In addition, the printing recycled paper sheet Pr1 is supplied to any of the recycled paper sheet storage sections (first recycled paper sheet storage sections) 321, 322, 323, and 324 provided in the recycled paper sheet storage section 320 by the recycled paper sheet supply section 200 and is stored therein, and the recycled paper sheet Pr2 is supplied to and stored in the recycled paper sheet discharge section (second recycled paper sheet storage section) 600.

Figure 15:
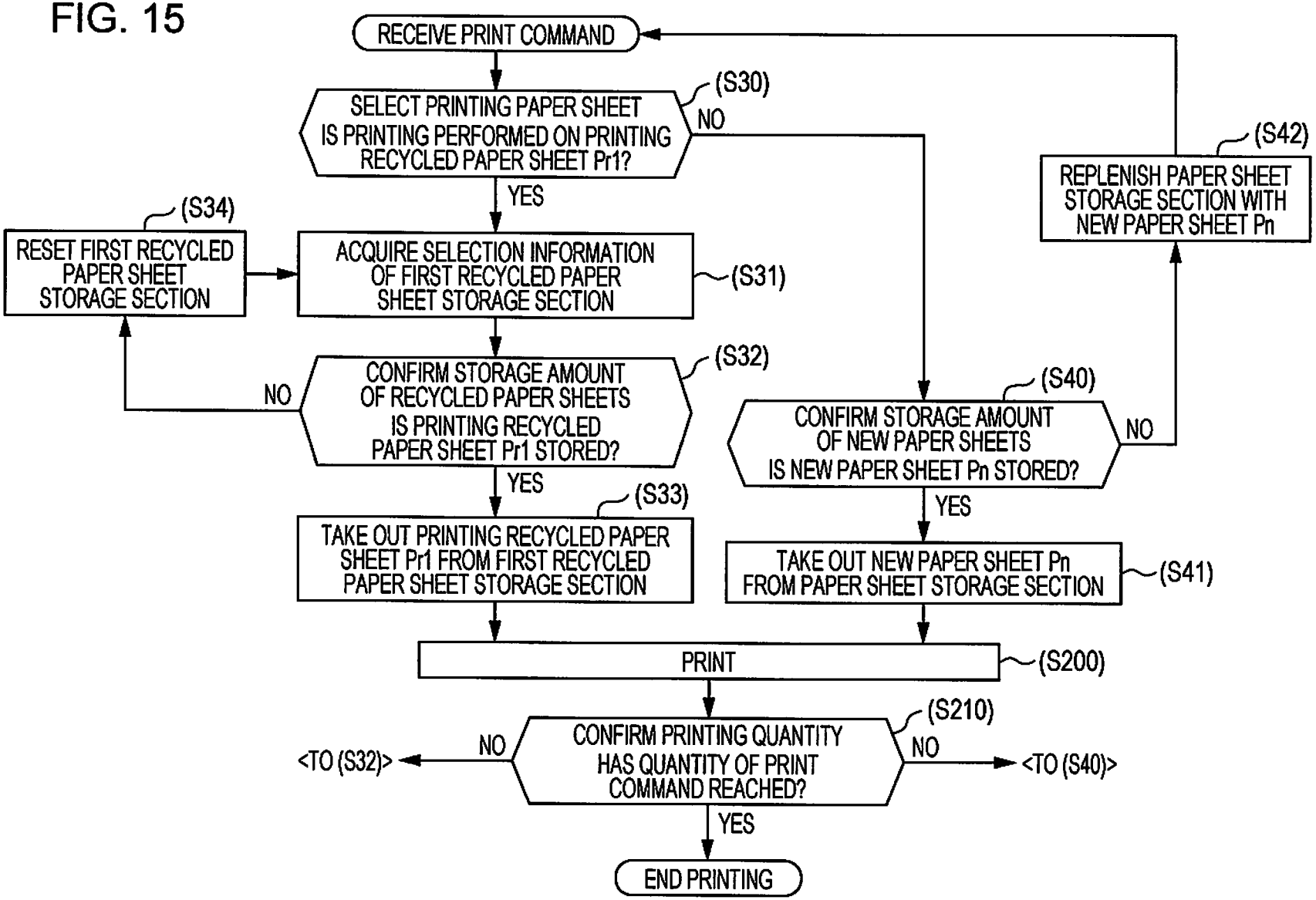
FIG. 15 is a flowchart illustrating a flow in which a recording target medium is supplied from the paper sheet storage section to a printing section in the paper sheet recycling and printing apparatus according to the sixth embodiment.

Next, a flowchart of FIG. 15 illustrates a flow of transporting and supplying the new paper sheet Pn or the printing recycled paper sheet Pr1 stored in the storage section 300 to the printing section 500 and forming the printed material Pp.

(Printing Paper Sheet Selection)

As illustrated in FIG. 15, as the control section provided in the paper sheet recycling and printing apparatus 1000 receives the print command for starting the printing, the printing is started. First, the printing paper sheet selection (S30) to be printed is executed. In other words, the paper sheet recycling and printing apparatus 1000 according to the present embodiment is an apparatus that supplies the printing recycled paper sheet Pr1 recycled in the paper sheet recycling section 100 provided in the paper sheet recycling and printing apparatus 1000 together with the new paper sheet Pn as the recording target medium of the printing section 500 provided in the paper sheet recycling and printing apparatus 1000 and obtains the printed material Pp. Therefore, in the printing paper sheet selection (S30), it is determined and selected whether the printing paper sheet designated by the print command is the printing recycled paper sheet Pr1 or the new paper sheet Pn.

(Selection Information Acquisition of First Recycled Paper Sheet Storage Section)

When the printing recycled paper sheet Pr1 is selected (YES) in the printing paper sheet selection (S30), the selection information acquisition (S31) of the predetermined recycled paper sheet storage section (predetermined first recycled paper sheet storage section) 32A is executed, and the information on which one of the recycled paper sheet storage sections (first recycled paper sheet storage sections) 321, 322, 323, and 324 is set as the predetermined recycled paper sheet storage section (predetermined first recycled paper sheet storage section) 32A is acquired.

The predetermined recycled paper sheet storage section (predetermined first recycled paper sheet storage section) 32A described with reference to FIG. 14 indicates one recycled paper sheet storage section (first recycled paper sheet storage section) which is selected from the plurality of recycled paper sheet storage sections (first recycled paper sheet storage sections) 321, 322, 323, and 324 and from which the printing recycled paper sheet Pr1 is taken out by the transport section 400, in the recycled paper sheet storage unit 320. In other words, among the recycled paper sheet storage sections (first recycled paper sheet storage sections) 321, 322, 323, and 324, one recycled paper sheet storage section (first recycled paper sheet storage section) in which the printing recycled paper sheet Pr1 can be transported to the printing section 500 is set as the predetermined recycled paper sheet storage section (predetermined first recycled paper sheet storage section) 32A. In addition, in the paper sheet recycling and printing apparatus 1000 according to the present embodiment, an example in which the recycled paper sheet storage section (first recycled paper sheet storage section) 322 is set as the predetermined recycled paper sheet storage section (predetermined first recycled paper sheet storage section) 32A (refer to FIG. 12).

(Recycled Paper Sheet Storage Amount Confirmation)

From the information acquired in the selection information acquisition (S31) of the predetermined recycled paper sheet storage section (predetermined first recycled paper sheet storage section), that is, the information indicating that the predetermined recycled paper sheet storage section (predetermined first recycled paper sheet storage section) 32A is the recycled paper sheet storage section (first recycled paper sheet storage section) 322, the recycled paper sheet storage amount confirmation (S32) for confirming the presence or absence of the printing recycled paper sheet Pr1 of the recycled paper sheet storage section (first recycled paper sheet storage section) 322 is performed. When it is confirmed that at least one printing recycled paper sheet Pr1 is stored (YES), the process shifts to the next recycled paper sheet taking-out.

(Recycled Paper Sheet Taking-Out)

The printing recycled paper sheet taking-out (S33) in which the printing recycled paper sheet Pr1 is taken out from the predetermined recycled paper sheet storage section (predetermined first recycled paper sheet storage section) 32A and is transported to the paper sheet taking-in section 500*a* of the printing section 500 by the transport section 400, is executed. In addition, the predetermined printing is executed (S200) by the printing section 500 with respect to the printing recycled paper sheet Pr1 transported to the paper sheet taking-in section 500*a*, and the printing recycled paper sheet Pr1 is discharged to the printed material discharge section 500*b* as the printed material Pp.

(Printing Quantity Confirmation)

When the printing is executed (S200), printing quantity confirmation (S210) for confirming whether or not the printing quantity commanded by the print command has been reached, is performed. Then, when it is confirmed that the predetermined quantity of the printed materials Pp is obtained, the printing is completed.

In the above-described recycled paper sheet storage amount confirmation (S32), in a case where it is confirmed that the printing recycled paper sheet Pr1 is not stored (NO) in the predetermined recycled paper sheet storage section (predetermined first recycled paper sheet storage section) 32A in which the printing recycled paper sheet Pr1 is confirmed in the selection information acquisition (S31) of the predetermined recycled paper sheet storage section (predetermined first recycled paper sheet storage section) in the previous step, the resetting (S34) of the predetermined recycled paper sheet storage section (predetermined first recycled paper sheet storage section) 32A is performed.

(Resetting of Predetermined First Recycled Paper Sheet Storage Section)

When it is confirmed that the printing recycled paper sheet Pr1 is not stored in the recycled paper sheet storage section (first recycled paper sheet storage section) 322 set in the predetermined recycled paper sheet storage section (predetermined first recycled paper sheet storage section) 32A, the resetting (S34) of the predetermined recycled paper sheet storage section (predetermined first recycled paper sheet storage section) is executed, and except for the recycled paper sheet storage section (first recycled paper sheet storage section) 321 set in the above-described another recycled paper sheet storage section (another first recycled paper sheet storage section) 32B, any of the recycled paper sheet storage sections (first recycled paper sheet storage sections) 323 and 324 provided in the recycled paper sheet storage unit 320 is set as the predetermined recycled paper sheet storage section (predetermined first recycled paper sheet storage section) 32A again.

In addition, as described with reference to the above-described FIG. 14, another recycled paper sheet storage section (another first recycled paper sheet storage section) 32B is referred to as one selected recycled paper sheet storage section (first recycled paper sheet storage section) in which the printing recycled paper sheet Pr1 supplied from the paper sheet recycling section 100 and transported by the recycled paper sheet supply section 200 is stored among the recycled paper sheet storage sections (first recycled paper sheet storage sections) 321, 323, and 324 except for the predetermined recycled paper sheet storage section (predetermined first recycled paper sheet storage section) 32A (first recycled paper sheet storage section 322).

Regarding which of the recycled paper sheet storage sections (first recycled paper sheet storage section) 323 and 324 is to be set as the predetermined recycled paper sheet storage section (predetermined first recycled paper sheet storage section) 32A, the invention is not particularly limited as long as the printing recycled paper sheet Pr1 is stored. For example, the recycled paper sheet storage section (first recycled paper sheet storage section) with a large storage amount of the printing recycled paper sheets Pr1 may be selected, or may be selected and instructed by the operator (person). In addition, although not illustrated, in a case where the printing recycled paper sheet Pr1 is not stored in all of the recycled paper sheet storage sections (first recycled paper sheet storage sections) 321, 322, 323, and 324, the operator (person) is warned by the warning means (not illustrated), and the printing is completed.

When the new predetermined recycled paper sheet storage section (predetermined first recycled paper sheet storage section) 32A is set by the resetting (S34) of the predetermined recycled paper sheet storage section (predetermined first recycled paper sheet storage section), the process shifts to the selection information acquisition (S31) of the first recycled paper sheet storage section (first recycled paper sheet storage section), and the steps after the recycled paper sheet storage amount confirmation (S32) are executed.

Meanwhile, in a case where the printing recycled paper sheet Pr1 is not selected (NO) in the printing paper sheet selection (S30), the paper sheet storage section 310 in which the new paper sheet Pn is stored is selected. When the paper sheet storage section 310 is selected, the new paper sheet storage amount confirmation (S40) for confirming the presence or absence of the stored new paper sheet Pn stored in the paper sheet storage section 310, is performed. When it is confirmed that the new paper sheet Pn is stored (YES) in the new paper sheet storage amount confirmation (S40), the taking-out (S41) of the new paper sheet Pn from the paper sheet storage section 310 is performed, and the new paper sheet Pn is supplied to the printing section 500. Then, the printing (S200) and the printing quantity confirmation (S210) are executed.

Meanwhile, in a case where the new paper sheet Pn is not stored in the paper sheet storage section 310 (NO), the operator (person) is warned by warning means (not illustrated) and the paper sheet storage section 310 is replenished with the new paper sheet Pn (S42). In addition, when the paper sheet recycling and printing apparatus 1000 receives the command, such as a print restart command, the printing is restarted.

In addition, in the printing quantity confirmation (S210), in a case where the printing quantity based on the printing command has not been reached (NO), the process shifts to the recycled paper sheet storage amount confirming (S32) step in the flow of selecting the printing recycled paper sheet Pr1 as the printing paper sheet, and then the steps up to the next printing (S200) are executed. Similarly, in the flow in which the new paper sheet Pn is selected as the printed paper sheet, the process shifts to the new paper sheet storage amount confirming (S40) step, and then the steps up to the printing (S200) are executed.

Above, in the paper sheet recycling and printing apparatus 1000 according to the described present embodiment, as the plurality of recycled paper sheet storage sections (first recycled paper sheet storage sections) 321, 322, 323, and 324 are provided in the recycled paper sheet storage unit 320 as illustrated in FIG. 12, even when there is no printing recycled paper sheet Pr1 from the predetermined recycled paper sheet storage section (predetermined first recycled paper sheet storage section) 32A from which the printing recycled paper sheet Pr1 transported to the printing section 500 is taken out, one of the recycled paper sheet storage sections (first recycled paper sheet storage sections) 321, 323, and 324 except for the predetermined recycled paper sheet storage section (predetermined first recycled paper sheet storage section) 32A (322) in the example of the setting of the present embodiment, is reset (step S34) as the predetermined recycled paper sheet storage section (predetermined first recycled paper sheet storage section) 32A again, and accordingly, it is possible to continue the printing without interruption.

Furthermore, when one of the recycled paper sheet storage sections (first recycled paper sheet storage sections) 321, 323, and 324 except for the predetermined recycled paper sheet storage section (predetermined first recycled paper sheet storage section) 32A, that is, the recycled paper sheet storage section (first recycled paper sheet storage section) 322 in the example of the setting of the present embodiment, is reset (step S34) as the predetermined recycled paper sheet storage section (predetermined first recycled paper sheet storage section) 32A again, any of the recycled paper sheet storage sections (first recycled paper sheet storage sections) 323 and 324 further except for another recycled paper sheet storage section (another first recycled paper sheet storage section) 32B to which the printing recycled paper sheet Pr1 formed in the paper sheet recycling section 100 is supplied and the recycled paper sheet storage section (first recycled paper sheet storage section) 321 in the example of the setting of the present embodiment, is reset as another recycled paper sheet storage section (first recycled paper sheet storage section) 32B. Therefore, when the printing recycled paper sheet Pr1 transported from the predetermined recycled paper sheet storage section (predetermined first recycled paper sheet storage section) 32A to the printing section 500 is taken out, there is no case where the supply of the printing recycled paper sheet Pr1 from the paper sheet recycling section 100 overlaps the taking-out. Therefore, it is possible to prevent occurrence of jamming at the time of paper feeding to the printing section 500.

Seventh Embodiment

Figure 16:
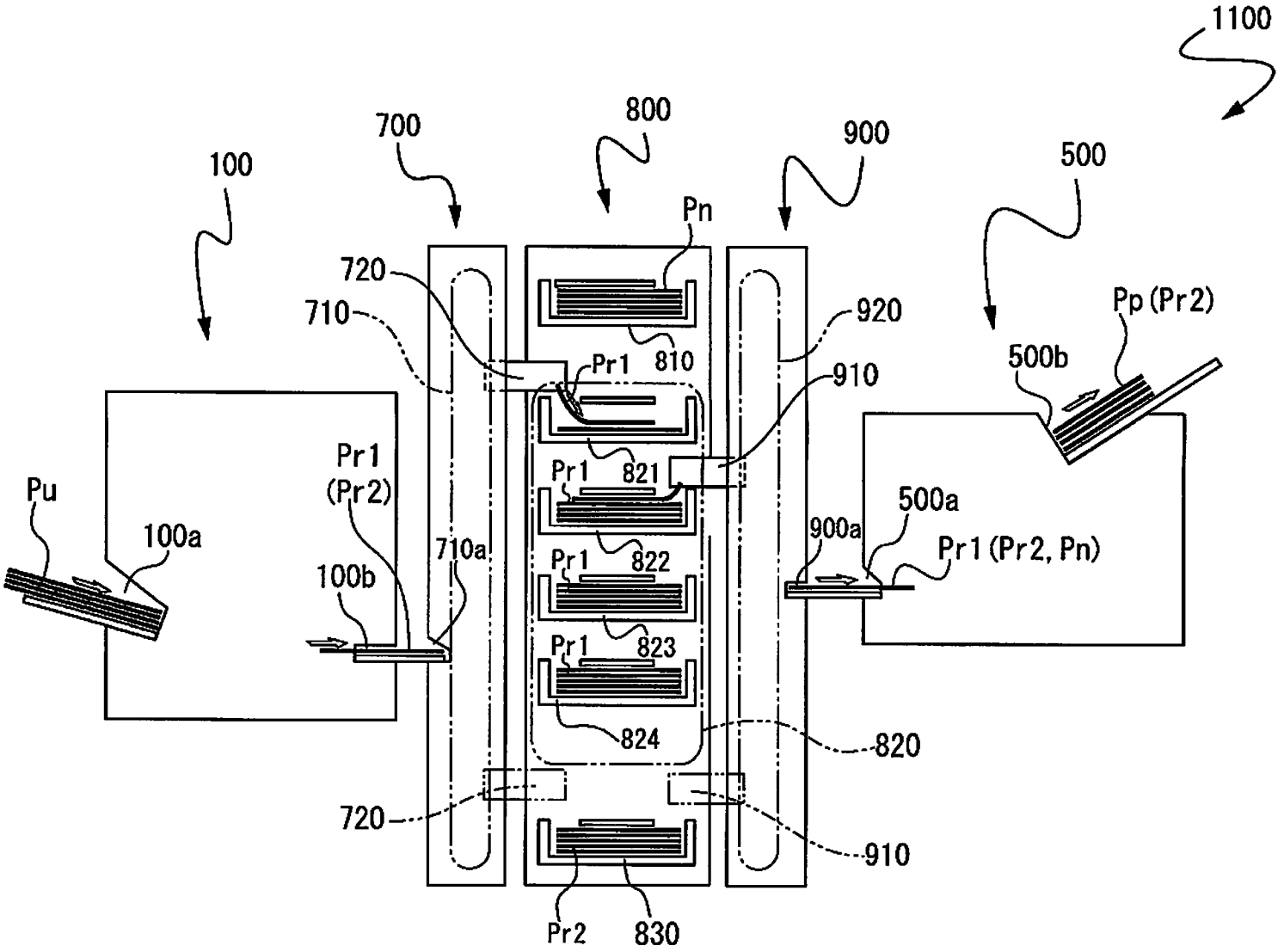
FIG. 16 is a configuration view illustrating a schematic configuration of a paper sheet recycling and printing apparatus according to a seventh embodiment.

FIG. 16 is a configuration view illustrating a schematic configuration of the paper sheet recycling and printing apparatus according to a seventh embodiment. The paper sheet recycling and printing apparatus 1100 illustrated in FIG. 16 is different from the paper sheet recycling and printing apparatus 1000 according to the sixth embodiment in the configuration of the recycled paper sheet supply section 200, the storage section 300, and the transport section 400, and other configuration elements are the same as those of the paper sheet recycling and printing apparatus 1000. Accordingly, in the description of the paper sheet recycling and printing apparatus 1100 according to the seventh embodiment, the same reference numerals will be given to the same configuration elements as those of the paper sheet recycling and printing apparatus 1000 according to the sixth embodiment, and the description thereof will be omitted.

As illustrated in FIG. 16, the storage section 800 includes the paper sheet storage section 810 in which the new paper sheet Pn is stored, the printing recycled paper sheet storage unit 820 in which the printing recycled paper sheet Pr1 is stored, and the recycled paper sheet storage section 830 that serves as the recycled paper sheet discharge section (second recycled paper sheet storage section) in which the recycled paper sheet Pr2 is stored. In this example, the recycled paper sheet storage section 820 includes a plurality of printing recycled paper sheet storage sections (first recycled paper sheet storage sections) 821, 822, 823, and 824 including the printing recycled paper sheet storage section (first recycled paper sheet storage section) 821 that serves as the recycled paper sheet storage section (first recycled paper sheet storage section) to which the printing recycled paper sheet Pr1 formed in the paper sheet recycling section 100 is supplied and in which the printing recycled paper sheet Pr1 is stored; the printing paper sheet storage section (first paper sheet storage section) 822 in which the printing recycled paper sheet Pr1 supplied to the printing section 500 is stored; and the printing recycled paper sheet storage sections (first recycled paper sheet storage sections) 823 and 824 which stand by in a state where the printing recycled paper sheet Pr1 is stored, as illustrated in the drawing.

In addition, in the paper sheet recycling and printing apparatus 1100 illustrated in FIG. 16, one paper sheet storage section 810 in which the new paper sheet Pn is stored, four printing recycled paper sheet storage sections (first recycled paper sheet storage sections) 821, 822, 823, and 824 in which the printing recycled paper sheet Pr1 is stored, and one recycled paper sheet storage section 830 in which the recycled paper sheet Pr2 is stored are exemplified, but the invention is not limited thereto. The plurality of paper sheet storage sections 810 in which the new paper sheet Pn is stored may be provided. The printing recycled paper sheet storage section (first recycled paper sheet storage section) in which the printing recycled paper sheet Pr1 is stored may include two printing recycled paper sheet storage sections including at least the printing recycled paper sheet storage section (first recycled paper sheet storage section) from which the recycled paper sheet is supplied to the printing section 500 and the printing recycled paper sheet storage section (first recycled paper sheet storage section) in which the printing recycled paper sheet Pr1 to be discharged from the paper sheet recycling section 100 is stored. The plurality of recycled paper sheet storage sections in which the printing recycled paper sheet Pr1 is stored may be provided.

The recycled paper sheet supply section 700 transports any of the printing recycled paper sheet Pr1 formed by the paper sheet recycling section 100 and the recycled paper sheet Pr2 that is not to be supplied for the printing to the storage section 800. Then, the transport section 900 can transport any of the new paper sheet Pn, the printing recycled paper sheet Pr1, or the recycled paper sheet Pr2 stored in the storage section 800 to the printing section 500.

The recycled paper sheet supply section 700 for transporting the printing recycled paper sheet Pr1 or the recycled paper sheet Pr2 formed in the paper sheet recycling section 100 to the storage section 800 includes the recycled paper sheet transport means 710 and the recycled paper sheet supply means 720 (not illustrated in detail). The waste paper sheet Pu is inserted into the paper sheet recycling section 100 from the waste paper sheet supply section 100*a* provided in the paper sheet recycling section 100, and the recycled printing recycled paper sheet Pr1 or recycled paper sheet Pr2 are delivered to the recycled paper sheet insertion port 710*a* provided in the recycled paper sheet supply section 700 from the recycled paper sheet discharge section (second recycled paper sheet storage section) 100*b*.

In a case where the printing recycled paper sheet Pr1 is inserted into the recycled paper sheet insertion port 710*a*, the recycled paper sheet transport means 710 is switched to transport the printing recycled paper sheet Pr1 to the recycled paper sheet supply means 720 by the driving section that serves as the supply section switching means (not illustrated). The recycled paper sheet supply means 720 moves such that the printing recycled paper sheet Pr1 can be supplied to any of the printing recycled paper sheet storage sections (first recycled paper sheet storage sections) 821, 822, 823, and 824 provided in the printing recycled paper sheet storage unit 820 provided in the storage section 800 by the driving means that serves as the storage section switching means (not illustrated), and stores the printing recycled paper sheet Pr1 therein. In the present embodiment, an aspect in which the printing recycled paper sheet Pr1 is stored in the printing recycled paper sheet storage section (first recycled paper sheet storage section) 821 is exemplified.

Between the storage section 800 and the printing section 500, the transport section 900 for transporting and supplying the new paper sheet Pn or the printing recycled paper sheet Pr1 that is stored in the storage section 800 and serves as the recording target medium or the recycled paper sheet Pr2 to the printing section 500, is provided.

The transport section 900 includes: paper sheet acquiring means 910 for picking up the desired paper sheet from the paper sheet storage section 810 in which the new paper sheet Pn is stored, the printing recycled paper sheet storage sections (first recycled paper sheet storage sections) 821, 822, 823, and 824 in which the printing recycled paper sheet Pr1 is stored, or the recycled paper sheet storage section 830 (second recycled paper sheet storage section) in which the recycled paper sheet Pr2 is stored; and the paper sheet transport means 920 (not illustrated in detail) for transporting the paper sheet picked up by the paper sheet acquiring means 910 to the paper sheet supply section 900*a*.

The paper sheet acquiring means 910 is driven by the driving means that serves as the transport switching means (not illustrated) at the position at which the paper sheet storage section 810 in which the new paper sheet Pn is stored, the printing recycled paper sheet storage sections (first recycled paper sheet storage sections) 821, 822, 823, and 824 in which the printing recycled paper sheet Pr1 is stored, or the recycled paper sheet storage section 830 (second recycled paper sheet storage section) in which the recycled paper sheet Pr2 is stored are disposed, by the paper sheet selection command from the printing section 500, and can pick up a desired paper sheet.

The printing recycled paper sheet Pr1 supplied from the paper sheet supply section 900*a* of the transport section 900 or the new paper sheet Pn is taken into the apparatus from the paper sheet taking-in section 500*a* of the printing section 500, and is discharged to the printed material discharge section 500*b* as the printed material Pp on which the desired recording information is printed. In addition, in a case where the recycled paper sheet Pr2 is taken into the printing section 500, the instruction of no printing information is sent from the apparatus control section and is discharged to the printed material discharge section 500*b* in a state without printing, that is, in a state of the recycled paper sheet Pr2. In other words, in the paper sheet recycling and printing apparatus 1100 according to the present embodiment, as the recycled paper sheet discharge section (second recycled paper sheet storage section) 600 provided in the paper sheet recycling and printing apparatus 1000 according to the sixth embodiment, the printed material discharge section 500*b* of the printing section 500 is disposed. In addition, the printing section 500 is not particularly limited as long as the printing section 500 is an apparatus that forms the printed material Pp by making toner or ink of the recording medium adhere to the surface of the recording target medium, such as a so-called laser printer or an ink jet printer.

Figure 17:
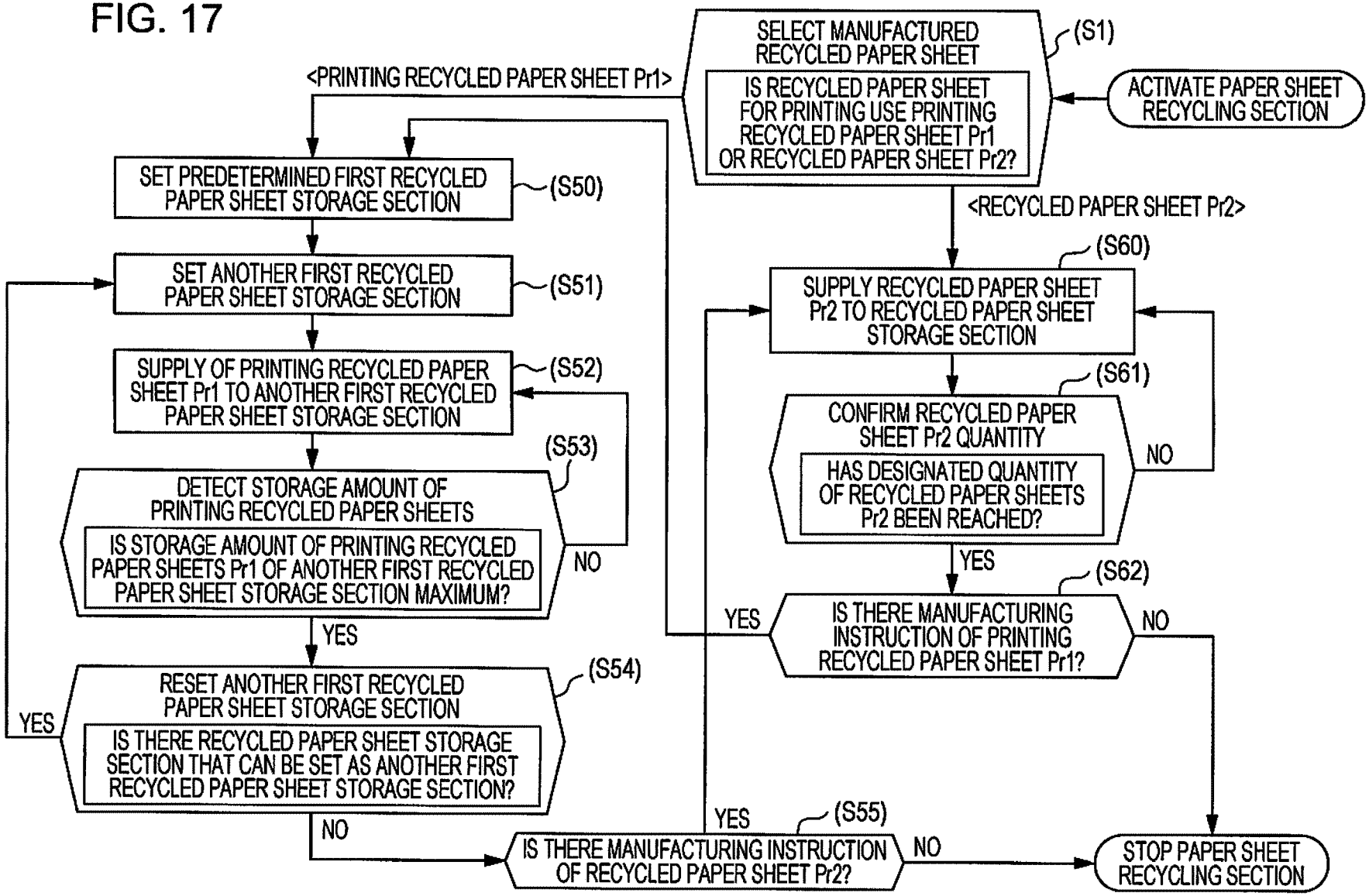
FIG. 17 is a flowchart illustrating a flow in which the recycled paper sheet is supplied from a paper sheet recycling section to a storage section in the paper sheet recycling and printing apparatus according to the seventh embodiment.

FIG. 17 is a flowchart illustrating a flow of supplying the printing recycled paper sheet Pr1 and the recycled paper sheet Pr2 formed in the paper sheet recycling section 100 provided in the paper sheet recycling and printing apparatus 1100 according to the seventh embodiment to the storage section 800.

In addition, in the following description, one printing recycled paper sheet storage section (first recycled paper sheet storage section) selected from the plurality of printing recycled paper sheet storage sections (first recycled paper sheet storage sections) 821, 822, 823, and 824 from which the printing recycled paper sheet Pr1 is taken out by the transport section 900, is set as the predetermined printing recycled paper sheet storage section (predetermined first recycled paper sheet storage section) 32A. Meanwhile, one printing recycled paper sheet storage section (first recycled paper sheet storage section) selected from the plurality of printing recycled paper sheet storage sections (first recycled paper sheet storage sections) 821, 822, 823, and 824 from which the printing recycled paper sheet Pr1 is supplied by the recycled paper sheet supply section 700, is set as another printing recycled paper sheet storage section (another first recycled paper sheet storage section) 32B.

(Manufactured Recycled Paper Sheet Selection)

When the operation of the paper sheet recycling section 100 is started, firstly, the manufactured recycled paper sheet selection (S1) is executed. The manufactured recycled paper sheet selection (S1) is a step for selecting whether the recycled paper sheet formed by the paper sheet recycling section 100 is the printing recycled paper sheet Pr1 to be supplied for the printing or the recycled paper sheet Pr2 that is not to be supplied for the printing. When the manufacturing of the printing recycled paper sheet Pr1 is selected in the manufactured recycled paper sheet selection (S1), the process shifts to setting (S50) of the predetermined recycled paper sheet storage section (predetermined first recycled paper sheet storage section) which is the next step.

(Setting of Predetermined First Recycled Paper Sheet Storage Section)

When the manufacturing of the printing recycled paper sheet Pr1 is selected in the manufactured recycled paper sheet selection (S1), the setting (S50) of the predetermined first recycled paper sheet storage section is executed. As described above, the predetermined recycled paper sheet storage section (predetermined first recycled paper sheet storage section) 32A indicates one printing recycled paper sheet storage section (first recycled paper sheet storage section) which is selected from the plurality of printing recycled paper sheet storage sections (first recycled paper sheet storage sections) 821, 822, 823, and 824 and from which the printing recycled paper sheet Pr1 is taken out by the transport section 900. In other words, among the printing recycled paper sheet storage sections (first recycled paper sheet storage sections) 821, 822, 823, and 824, one printing recycled paper sheet storage section (first recycled paper sheet storage section) in which the printing recycled paper sheet Pr1 can be transported to the printing section 500 is set as the predetermined recycled paper sheet storage section (predetermined first recycled paper sheet storage section) 32A. In addition, when the operation of the paper sheet recycling section 100 is started, when the predetermined recycled paper sheet storage section (predetermined first recycled paper sheet storage section) 32A has already been set, it is not necessary to reset the paper sheet storage section.

In the paper sheet recycling and printing apparatus 1100 according to the present embodiment illustrated in FIG. 16, an aspect in which the printing recycled paper sheet Pr1 transported from the printing recycled paper sheet storage section (first recycled paper sheet storage section) 822 provided in the printing recycled paper sheet storage unit 820 to the printing section 500 is taken out is exemplified. In this example, the apparatus control section (not illustrated) recognizes that the printing recycled paper sheet storage section (first recycled paper sheet storage section) 822 is a predetermined recycled paper sheet storage section (predetermined first recycled paper sheet storage section) 32A, and the paper sheet acquiring means 910 is driven by the transport switching means at the position of the printing recycled paper sheet storage section (first recycled paper sheet storage section) 822.

(Setting of Another First Recycled Paper Sheet Storage Section)

Next, the setting (S51) of another first recycled paper sheet storage section in which, among the printing recycled paper sheet storage sections (first recycled paper sheet storage sections) 821, 823, and 824 except for the predetermined recycled paper sheet storage section (predetermined first recycled paper sheet storage section) 32A (822), one printing recycled paper sheet storage section (first recycled paper sheet storage section) in which the printing recycled paper sheet Pr1 supplied from the recycled paper sheet recycling section 100 and transported by the recycled paper sheet supply section 700 is stored is set as another recycled paper sheet storage section (another first recycled paper sheet storage section) 32B, is executed.

Among the printing recycled paper sheet storage sections (first recycled paper sheet storage sections) 821, 823, and 824 except for the predetermined recycled paper sheet storage section (predetermined first recycled paper sheet storage section) 32A (822), the printing recycled paper sheet storage section (first recycled paper sheet storage section) in which the printing recycled paper sheet Pr1 is not stored is selected as another recycled paper sheet storage section (another first recycled paper sheet storage section) 32B. In the present embodiment, the printing recycled paper sheet storage section (first recycled paper sheet storage section) 821 is set as another recycled paper sheet storage section (another first recycled paper sheet storage section) 32B and the printing recycled paper sheet Pr1 is supplied.

In addition, when setting another recycled paper sheet storage section (another first recycled paper sheet storage section) 32B, it is not necessary to select the printing recycled paper sheet storage section (first recycled paper sheet storage section) in which there is no printing recycled paper sheet Pr1. For example, in a case where the printing recycled paper sheet storage section (first recycled paper sheet storage section) which has already reached the maximum storage amount of the printing recycled paper sheets Pr1 has been excluded from options, and further, there is no printing recycled paper sheet storage section (first recycled paper sheet storage section) which is empty without the printing recycled paper sheet Pr1, even when the printing recycled paper sheet Pr1 is stored, it is possible to select another recycled paper sheet storage section among the recycled paper sheet storage sections (first recycled paper sheet storage sections) having a region in which the new printing recycled paper sheet Pr1 can be stored. In the paper sheet recycling and printing apparatus 1100 illustrated in the present embodiment, in order to supply the printing recycled paper sheet Pr1 to the printing recycled paper sheet storage section (first recycled paper sheet storage section) 821 as illustrated in FIG. 16, the apparatus control section (not illustrated) recognizes that the printing recycled paper sheet storage section (first recycled paper sheet storage section) 821 is another recycled paper sheet storage section (another first recycled paper sheet storage section) 32B, and the recycled paper sheet supply means 720 is driven by the storage section switching means at the position of the printing recycled paper sheet storage section (first recycled paper sheet storage section) 821.

(Recycled Paper Sheet Supply)

When another recycled paper sheet storage section (another first recycled paper sheet storage section) is set (S51), the supply (S52) of the printing recycled paper sheet from the recycled paper sheet supply means 720 of the recycled paper sheet supply section 700 to the set another recycled paper sheet storage section (another first recycled paper sheet storage section) 32B, is executed.

(Printing Recycled Paper Sheet Storage Amount Detection)

When the printing recycled paper sheet Pr1 is supplied to another recycled paper sheet storage section (another first recycled paper sheet storage section) 32B, the printing recycled paper sheet storage among detection (S53) in another recycled paper sheet storage section (another first recycled paper sheet storage section) 32B is performed. In the printing recycled paper sheet storage amount detection (S53), in a case where the maximum storage amount is not satisfied, that is, NO, the printing recycled paper sheet supply (S52) is performed again. However, in a case where the maximum storage amount has been reached, that is, YES, the process shifts to the next resetting (S54) of another recycled paper sheet storage section (another first recycled paper sheet storage section).

(Resetting of Another First Recycled Paper Sheet Storage Section)

When the printing recycled paper sheet storage section (first recycled paper sheet storage section) 821 illustrated in FIG. 16 in the present embodiment, which was set as another recycled paper sheet storage section (another first recycled paper sheet storage section) 32B, has reached the maximum storage amount of the printing recycled paper sheets Pr1, the resetting of another recycled paper sheet storage section (another first recycled paper sheet storage section) is performed (S54). In other words, in the present embodiment, it is determined whether or not it is possible to set one recycled paper sheet storage section (first recycled paper sheet storage section) from the printing recycled paper sheet storage sections (first recycled paper sheet storage sections) 823 and 824 except for the printing recycled paper sheet storage section (first recycled paper sheet storage section) 822 set as the predetermined recycled paper sheet storage section (predetermined first recycled paper sheet storage section) 32A from which the printing recycled paper sheet Pr1 transported to the above-described printing section 500 is taken out, and the printing recycled paper sheet storage section (first recycled paper sheet storage section) 821 that has reached the maximum storage amount of the printing recycled paper sheets Pr1 as another recycled paper sheet storage section (another first recycled paper sheet storage section) 32B, as another recycled paper sheet storage section (another first recycled paper sheet storage section) 32B.

In a case where both or any one of the printing recycled paper sheet storage sections (first recycled paper sheet storage sections) 823 and 824 have the region in which the printing recycled paper sheet Pr1 can be stored (YES), the process shifts to the setting (S51) of another recycled paper sheet storage section (another first recycled paper sheet storage section), and the printing recycled paper sheet Pr1 is stored in the newly set another recycled paper sheet storage section (another first recycled paper sheet storage section) 32B. However, in a case where there is no region in which the printing recycled paper sheet Pr1 can be stored, that is, in a case where the maximum storage amount has been reached (NO), in any of the printing recycled paper sheet storage sections (first recycled paper sheet storage sections) 823 and 824, it is confirmed (S55) whether or not the paper sheet recycling and printing apparatus 1100 receives a manufacturing instruction of the recycled paper sheet Pr2 that is not to be supplied for the printing, and when the manufacturing instruction of the recycled paper sheet Pr2 is not received (NO), the paper sheet recycling section 100 is stopped, and the supply of the printing recycled paper sheet Pr1 is paused. Meanwhile, in a case where the paper sheet recycling and printing apparatus 1100 receives the manufacturing instruction of the recycled paper sheet Pr2 (YES), the process shifts to the supply (S60) of the recycled paper sheet Pr2 that is to be described later and not to be supplied for the printing to the recycled paper sheet storage section.

In addition, in a case where the process shifts to the step of confirmation (S55) of the manufacturing instruction of the recycled paper sheet Pr2 before stopping the paper sheet recycling section 100, not only the paper sheet recycling section 100 is stopped by the above-described flow, but also the paper sheet recycling section 100 is stopped in the following case. For example, in a case where the planned forming quantity of the printing recycled paper sheet Pr1 with respect to the paper sheet recycling section 100 is input into the control section in advance and the planned forming quantity has been reached, the process shifts to the step (S55) of the manufacturing instruction of the recycled paper sheet Pr2 before stopping the paper sheet recycling section 100, and shifts to the stop of the paper sheet recycling section 100. Otherwise, in a case where all of the waste paper sheets Pu that serve as the raw material supplied to the waste paper sheet supply section 100*a* are consumed, the process shifts to the step of confirming (S55) the manufacturing instruction of the recycled paper sheet Pr2 before stopping the paper sheet recycling section 100, and the paper sheet recycling section 100 is stopped or paused while the waste paper sheet Pu is supplied again.

As described above, since any of the plurality of printing recycled paper sheet storage sections (first recycled paper sheet storage sections) 821, 822, 823, and 824 provided in the printing recycled paper sheet storage unit 820 is set as another recycled paper sheet storage section (another first recycled paper sheet storage section) 32B to which the printing recycled paper sheet Pr1 is supplied, even when the paper sheet recycling section 100 is continuously operated, the printing recycled paper sheet Pr1 formed by the paper sheet recycling section 100 is supplied to any of the printing recycled paper sheet storage sections (first recycled paper sheet storage sections) 821, 822, 823, and 824, and can be stored therein.

In other words, in the paper sheet recycling section 100 which is illustrated in FIG. 13 and is provided in the paper sheet recycling and printing apparatus 1100 according to the present embodiment, in order to obtain the printing recycled paper sheet Pr1 having more stable quality, the plurality of printing recycled paper sheet storage sections (first recycled paper sheet storage sections) 821, 822, 823, and 824 are provided in the printing recycled paper sheet storage unit 820, and the continuous operation for a long period of time by the paper sheet recycling section 100 is possible.

In addition, from the plurality of printing recycled paper sheet storage sections (first recycled paper sheet storage sections) 821, 822, 823, and 824, from the printing recycled paper sheet storage section (first recycled paper sheet storage section) except for the printing recycled paper sheet storage section (first recycled paper sheet storage section) 822 set as the predetermined recycled paper sheet storage section (predetermined first recycled paper sheet storage section) 32A, another recycled paper sheet storage section (another first recycled paper sheet storage section) 32B (printing recycled paper sheet storage section (first recycled paper sheet storage section) 821 in the example of the present embodiment) is set as the printing recycled paper sheet storage section (first recycled paper sheet storage section) to which the printing recycled paper sheet Pr1 is supplied and in which the printing recycled paper sheet Pr1 is stored, and accordingly, it is possible to prevent a case where the taking-out of the printing recycled paper sheet Pr1 transported to the printing section 500 and the supply of the printing recycled paper sheet Pr1 from the paper sheet recycling section 100 overlap each other, that is, a so-called paper sheet complication, and to prevent occurrence of jamming.

Figure 18:
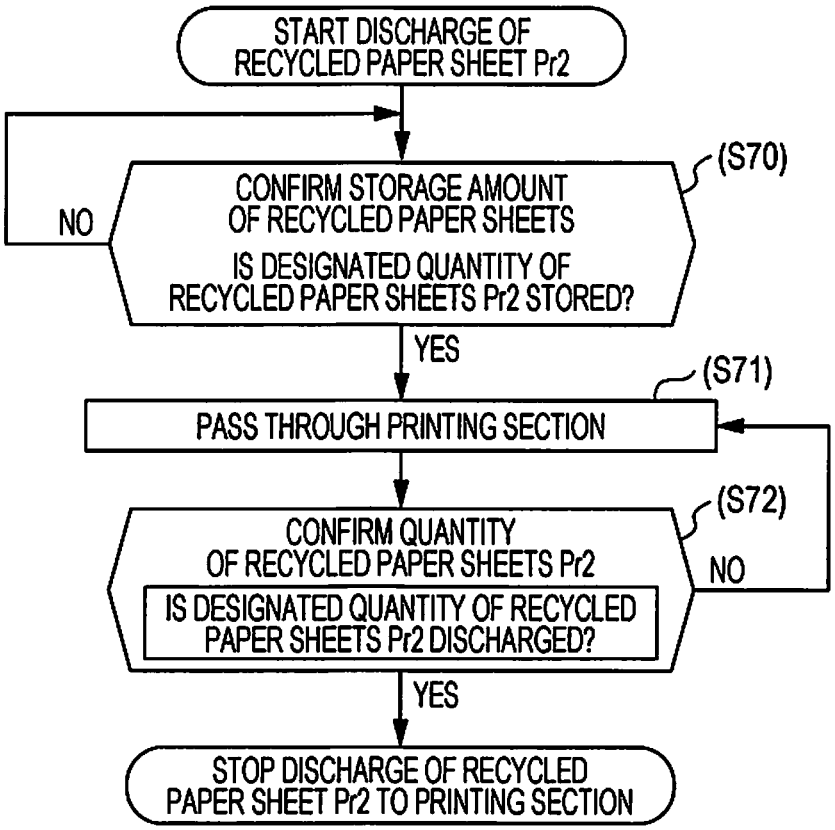
FIG. 18 is a flowchart illustrating a flow of discharge of the recycled paper sheet in the paper sheet recycling and printing apparatus according to the seventh embodiment.

Next, the flowchart of FIG. 18 illustrates a flow in which the recycled paper sheet Pr2 that is not to be supplied for the printing formed in the paper sheet recycling section 100 is discharged to the recycled paper sheet discharge section (second recycled paper sheet storage section) 600.

As illustrated in FIG. 18, the flow for transporting and supplying the recycled paper sheet Pr2 stored in the storage section 800 in the paper sheet recycling and printing apparatus 1100 according to the present embodiment to the printing section 500 and discharging the unprinted recycled paper sheet Pr2 is started first after the sheet recycled paper sheet Pr2 formed in the paper sheet recycling section 100 is supplied to the recycled paper sheet storage section 830 of the storage section 800.

(Recycled Paper Sheet Storage Amount Confirmation)

The recycled paper sheet storage amount confirmation (S70) in which it is confirmed whether or not the designated storage amount of the recycled paper sheets Pr2 to be discharged is stored in the recycled paper sheet storage section 830 of the storage section 800, is executed. Here, in a case where the recycled paper sheet Pr2 of the designated storage amount is stored in the recycled paper sheet storage section 830 (YES), the process shifts to the next printing section passage (S71).

(Printing Section Passage)

In the printing section passage (S71), the printing section 500 is passed, but the printing is not performed at this time. Then, the recycled paper sheet Pr2 that is not to be printed is discharged to the printed material discharge section 500*b*.

(Recycled Paper Sheet Pr2 Quantity Confirmation)

In addition, it is confirmed whether or not the designated quantity of the recycled paper sheets Pr2 is discharged to the printed material discharge section 500*b* in the printing section passage (S71) step by the recycled paper sheet Pr2 quantity confirmation (S72). In a case where, the designated quantity has not been reached (NO), the process shifts to the printing section passage (S71) and is repeated until the designated discharge quantity of the designated recycled paper sheets Pr2 is achieved. However, in a case where the designated quantity has been reached (YES), the discharge of the recycled paper sheet Pr2 to the printed material discharge section 500*b* is stopped.

In a case where the recycled paper sheet Pr2 is not stored in the recycled paper sheet storage section 830 (NO) in the above-described recycled paper sheet storage amount confirmation (S70), the recycled paper sheet Pr2 is supplied to the recycled paper sheet storage section 830 until reaching the designated quantity of the recycled paper sheets Pr2.

As described above, the paper sheet recycling and printing apparatus 1100 according to the present embodiment can discharge the recycled paper sheet Pr2 that is not to be supplied for the printing to the printed material discharge section 500*b* provided in the printing section 500. Accordingly, since there is no case where a dedicated discharge section of the recycled paper sheet Pr2 is provided, it is possible to further simplify the configuration of the paper sheet recycling and printing apparatus 1100, and to reduce the apparatus cost.

Figure 19:
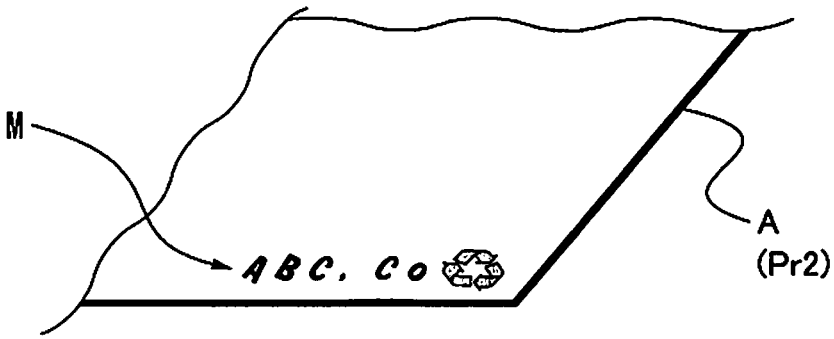
FIG. 19 is an external view of the recycled paper sheet illustrating an example of the printing logo mark.

Further, as illustrated in FIG. 19, in a case of creating the recycled paper sheet A that serves as the recycled paper sheet Pr2 that is not to be supplied for the printing but on which, for example, the logo mark M is printed, in the paper sheet recycling and printing apparatus 1100 according to the present embodiment, the apparatus and the flow for discharging the recycled paper sheet Pr2 via the printing section 500 are employed, it is possible to easily obtain the recycled paper sheet A on which the logo mark M is printed.

Eighth Embodiment

As an eighth embodiment, the printing apparatus 2000 provided with the storage section 300 including the recycled paper sheet storage unit 320 will be described. In addition, the printing apparatus 2000 according to the present embodiment has an aspect in which the paper sheet recycling section 100 of the paper sheet recycling and printing apparatus 1000 according to the sixth embodiment is configured as a paper sheet recycling apparatus 2100 that serves as an independent apparatus and is incorporated in a paper sheet recycling and printing system 10000. Therefore, the same reference numerals will be given to the same configuration elements as those of the paper sheet recycling and printing apparatus 1000 according to the sixth embodiment, and the description thereof will be omitted.

More specifically, in the printing apparatus 2000 according to the present embodiment, the printing section 500, the transport section 400, the storage section 300, and the recycled paper sheet supply section 200 have the same reference numerals as those of the paper sheet recycling and printing apparatus 1000 according to the sixth embodiment.

Figure 20:
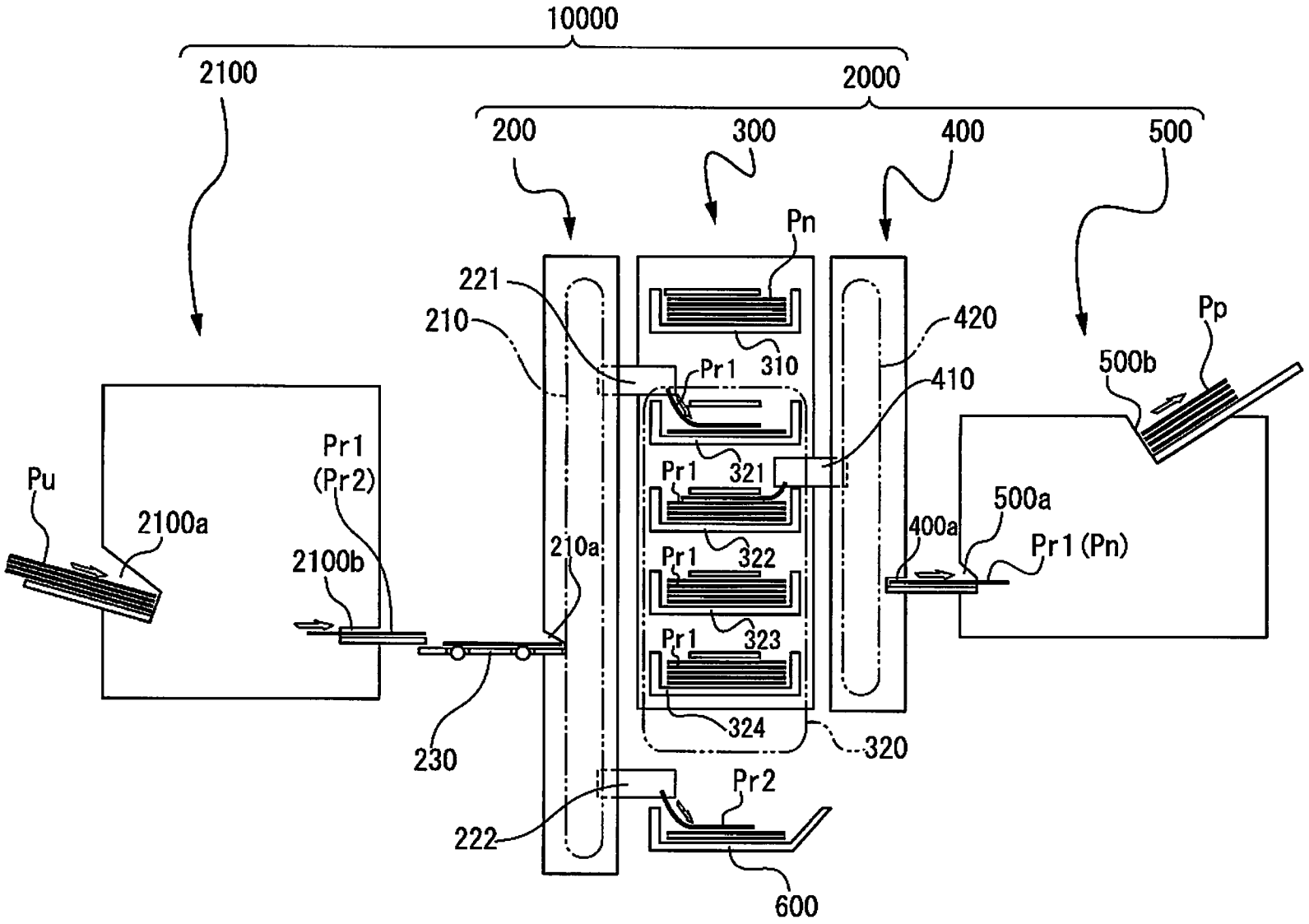
FIG. 20 is a configuration view illustrating a schematic configuration of a paper sheet recycling and printing system including a printing apparatus according to an eighth embodiment.

As illustrated in FIG. 20, the paper sheet recycling and printing system 10000 includes the paper sheet recycling apparatus 2100 and the printing apparatus 2000. The paper sheet recycling apparatus 2100 includes the same apparatus configuration (refer to FIG. 13) on the inside thereof as the paper sheet recycling section 100 provided in the paper sheet recycling and printing apparatus 1000 illustrated in FIG. 12, for example, and the waste paper sheet Pu supplied to the waste paper sheet supply section 2100*a* is discharged to a recycled paper sheet discharge section (second recycled paper sheet storage section) 2100*b* as the printing recycled paper sheet Pr1 or the recycled paper sheet Pr2.

The discharged printing recycled paper sheet Pr1 or recycled paper sheet Pr2 is transported to the recycled paper sheet insertion port 210*a* of the recycled paper sheet supply section 200 via the supply transport section 230. Then, the transported recycled paper sheet Pr1 is supplied to and stored in any of the recycled paper sheet storage sections (first recycled paper sheet storage sections) 321, 322, 323, and 324 provided in the recycled paper sheet storage unit 320 by the first recycled paper sheet supply means (recycled paper sheet storage and supply means) 221 of the recycled paper sheet supply section 200. Meanwhile, the recycled paper sheet Pr2 that is not to be supplied for the printing is supplied to and stored in the recycled paper sheet storage section (second recycled paper sheet storage section) 600 by the second recycled paper sheet supply means (recycled paper sheet discharge and supply means) 222.

The supply transport section 230 is provided in the recycled paper sheet supply section 200, but is disposed to be detachable from the paper sheet recycling apparatus 2100. In this manner, as the paper sheet recycling apparatus 2100 and the printing apparatus 2000 are configured to be separable at the position of the supply transport section 230, it is possible to easily exchange only the paper sheet recycling apparatus 2100, and to easily perform maintenance and management of the paper sheet recycling and printing system 10000.

In addition, in the printing apparatus 2000 according to the present embodiment, since a flow for supplying the printing recycled paper sheet Pr1 supplied from the paper sheet recycling apparatus 2100 to the recycled paper sheet storage unit 320 and a flow for supplying the recycled paper sheet Pr2 to the recycled paper sheet discharge section (second recycled paper sheet storage section) 600 are the same as those of the flowchart illustrated in FIG. 14, the description thereof will be omitted. In addition, since a flow for transporting and supplying the new paper sheet Pn or the printing recycled paper sheet Pr1 stored in the storage section 300 to the printing section 500 and forming the printed material Pp is the same as that of the flowchart illustrated in FIG. 15, the description thereof will be omitted.

The paper sheet recycling and printing system 10000 including the printing apparatus 2000 according to the present embodiment may be a paper sheet recycling and printing system in which the recycled paper sheet discharge section (second recycled paper sheet storage section) 600 provided in the paper sheet recycling and printing apparatus 1000 according to the sixth embodiment is provided, the recycled paper sheet Pr2 that is not to be supplied for the printing is stored in the recycled paper sheet discharge section 600, the recycled paper sheet storage section 600 functions as the taking-out section of the recycled paper sheet Pr2, but the storage section 800 according to the seventh embodiment is provided.

In other words, in the paper sheet recycling and printing system 10000 illustrated in FIG. 20, the recycled paper sheet supply section 700 can be installed instead of the recycled paper sheet supply section 200 provided in the printing apparatus 2000, the storage section 800 can be installed instead of the storage section 300, and the transport section 900 can be installed instead of the transport section 400. Accordingly, the recycled paper sheet Pr2 can be discharged to the printed material discharge section 500*b* provided in the printing section 500 instead of the recycled paper sheet discharge section (second recycled paper sheet storage section) 600 (refer to FIG. 16).

Ninth Embodiment

As a ninth embodiment, the paper sheet recycling apparatus 3000 provided with the storage section 300 including the recycled paper sheet storage unit 320 and the recycled paper sheet discharge section (second recycled paper sheet storage section) 600 will be described. In addition, the paper sheet recycling apparatus 3000 according to the present embodiment has an aspect in which the printing section 500 of the paper sheet recycling and printing apparatus 1000 according to the sixth embodiment is configured as the printing apparatus 3100 that serves as an independent apparatus and is incorporated in the paper sheet recycling and printing system 20000. Therefore, the same reference numerals will be given to the same configuration elements as those of the paper sheet recycling and printing apparatus 1000 according to the sixth embodiment, and the description thereof will be omitted.

More specifically, in the paper sheet recycling apparatus 3000 according to the present embodiment, the paper sheet recycling section 100, the recycled paper sheet supply section 200, the storage section 300, and the transport section 400, are the same configuration elements as those of the paper sheet recycling and printing apparatus 1000 according to the sixth embodiment.

Figure 21:
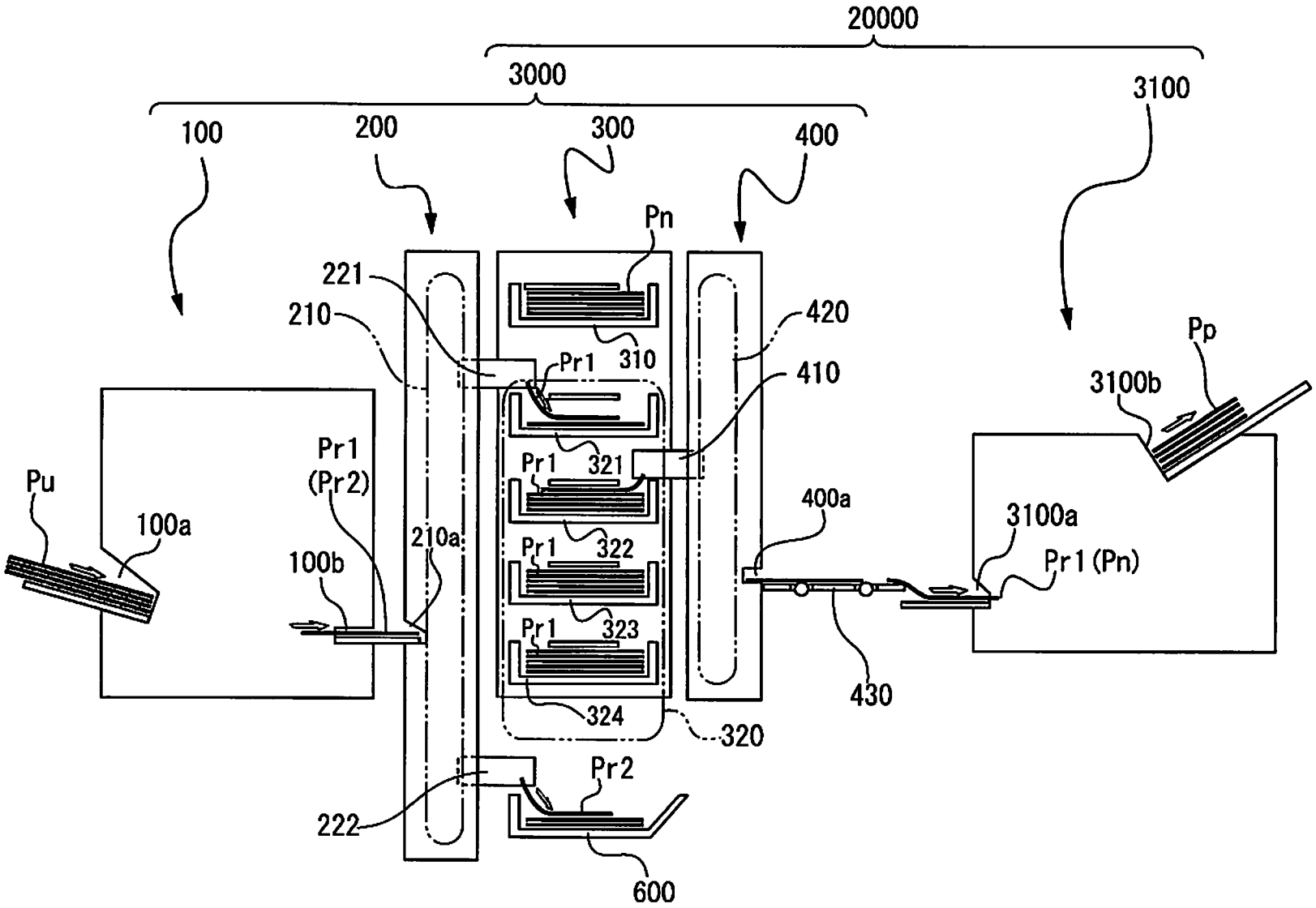
FIG. 21 is a configuration view illustrating a schematic configuration of a paper sheet recycling and printing system including a paper sheet recycling apparatus according to a ninth embodiment.

As illustrated in FIG. 21, the paper sheet recycling and printing system 20000 includes the paper sheet recycling apparatus 3000 and the printing apparatus 3100. The paper sheet recycling apparatus 3000 stores the printing recycled paper sheet Pr1 among the recycled paper sheets formed in the paper sheet recycling section 100 in any of the plurality of recycled paper sheet storage sections (first recycled paper sheet storage sections) 321, 322, 323, and 324 of the recycled paper sheet storage unit 320 provided in the storage section 300, supplies the new paper sheet Pn that serves as the predetermined recording target medium from the paper sheet storage section 310 by the print command from the printing apparatus 3100, supplies the printing recycled paper sheet Pr1 from the recycled paper sheet storage section 320 to the printing apparatus 3100 according to the flowchart illustrated in FIG. 15, and obtains the printed material Pp. Further, the paper sheet recycling apparatus 3000 is an apparatus which supplies the recycled paper sheet Pr2 that is not to be supplied for the printing among the recycled paper sheets formed in the paper sheet recycling section 100 to the recycled paper sheet discharge section (second recycled paper sheet storage section) 600 by the second recycled paper sheet supply means (recycled paper sheet discharge and supply means) 222 of the recycled paper sheet supply section 200 and stores the recycled paper sheet Pr2 therein.

Between the transport section 400 and the printing apparatus 3100, the new paper sheet Pn or the printing recycled paper sheet Pr1 of the recording target medium discharged from the paper sheet supply section 400*a* is transported to the paper sheet taking-in section 3100*a* of the printing apparatus 3100 by the supply transport section 430 provided in the transport section 400.

The supply transport section 430 is disposed separably between the paper sheet recycling apparatus 3000 and the printing apparatus 3100, and can easily exchange the printing apparatus 3100. In other words, in the paper sheet recycling and printing system 20000, the printing apparatus 3100 is an apparatus that is easily applied to an appropriate printing apparatus according to work, for example, from a laser printer to an ink jet printer or a printing apparatus having a faster printing speed, or from a monochrome printer to a color printer.

In addition, in the paper sheet recycling apparatus 3000 according to the present embodiment, since a flow for supplying the printing recycled paper sheet Pr1 supplied from the paper sheet recycling section 100 to the recycled paper sheet storage unit 320 and a flow for supplying the recycled paper sheet Pr2 to the recycled paper sheet discharge section (second recycled paper sheet storage section) 600 are the same as those of the flowchart illustrated in FIG. 14, the description thereof will be omitted. In addition, since a flow for transporting and supplying the new paper sheet Pn or the printing recycled paper sheet Pr1 stored in the storage section 300 to the printing apparatus 3100 and forming the printed material Pp is the same as that of the flowchart illustrated in FIG. 15, the description thereof will be omitted.

The paper sheet recycling and printing system 20000 including the paper sheet recycling apparatus 3000 according to the present embodiment may be a paper sheet recycling and printing system in which the recycled paper sheet discharge section (second recycled paper sheet storage section) 600 provided in the paper sheet recycling and printing apparatus 1000 according to the sixth embodiment is provided, the recycled paper sheet Pr2 that is not to be supplied for the printing is stored in the recycled paper sheet discharge section 600, the recycled paper sheet storage section 600 functions as the taking-out section of the recycled paper sheet Pr2, but the storage section 800 according to the seventh embodiment is provided.

In other words, in the paper sheet recycling and printing system 20000 illustrated in FIG. 21, the recycled paper sheet supply section 700 can be installed instead of the recycled paper sheet supply section 200 provided in the paper sheet recycling apparatus 3000, the storage section 800 can be installed instead of the storage section 300, and the transport section 900 can be installed instead of the transport section 400. Accordingly, the recycled paper sheet Pr2 can be discharged to the printed material discharge section 3100*b* provided in the printing apparatus 3100 instead of the recycled paper sheet discharge section (second recycled paper sheet storage section) 600 (refer to FIG. 16).

As described above, in the paper sheet recycling and printing apparatus 1000 according to the sixth embodiment, the paper sheet recycling and printing apparatus 1100 according to the seventh embodiment, the paper sheet recycling and printing system 10000 including the printing apparatus 2000 according to the eighth embodiment, and the paper sheet recycling and printing system 20000 including the paper sheet recycling apparatus 3000 according to the ninth embodiment, as the plurality of recycled paper sheet storage sections (first recycled paper sheet storage sections) 321, 322, 323, and 324 are provided in the recycled paper sheet storage unit 320 as illustrated in FIG. 12 or the plurality of printing recycled paper sheet storage sections (first recycled paper sheet storage sections) 821, 822, 823, and 824 are provided in the printing recycled paper sheet storage unit 820 as illustrated in FIG. 16, even when there is no printing recycled paper sheet Pr1 from the predetermined recycled paper sheet storage section (predetermined first recycled paper sheet storage section) 32A from which the printing recycled paper sheet Pr1 transported to the printing section 500 or the printing apparatus 3100 is taken out, as illustrated in the flowchart of FIG. 15, one of the recycled paper sheet storage sections (first recycled paper sheet storage sections) 321, 323, and 324 except for the predetermined recycled paper sheet storage section (predetermined first recycled paper sheet storage section) 32A, that is, the recycled paper sheet storage section (first recycled paper sheet storage section) 322 in the example of the setting of the above-described embodiment, or one of other printing recycled paper sheet storage sections (first recycled paper sheet storage sections) 821, 823, and 824 except for the printing recycled paper sheet storage section (first recycled paper sheet storage section) 822, is reset (step S34) as the predetermined recycled paper sheet storage section (predetermined first recycled paper sheet storage section) 32A, and accordingly, it is possible to continue the printing without interruption.

Furthermore, when one of the recycled paper sheet storage sections (first recycled paper sheet storage sections) 321, 323, and 324 except for the predetermined recycled paper sheet storage section (predetermined first recycled paper sheet storage section) 32A, that is, the recycled paper sheet storage section (first recycled paper sheet storage section) 322 in the example of the setting of the present embodiment, or one of other printing recycled paper sheet storage sections (first recycled paper sheet storage sections) 821, 823, and 824 except for the printing recycled paper sheet storage section (first recycled paper sheet storage section) 822, is reset (step S34) as the predetermined recycled paper sheet storage section (predetermined first recycled paper sheet storage section) 32A, any of the recycled paper sheet storage sections (first recycled paper sheet storage sections) 323 and 324 further except for another recycled paper sheet storage section (another first recycled paper sheet storage section) 32B to which the printing recycled paper sheet Pr1 formed in the paper sheet recycling section 100 or the paper sheet recycling apparatus 2100 and the recycled paper sheet storage section (another first recycled paper sheet storage section) 321 in the example of the setting of the above-described embodiment, or any of the printing recycled paper sheet storage sections (first recycled paper sheet storage sections) 823 and 824 further except for the printing recycled paper sheet storage section (first recycled paper sheet storage section) 821, is reset as another recycled paper sheet storage section (first recycled paper sheet storage section) 32B. Therefore, when the printing recycled paper sheet Pr1 transported from the predetermined recycled paper sheet storage section (predetermined first recycled paper sheet storage section) 32A to the printing section 500 or the printing apparatus 3100 is taken out, there is no case where the supply of the printing recycled paper sheet Pr1 from the paper sheet recycling section 100 or the paper sheet recycling apparatus 2100 overlaps the taking-out. Therefore, it is possible to prevent occurrence of jamming at the time of paper feeding to the printing section 500 or the printing apparatus 3100.

Further, in the paper sheet recycling section 100, it is possible to form the printing recycled paper sheet Pr1 to be supplied for the printing and the recycled paper sheet Pr2 that is not to be supplied for the printing. Since at least two types of recycled paper sheets (printing recycled paper sheet Pr1 and recycled paper sheet Pr2) are used differently, and in particular, the recycled paper sheet Pr2 is simply used as the recycled paper sheet cut form, and in the paper sheet recycling and printing apparatus 1000 and the paper sheet recycling and printing systems 10000 and 20000 according to the above-described embodiments, the recycled paper sheet discharge section (second recycled paper sheet storage section) 600 is provided, and accordingly, it is possible to easily take out the recycled paper sheet Pr2.

In addition, in the paper sheet recycling and printing apparatus 1100, even when the recycled paper sheet Pr2 is supplied from the transport section 900 to the printing section 500, the taking-out section of the printed material Pp and the recycled paper sheet Pr2 in the apparatus can be used commonly by discharging the paper sheets to the printed material discharge section 500*b* without printing, and it is possible to provide ease of taking out the paper sheet.

REFERENCE SIGNS LIST

100 paper sheet recycling section
200 recycled paper sheet supply section
300 storage section
400 transport section
500 printing section
1000 paper sheet recycling and printing apparatus

The invention claimed is:

1. A paper sheet recycling and printing apparatus comprising:

a paper sheet recycling section which manufactures recycled paper sheets by defibrating a waste paper sheet and forming the recycled paper sheets from defibrated material of the waste paper sheet, the recycled paper sheets including a first recycled paper sheet and a second recycled paper sheet different from the first recycled paper sheet, the paper sheet recycling section manufacturing the first recycled paper sheet under a first condition and the second recycled paper sheet under a second condition different from the first condition;

a first recycled paper sheet storage section in which the first recycled paper sheet manufactured under the first condition is stored;

a second recycled paper sheet storage section which is different from the first recycled paper sheet storage section and in which the second recycled paper sheet manufactured under the second condition is stored; and a printing section to which the first recycled paper sheet manufactured under the first condition is supplied from the first recycled paper sheet storage section and which prints recording information on a recording target medium including the first recycled paper sheet.

2. The paper sheet recycling and printing apparatus according to claim 1, further comprising:

a first recycled paper sheet supply section which supplies the first recycled paper sheet from the paper sheet recycling section to the first recycled paper sheet storage section; and a second recycled paper sheet supply section which supplies the second recycled paper sheet to the second recycled paper sheet storage section.

3. The paper sheet recycling and printing apparatus according to claim 1, further comprising:

a transport section which transports the first recycled paper sheet manufactured under the first condition and stored in the first recycled paper sheet storage section to the printing section.

4. The paper sheet recycling and printing apparatus according to claim 2, further comprising:

supply section switching means for switching between the first recycled paper sheet supply section and the second recycled paper sheet supply section.

5. The paper sheet recycling and printing apparatus according to claim 1, wherein a plurality of the first recycled paper sheet storage sections is provided.

6. The paper sheet recycling and printing apparatus according to claim 1, wherein the second recycled paper sheet storage section makes it possible to take out the stored second recycled paper sheet manufactured under the second condition from the outside.

7. The paper sheet recycling and printing apparatus according to claim 1, further comprising:

a printed material storage section in which a printed material obtained by printing the recording information on the recording target medium by the printing section is stored, wherein the printed material storage section also serves as the second recycled paper sheet storage section.

8. The paper sheet recycling and printing apparatus according to claim 5, wherein the first recycled paper sheet is not supplied to a predetermined first recycled paper sheet storage section among the plurality of first recycled paper sheet storage sections and the first recycled paper sheet stored in the predetermined first recycled paper sheet storage section is transported to the printing section by the transport section.

9. The paper sheet recycling and printing apparatus according to claim 5, wherein the first recycled paper sheet supply section includes storage section switching means that is capable of transporting the first recycled paper sheet to one of the plurality of first recycled paper sheet storage sections.

10. The paper sheet recycling and printing apparatus according to claim 3, wherein the transport section makes it possible to transport the second recycled paper sheet manufactured under the second condition and stored in the second recycled paper sheet storage section to the printing section, wherein the printing section includes a paper sheet transport path including printing means for printing the recording information on the recording target medium, and wherein the second recycled paper sheet manufactured under the second condition, transported to the printing section and stored in the second recycled paper sheet storage section, is transported through the paper sheet transport path with or without executing printing by the printing means, and is stored in the printed material storage section.

11. The paper sheet recycling and printing apparatus according to claim 9, wherein the storage section switching means switches to supply of the first recycled paper sheet from the first recycled paper sheet supply section to one first recycled paper sheet storage section in which there is no first recycled paper sheet among the plurality of first recycled paper sheet storage sections.

12. The paper sheet recycling and printing apparatus according to claim 5, wherein the transport section includes transport switching means for setting one of the plurality of first recycled paper sheet storage sections in which the first recycled paper sheet is stored as the first recycled paper sheet storage section from which the first recycled paper sheet manufactured under the first condition is supplied to the printing section when there is no first recycled paper sheet stored in the first recycled paper sheet storage section, and transporting the first recycled paper sheet from the set first recycled paper sheet storage section.

13. The paper sheet recycling and printing apparatus according to claim 1, further comprising:

a setting section, wherein a control is performed based on setting of the setting section.

14. The paper sheet recycling and printing apparatus according to claim 13, wherein the paper sheet recycling section manufactures the first recycled paper sheet manufactured under the first condition or the second recycled paper sheet manufactured under the second condition based on the setting of the setting section.

15. A printing apparatus comprising:

a determining section which determines whether a recycled paper sheet to be supplied from a paper sheet recycling apparatus, which manufactures the recycled paper sheet by defibrating a waste paper sheet and forming the recycled paper sheet from defibrated material of the waste paper sheet, is a first recycled paper sheet that has been manufactured under a first condition at the paper sheet recycling apparatus, or a second recycled paper sheet that is different from the first recycled paper sheet and has been manufactured under a second condition different from the first condition at the paper sheet recycling apparatus;

a first recycled paper sheet storage section in which the first recycled paper sheet manufactured under the first condition is stored;

a second recycled paper sheet storage section which is different from the first recycled paper sheet storage section and in which the second recycled paper sheet manufactured under the second condition is stored; and a printing section to which the first recycled paper sheet manufactured under the first condition is supplied from the first recycled paper sheet storage section and which prints recording information on a recording target medium including the first recycled paper sheet.

16. The printing apparatus according to claim 15, further comprising:

a first recycled paper sheet supply section which supplies the first recycled paper sheet from the paper sheet recycling apparatus to the first recycled paper sheet storage section; and a second recycled paper sheet supply section which supplies the second recycled paper sheet to the second recycled paper sheet storage section.

17. The printing apparatus according to claim 15, further comprising:

a transport section which transports at least the first recycled paper sheet manufactured under the first condition and stored in the first recycled paper sheet storage section to the printing section.

18. The printing apparatus according to claim 16, further comprising:

supply section switching means for switching between the first recycled paper sheet supply section and the second recycled paper sheet supply section.

19. The printing apparatus according to claim 15, wherein a plurality of the first recycled paper sheet storage sections is provided.

20. The printing apparatus according to claim 15, wherein the second recycled paper sheet storage section makes it possible to take out the stored second recycled paper sheet manufactured under the second condition from the outside.

21. The printing apparatus according to claim 15, further comprising:

a printed material storage section in which a printed material obtained by printing the recording information on the recording target medium by the printing section is stored, wherein the printed material storage section also serves as the second recycled paper sheet storage section.

22. The printing apparatus according to claim 19, wherein the first recycled paper sheet is not supplied to a predetermined first recycled paper sheet storage section among the plurality of first recycled paper sheet storage sections and the first recycled paper sheet stored in the predetermined first recycled paper sheet storage section is transported to the printing section by the transport section.

23. The printing apparatus according to claim 19, wherein the first recycled paper sheet supply section includes storage section switching means that is capable of transporting the first recycled paper sheet to one of the plurality of first recycled paper sheet storage sections.

24. The printing apparatus according to claim 17, wherein the transport section makes it possible to transport the second recycled paper sheet manufactured under the second condition and stored in the second recycled paper sheet storage section to the printing section, wherein the printing section includes a paper sheet transport path including printing means for printing the recording information on the recording target medium, and wherein the second recycled paper sheet manufactured under the second condition, transported to the printing section and stored in the second recycled paper sheet storage section, is transported through the paper sheet transport path with or without executing printing by the printing means, and is stored in the printed material storage section.

25. The printing apparatus according to claim 23, wherein the storage section switching means switches to supply of the first recycled paper sheet from the first recycled paper sheet supply section to one first recycled paper sheet storage section in which there is no first recycled paper sheet among the plurality of first recycled paper sheet storage sections.

26. The printing apparatus according to claim 15, wherein the second recycled paper sheet supply section supplies the second recycled paper sheet to the printing section, and the unprinted second recycled paper sheet is discharged to a recording target medium discharge section by which the recording target medium is discharged from the printing section.

27. The printing apparatus according to claim 15, further comprising:

a setting section, wherein a control is performed based on setting of the setting section.

28. The printing apparatus according to claim 27, wherein the determining section performs determination based on the setting of the setting section.

29. A paper sheet recycling apparatus comprising:

a paper sheet recycling section which manufactures recycled paper sheets by defibrating a waste paper sheet and forming the recycled paper sheets from defibrated material of the waste paper sheet, the recycled paper sheets including a first recycled paper sheet and a second recycled paper sheet different from the first recycled paper sheet, the paper sheet recycling section manufacturing the first recycled paper sheet under a first condition and the second recycled paper sheet under a second condition different from the first condition;

a determining section which determines whether the recycled paper sheet is the first recycled paper sheet manufactured under the first condition or the second recycled paper sheet manufactured under the second condition;

a first recycled paper sheet storage section in which the first recycled paper sheet manufactured under the first condition is stored; and a second recycled paper sheet storage section which is different from the first recycled paper sheet storage section and in which the second recycled paper sheet manufactured under the second condition is stored, wherein the first recycled paper sheet manufactured under the first condition is supplied from the first recycled paper sheet storage section to a printing apparatus.

30. The paper sheet recycling apparatus according to claim 29, further comprising:

a first recycled paper sheet supply section which supplies the first recycled paper sheet to the first recycled paper sheet storage section;

a second recycled paper sheet supply section which supplies the second recycled paper sheet to the second recycled paper sheet storage section; and supply section switching means which switches the first recycled paper sheet supply section and the second recycled paper sheet supply section.

31. The paper sheet recycling apparatus according to claim 29, further comprising:

a transport section which transports at least the first recycled paper sheet manufactured under the first condition and stored in the first recycled paper sheet storage section to the printing apparatus.

32. The paper sheet recycling apparatus according to claim 29, wherein a plurality of the first recycled paper sheet storage sections is provided.

33. The paper sheet recycling apparatus according to claim 29, wherein the second recycled paper sheet storage section makes it possible to take out the stored second recycled paper sheet manufactured under the second condition from the outside.

34. The paper sheet recycling apparatus according to claim 32, wherein the first recycled paper sheet is not supplied to a predetermined first recycled paper sheet storage section among the plurality of first recycled paper sheet storage sections and the first recycled paper sheet stored in the predetermined first recycled paper sheet storage section is transported to the printing apparatus by the transport section.

35. The paper sheet recycling apparatus according to claim 32, wherein the first recycled paper sheet supply section includes storage section switching means that is capable of transporting the first recycled paper sheet to one of the plurality of first recycled paper sheet storage sections.

36. The paper sheet recycling apparatus according to claim 31, wherein the transport section makes it possible to transport the second recycled paper sheet manufactured under the second condition and stored in the second recycled paper sheet storage section to the printing apparatus, and wherein the second recycled paper sheet manufactured under the second condition, stored in the second recycled paper sheet storage section, and transported to the printing apparatus is stored in the printed material storage section provided in the printing apparatus with or without executing the printing.

37. The paper sheet recycling apparatus according to claim 35, wherein the storage section switching means switches to supply of the first recycled paper sheet from the first recycled paper sheet supply section to one first recycled paper sheet storage section in which there is no first recycled paper sheet among the plurality of first recycled paper sheet storage sections.

38. The paper sheet recycling apparatus according to claim 29, further comprising:

a setting section, wherein a control is performed based on setting of the setting section.

39. The paper sheet recycling apparatus according to claim 38, wherein the determining section performs determination based on the setting of the setting section.

* * * * *